United States Patent [19]

Schmitz et al.

[11] 4,211,065

[45] Jul. 8, 1980

[54] AUTOMATIC SYSTEM FOR SETTING DIGITAL WATCHES

[75] Inventors: Lawrence S. Schmitz, Costa Mesa; Curtis E. Dodds, Stanton; John Whipple, Santa Ana, all of Calif.

[73] Assignee: Hughes Aircraft Company, Culver City, Calif.

[21] Appl. No.: 827,991

[22] Filed: Aug. 26, 1977

[51] Int. Cl.[2] ..... G04B 1/00

[52] U.S. Cl. ..... 368/47; 368/85; 368/185; 368/1

[58] Field of Search ..... 58/23 C, 23 R, 33, 34, 58/35 W, 85.5, 145 K, 145 R; 73/6

[56] References Cited

U.S. PATENT DOCUMENTS

| | | | |
|---|---|---|---|
| 3,978,322 | 8/1976 | Dobkin | 73/6 |
| 4,020,628 | 5/1977 | Vittoz | 58/145 K |
| 4,023,344 | 5/1977 | Mukaiyama | 58/35 W |
| 4,051,663 | 10/1977 | Chihara et al. | 58/35 W |
| 4,117,663 | 10/1978 | Mosimann et al. | 58/23 R |
| 4,120,148 | 10/1978 | Moyer | 58/85.5 |
| 4,125,993 | 11/1978 | Emile, Jr. | 58/145 K |
| 4,147,022 | 4/1979 | Ichikawa | 58/50 R |

OTHER PUBLICATIONS

M. Schwartz, Information Transmission, Modulation, and Noise, 1970, p. 138, pp. 176–178.

*Primary Examiner*—Gene Z. Rubinson
*Assistant Examiner*—Forester W. Isen
*Attorney, Agent, or Firm*—Walter J. Adam; W. H. MacAllister

[57] ABSTRACT

A system for automatically time setting and message setting or programming of a cased digital watch or a watch module and including both an external setting unit and a serial interface control circuit inside the cased digital watch. The system in accordance with the invention is compatible with either watches that require time setting or watches that require both time setting and message programming and is applicable to any type of manually controllable watch. The time and message set system has a data entry unit that includes a keyboard, a display, a reference time module, a memory, a light source such as a light emitting diode or an LED array as an output and a processor which provides central control of the other functional units. The LED array output supplies coded messages to a light or energy responsive device or phototransistor in position under the face of the watch. The watch includes a novel circuit for responding to the phototransistor and provides time setting and message setting.

19 Claims, 62 Drawing Figures

DATA TIMER CIRCUIT 90

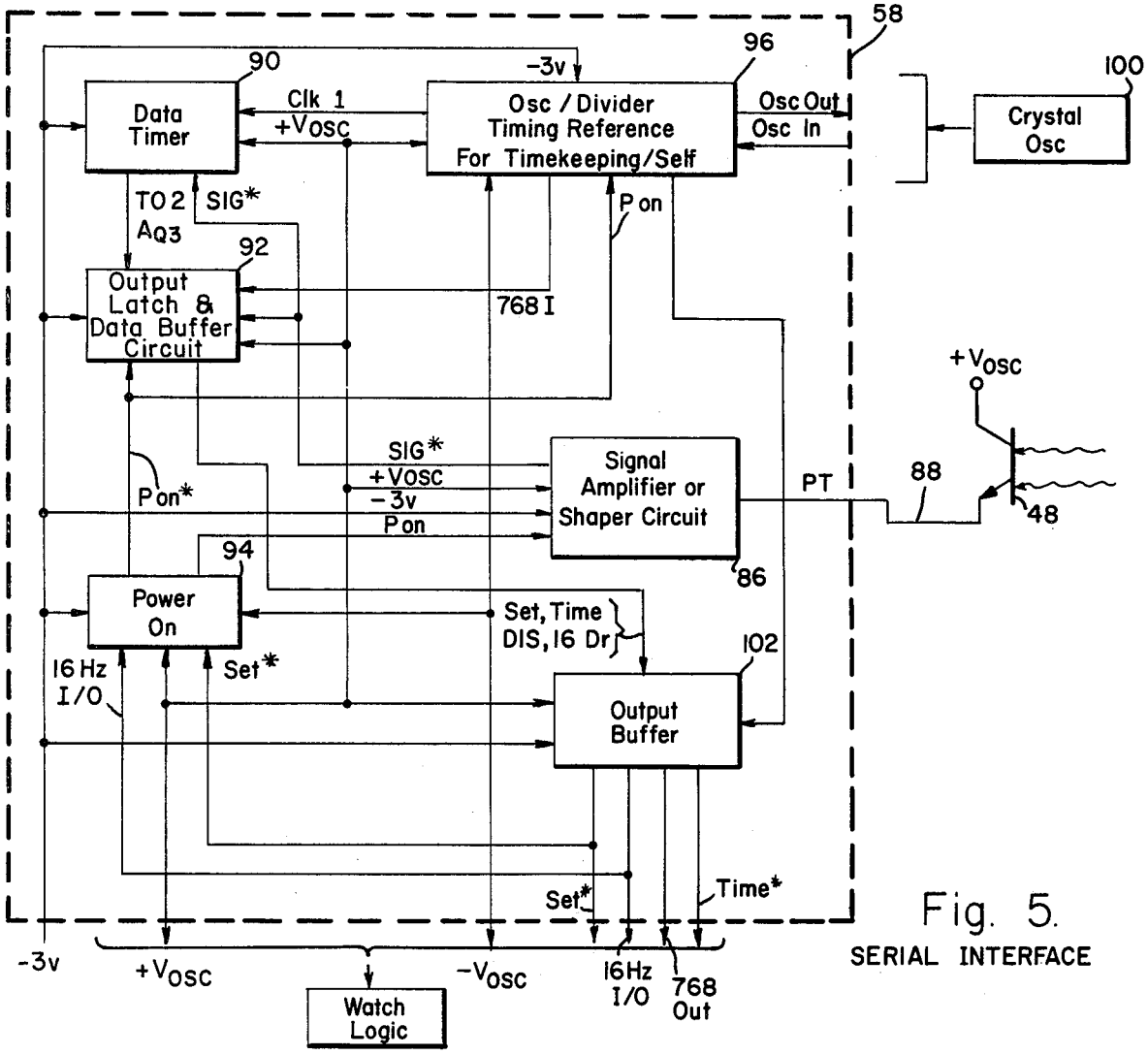
Fig. 5.
SERIAL INTERFACE
Fig. 6.
AMPLIFIER/SHAPER CIRCUIT 86
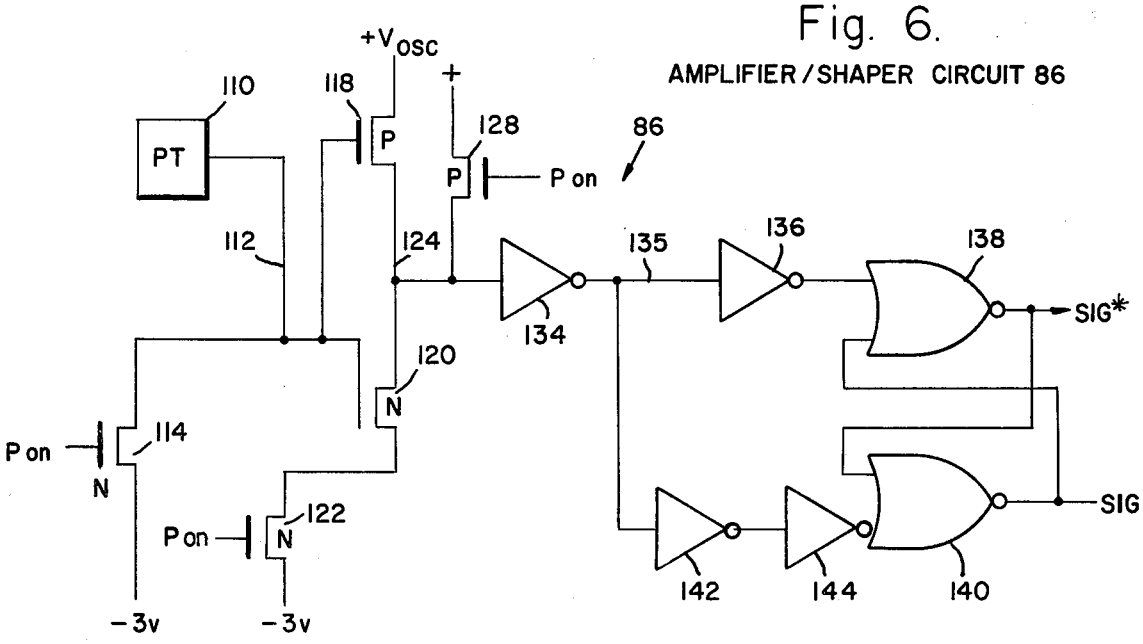

POWER ON CIRCUIT 94

OSCILLATOR DIVIDER
CIRCUIT 96

OUTPUT BUFFERS CIRCUITS 102

LATCH

OUTPUT LATCH AND DATA BUFFER CIRCUIT 92
Latch
Latch
Latch
Toggle FF
DFF
Time
Set
DIS
16 Dr
SIG*
UNL
UNL*
P on
P on*
TO2
AQ3
TCLOCK
+VOSC
CLK1
TO
TQ
768I INITIAL DIVIDER 490
768 Hz
560
LS
In Out
561
768
EDOR
562
768P
-3v
0v
128 Hz
IT*
DFF
564
Q1
Q2
Q3
16 Hz I/O
TFF
566
567
568
569
490

1st Half Reset
2nd Half Reset
569a
571
D
588
1 Hz
1 HzP*
586
SZ
584
587
TFF ASYNC
580
582
581
583
16 HzP
2 Hz
16 HzP (To CLKC Only)
2 Hz (To SLEW MSG Control Only)
EDOR
573

SET SEQUENCE CONTROL 516

SHIFT REG. CONTROL

SETTING LETTER COUNTER

WORD COUNTER

CLOCK & SLEW CONTROL 530

PUSH COUNTER

INITIAL DIVIDER TIMING

CLOCK C TIMING, SLOW SLEW & FAST SLEW $\phi_A/\phi_B$ TIMING WITH DMSG = 1

DEBOUNCE TIMING

OVERALL PROGRAM

SET TIME ONLY

| KEYBOARD AND DISPLAY MEMORY | |
|---|---|
| 0AA0<br>A1 | SEG. 1<br>DIGIT 1 |
| A2<br>A3 | SEG. 2<br>DIGIT 2 |
| A4<br>A5 | SEG. 3<br>DIGIT 3 |
| A6<br>A7 | SEG. 4<br>DIGIT 4 |
| A8<br>A9 | SEG. 5<br>DIGIT 5 |

SET WORD INTO WATCH

READ REAL TIME & CALCULATE No. OF OUTPUT PULSES

READ AND STORE
(IN DISPLAY MEMORY)
REAL TIME CLOCK

READ REAL TIME AND SET WATCH

CALL TIME TWICE IN ONE SECOND

CALL TIME ONCE IN ONE SECOND

SEQUENCE WATCH SET

CALL T, S (TIME AND SET) SUBROUTINE

CALL T, $\overline{S}$ (TIME AND $\overline{SET}$) SUBROUTINE

CALL S,$\overline{T}$ (SET & TIME) SUBROUTINE

CALL $\overline{T}$, $\overline{S}$
($\overline{TIME}$ AND $\overline{SET}$)
SUBROUTINE OUTPUT 16 Hz Fig. 54
DELAY SUBROUTINE
180 MILLISECONDS
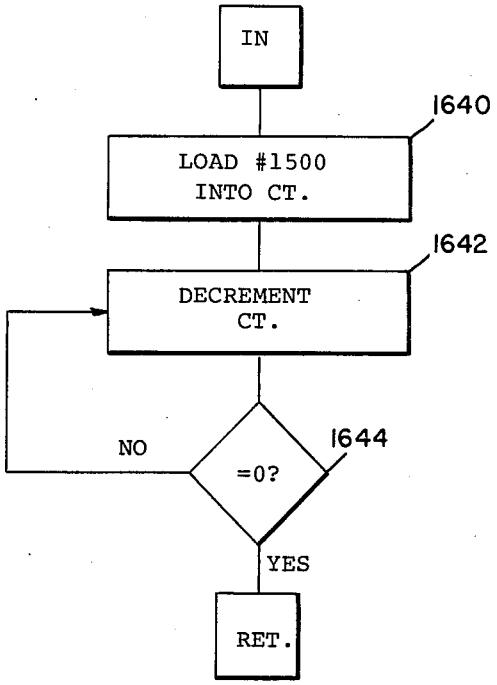
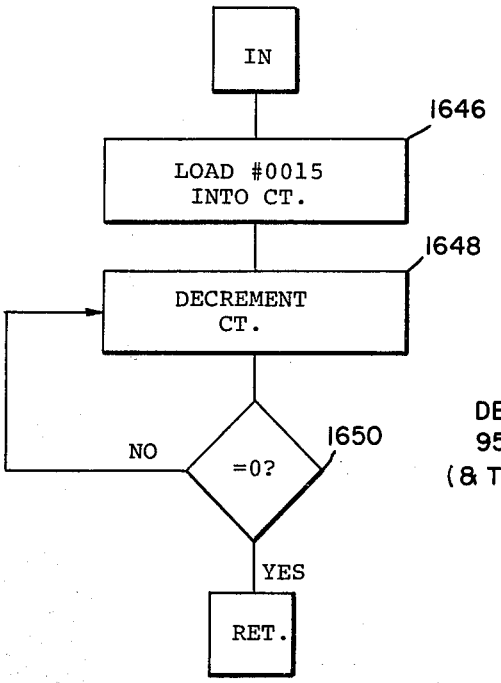
Fig. 55
DELAY SUBROUTINE
950 MICROSECONDS
(& TO2 TIME OUT DELAY)

MUX DISPLAY

AUTOMATIC SYSTEM FOR SETTING DIGITAL WATCHES

BACKGROUND OF THE INVENTION

1. Field of the Invention

This invention relates to digital watches and particularly to a system for automatic time setting and message programming of digital watches.

2. Description of the Prior Art

Previously, digital watches were set by means of a sequence of button pushes, the setting being done manually. In watches in which messages were displayed or message watches, similar arrangements either involving a separate button or additional pushes of the time button were utlized for setting and selecting messages as they slew across the display. The manual setting of both time and messages is relatively time consuming and is especially critical when a number of watches are being either manufactured or sold. It would be a substantial advantage to the art if a system were provided compatible to digital watches that would allow automatic time setting and automatic message setting while the watch was within its case and in its completed condition prior to being released by the manufacturer as well as at watch setting or repair centers.

SUMMARY OF THE INVENTION

A system for automatic time setting and message programming of a cased digital watch or of a watch module in which information is serially transmitted as a string of light energy pulses from a source of light or as energy pulses such as from an LED (light emitting diode) or LED array flooding the display window of the watch. An energy receiving or responsive device such as photosensitive transistor is positioned in the watch display for receiving the serial message. The transmitted information may be in the form of a pulse width modulated code. The data entry unit which applies the message to the LED includes a keyboard which allows an operator to type in messages for transmission to the digital watch, a display providing visual feedback of information entered via the keyboard, a reference time module, a memory, a processor which provides central control of the other functional blocks and a watch holder to establish a watch position to receive the signals from the LED. The digital watch module itself includes a serial interface circuit that controls the logic steps of the watch in response to a series of three bit codes representing a command code and includes connections to the digital watch for simulating the normal manual setting commands of the watch. For initiating a setting operation, a 3-bit command code is transmitted to the interface circuit for unlocking that circuit during the setting. The serial interface circuit automatically locks itself in a short period of time upon termination of the setting operation to allow undisturbed normal watch operation. The processor computes a series of pulses for each time setting of the counters of the divider chain and computes a series of pulses for properly slewing the message counter for each message desired to be stored into the watch message memory. A repetitive transmission of first the code followed by a series of pulses from the LED is provided at a high rate such as 5 khz which then, for example, speeds up the time setting from a normal speed of 16 hz. The message programming is similarly speeded up to a 5 khz rate and as a result, both the time and the message programming is performed in a matter of seconds. The system of the invention is very reliable and does not require careful positioning of the watch in the watch holder because the watch base is flooded with the coded light and secondly, feedback signals are not required from the watch back to the processor in the system in accordance with the invention. Also, within the scope of the invention is setting or programming a group of watches simultaneously by having a plurality of holders each receiving the LED light pulses.

It is therefore an object of this invention to provide a system for automatic time setting of a digital watch.

It is a further object of this invention to provide a system for automatic message programming of a cased digital watch.

It is a further object of this invention to provide a system that allows individual or groups of watches to be programmed in a few seconds with little or no skill required by the operator.

It is still another object of the invention to provide a digital watch including an interface so that it can be automatically time set or message programmed or both.

It is a further object of this invention to provide a digital watch that can be automatically time set or message programmed or both and that provides an automatic locking feature to return the watch to its normal manual condition when not being set or programmed in accordance with the invention.

BRIEF DESCRIPTION OF THE DRAWINGS

These and other objects, features and advantages of the invention as well as the invention itself will become more apparent to those skilled in the art in the light of the following detailed description taken in consideration with the accomanying drawings wherein like reference numerals indicate like or corresponding parts throughout the seveal views wherein:

FIG. 5 is a schematic circuit and block diagram showing the serial interface unit that may be utilized in the watch module;

FIG. 6 is a schematic circuit diagram showing the amplifier/shaper circuit that may be utilized in the serial interface unit;

FIGS. 54 and 55 are flow diagrams for DELAY SUBROUTINES respectively of 180 MILLISECONDS and 950 MICROSECONDS.

DESCRIPTION OF THE PREFERRED EMBODIMENT

Figure 1:
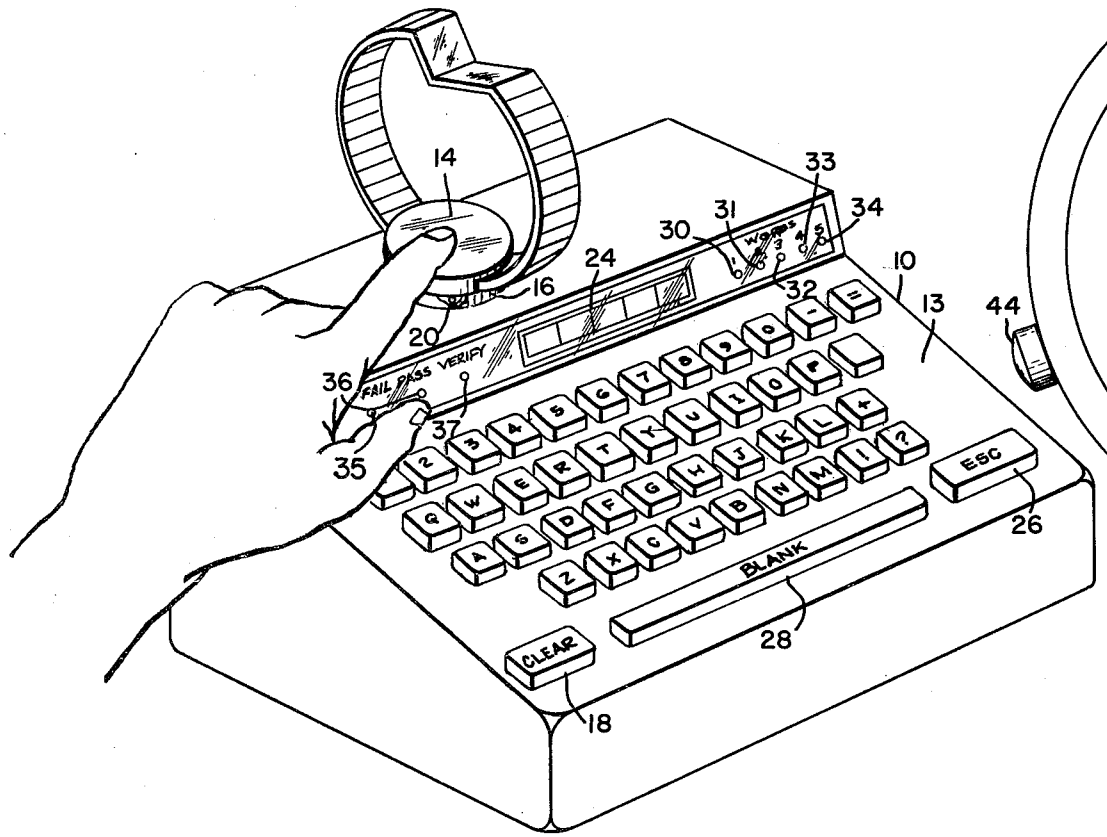
FIG. 1 is an illustrative example of the test unit or data entry unit box having a window or watch holder in which the watch is set for receiving the time set and message set information.

Referring first to FIG. 1 which is an external view of the data entry unit 10 having a keyboard 13, a watch 14 is shown resting on a suitable holding structure 16 with its face down and positioned to receive the light pulses from an LED or LED array 20 illustrated in a broken-away section of the structure 16. The keyboard 13 includes all the characters in the message set. A clear reset button 18 for erasing a message shown on a display 24 and an escape continue button 26 are provided to transfer the message to the LED 20 for transmission to the watch 14. A blank button 28 is also provided and five word lights 30 to 34 indicate to the operator which word is presently being prepared for serial transmission to the watch 14. Also, three lights fail, pass and verify respectively designated 35, 36 and 37 are provided for the operator's information. All display lights may be provided by LED's, for example.

Figure 2:
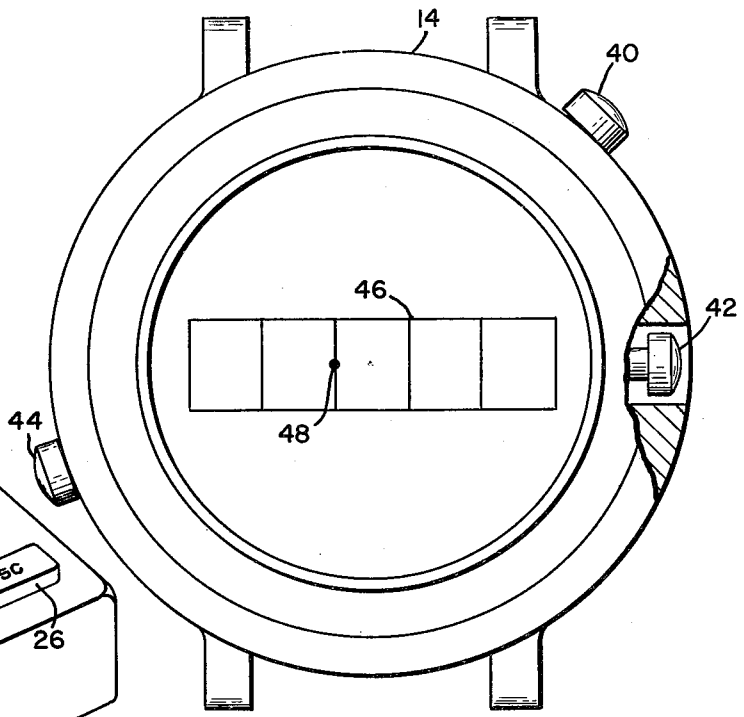
FIG. 2 is a schematic diagram of a typical face of a digital watch showing a location at which the phototransistor may be positioned.

Referring now to FIG. 2, the watch 14 is shown as an illustrative type two button digital watch that may be time set and message set, in accordance with the invention. It is well known in the art that a time button 40 and a recessed button 42 are provided for manually setting a time or message into the watch 14. Also, on some watches, a message button 44 may be provided for ease of storing a message in the watch as well as for displaying the message. The watch may have any number of types of different displays such as the illustrated LED display 46 of five characters. Positioned at the display window may be a light or energy responsive device such as a phototransistor 48 for receiving the signals from the LED array 20 which floods the entire face or window of the watch 14. In other arrangements, the phototransistor 48 may be placed at the edge of the front surface of the watch or at any suitable position. It is to be understood that the principles of the invention are not to be limited to LED displays but include any suitable type of displays such as a liquid crystal display, in which case the photo transistor 48 may be placed in any suitable position such as near the displayed numerals. It is to be noted that a liquid crystal display is driven by a matrix having a code to define each character similar to the illustrated LED display.

Because the LED array 20 floods the watch face with coded signals, the system provides reliable time setting and message setting without accurately aligning of the watch 14 in the holding structure 16. Also within the s;cope of the invention, a suitable optic arrangement may be utilized in the holding structure 16 when desired to focus or direct the light or energy signals.

Figure 3:
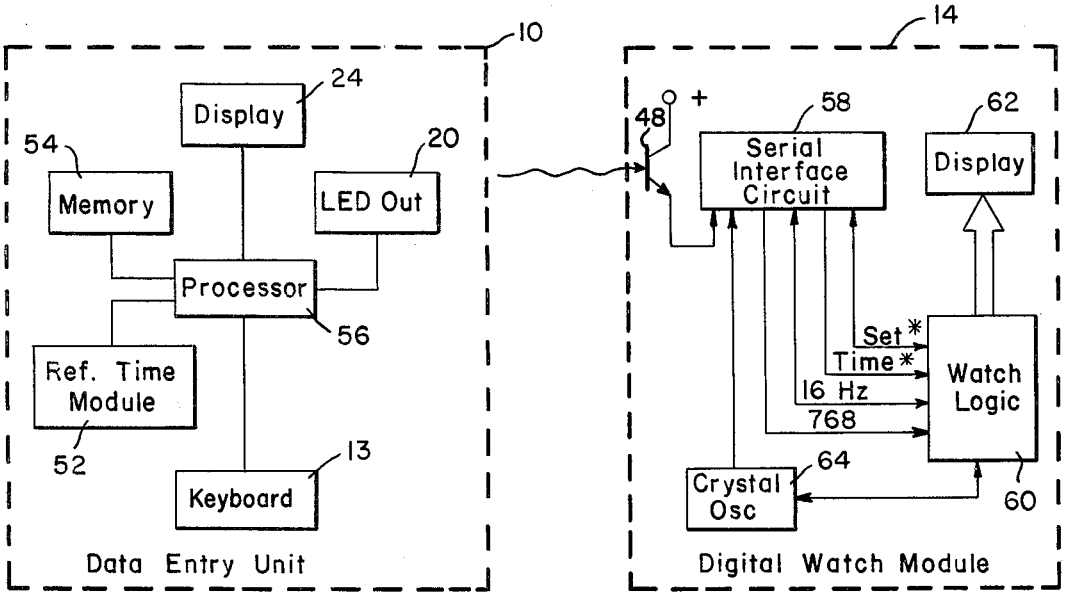
FIG. 3 is a schematic block diagram illustrating the data entry unit and the digital watch module in accordance with the invention.

Referring now to FIG. 3, the data entry unit 10 which is the unit shown in FIG. 1 includes the keyboard 13 which the operator uses to type in messages for transmission to the digital watch and, as previously discussed, control keys for establishing the operating modes. It is to be noted that in the description of the subject invention, an asterisk (*) after a term indicates the logically inverted form of the term. The display 24 provides visual feedback to the operator of information entered through the keyboard by the operator. A reference time module 52 is a watch similar to any of a number of prior art digital watches accurately set for the correct time of day so that when interrogated, it provides time data to be transferred to the digital watch being set. A memory 54 contains a stored program and provides scratch pad storage areas for use by the processor 56, the processor providing central control of the other functional blocks. The LED output 20 as discussed relative to FIG. 1 provides the output data by serially transmitting pulses of light to the digital watch module 14 which may or may not be cased, within the scope of the invention. A serial interface circuit 58 is included in the digital watch module 14 especially developed to receive the signals at the phototransistor 48 (FIG. 1) from the LED output 20 and control the watch logic 60, as well as the watch display 62 for both time setting and message setting or programming. A crystal oscillator 64 is shown applying signals to the serial interface circuit 58 and receiving signals from the watch logic 60. The SET*, TIME*, 16 hz signal and 768 hz signal are applied to the watch logic 60 from the serial interface circuit 58.

Figure 4:
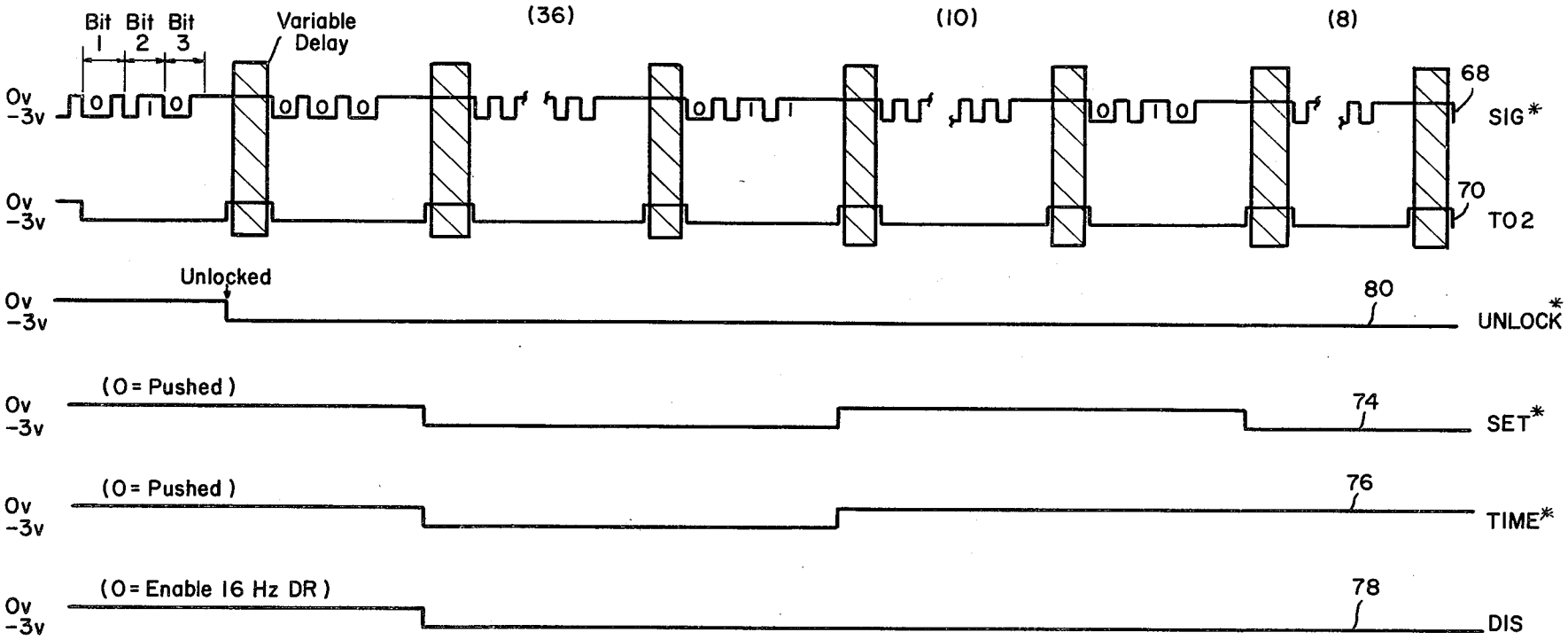
FIG. 4 is a schematic diagram of waveforms showing voltage as a function of time for generally explaining the serial format of the data transfer from the data entry unit into the watch.

Referring now to FIG. 4 as well as to FIG. 3, the general serial transmission of data will be explained prior to explaining the improved watch module 14, in accordance with the invention. In general after the module is unlocked, a serial waveform of pulses transmitted by the LED unit 20 shown by waveform 68, first transmits three bits of pulse width modulated data followed by a time out period TO2 of a waveform 70 which may have a variable width, then followed with a predetermined number of pulses of the waveform 68 which number, when the proper commands have been set up, determines the time setting or message that is to be set into the watch memory. It is to be noted at this time that the pulse rate of the waveform 68 is at a relatively high speed such as 5 khz which is inserted into the watch divider chain at a suitable point such as the 16 hz point to provide rapid automatic setting of the watch. The first three coded bits of the waveform 68 unlocks the interface unit and is not followed by a burst of pulses. Three coded time modulated bits of the waveform 68, once the watch is unlocked, perform the electronically changing of the SET* and TIME* signals as well as the DIS signal as indicated by the respective waveforms 74, 76 and 78. The SIG* signal for unlocking applies serially the three bits 0-1-0 and in response to the TO2 signal of the waveform 70, the UNLOCK* signal of a waveform 80 goes to a low level (−3V) and remains thereafter during the entire setting operation for that watch. It is to be noted that after the watch is unlocked, three serial coded command bits respectively representing SET*, TIME* and DIS are always followed by either a predetermined or a calculated number of pulses. The predetermined numbers of pulses are for providing time for the serial interface of the watch and the circuits of the watch itself to respond to the code. The calculated pulses are provided for time setting for changing the count in the various counters which may be month, date, hours, minutes and seconds or storing the message by sequencing the message counter through a message sequence to the desired characters.

Referring now to FIG. 5, the serial interface circuit 58 which is positioned in the watch module will first be explained. The serial interface unit 58 contains a signal amplifier/shaper circuit 86 receiving a phototransistor signal on a lead 88 from the energy responsive device or phototransistor 48 which may be positioned in the face of the watch. Additional amplifier circuits as required may be included in the lead 88. A data timer 90 is provided for receiving the signal SIG* from the circuit 86, and an output latch and data buffer circuit 92 is provided principally for storing the control codes from the processor and separating out the 16DR signal. A power-on circuit 94 has a principal function of generating the $P_{ON}$ signal and an oscillator divider circuit 96 is provided as a timing reference which is a conventional time divider circuit modified, in accordance with the invention, and being responsive to the crystal oscillator 100. The oscillator divider circuit 96 provides the 768 out signal to the watch logic as well as 768 I to the data shift register 92. An output buffer 102 is provided to transfer signals 768 out, 16 hz, SET* and TIME* to the watch logic. Also received by the serial interface unit 58 from the watch logic are $+V_{OSC}$ and $-V_{OSC}$.

Referring now to FIG. 6, the signal amplifier/shaper circuit 86 responds to the signal from the phototransistor (PT) to generate a SIG and SIG* pulse signal. The phototransistor signal PT is applied from a pad 110 to a lead 112 which in turn is coupled to the drain of an N-type transistor 114, the control electrode of a P-type transistor 118 and to the control electrode of an N-type transistor 120. The current flowing in the lead 112, as a result of a positive pulse signal being applied to the base of the phototransistor 48 and $P_{ON}$ signal being high, flows through the transistor 114 essentially to provide a discharge path to a −3 volt terminal for current stored in the capacitance of the phototransistor when the $P_{ON}$ or power on signal is high. The transistor 118 is biased so that, in combination with the transistor 120, amplification is provided. The drain of the transistor 118 is coupled to the drain of the transistor 120 through a lead 124 which in turn is coupled to the source of a P-type transistor 128 having its base electrode responsive to the signal $P_{ON}$ so that when $P_{ON}$ goes to logical O, a high or 1 level is applied to the input of an inverter 134. An N-type transistor 122 has its drain coupled to the source of the transistor 120 and its source coupled to a −3 volts terminal with its control electrode coupled to $P_{ON}$. The inverter 134 is coupled through a lead 135 and an inverter 136 and in turn to one input of a NOR circuit 138 which is cross-coupled with a NOR circuit 140 to provide a latch. The output of the inverter 134 at the lead 135 is also coupled to serially connected inverters 142 and 144 the latter of which is coupled to the input of the NOR gate 140. The other inputs of the NOR gates 138 and 140 are respectively coupled to the SIG output of gate 140 and the SIG* output of the gate 138. When the signal on the lead 112 goes high (LED is on), the signal on the lead 124 goes low and the signal on the lead 135 goes high so SIG* is latched at a high or one condition. When the signal on the lead 112 goes low, the transistor 118 goes on so a high voltage is applied to the lead 124, causing the lead 135 to go low, which in turn causes SIG* to go low. When $P_{ON}$ goes to 0 (power goes off), the transistor 128 is biased into conduction and a high or one voltage at the input of the inverter 134 applies a high signal to the input of the NOR gate 138 forcing and assuring that SIG* goes low (LED is not emitting light) and remains at a low level in the absence of power.

Figure 7:
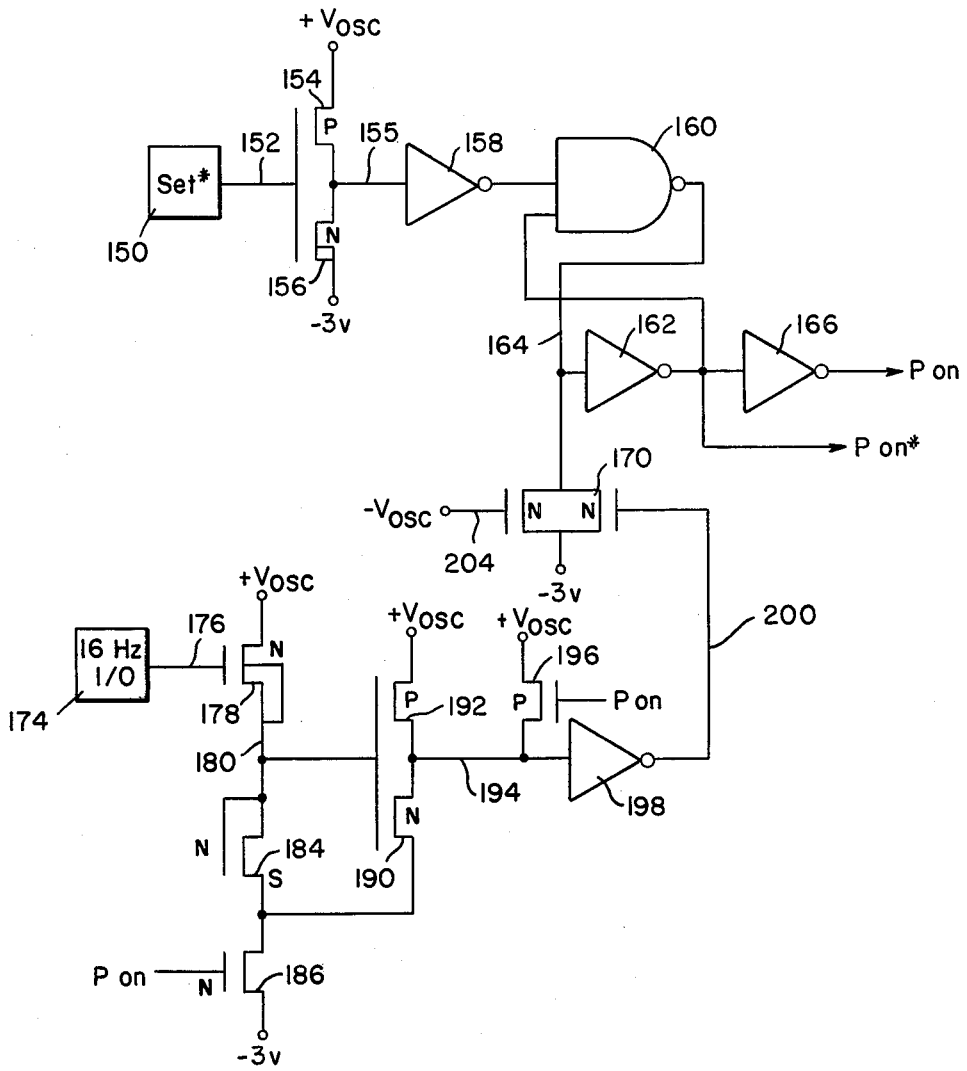
FIG. 7 is a schematic circuit diagram of the power on circuit responsive to a manual operation of the set button that may be utilized in the serial interface unit.

Referring now to FIG. 7, the power-on circuit will be explained in further detail, the circuit responding to SET* going low in response to the operator pressing the recessed SET button 42. Thus, prior to time setting and message setting in accordance with the invention, $P_{ON}$ is established at a high or one condition. The SET* pad 150 supplies a low level signal through a lead 152 to the control electrodes of a P-type transistor 154 and an N-type transistor 156. The source of the transistor 154 is coupled to $+V_{OSC}$ and the drain of the transistor 154 is coupled to the drain of the transistor 156, in turn having its source coupled to a −3 volt terminal. The drains of the transistors 154 and 156 are coupled through a lead 155 and an inverter 158 to one input of an NAND gate 160 having its other input coupled to the output of an inverter 162 to form a latch. The output of the NAND gate 160 is coupled through a lead 164 to the input of the inverter 162. The lead 164 remains high during the entire time and message setting period. The gate 160 and the inverter 162 provide a latch with $P_{ON}$* at a low level and $P_{ON}$ at a high level as provided by an inverter 166 until a low signal is provided on the lead 164. A pair of N-type transistors 170, which are ored together, have their drains coupled to the lead 164 and sources coupled to a −3 volt terminal for resetting the latch by conducting and applying a low level signal to the lead 164. The illustrated dual arrangement is provided in a watch that utilizes two series connected batteries that may alternately switch back and forth each 12 hours. However, during display periods the voltage across both of the two series batteries is utilized. The $P_{ON}$ signal goes off or low when the system returns to single battery operation. The first battery provides a voltage from 0 to −1.5 volts and the second battery provides a voltage from −1.5 volts to −3.0 volts, so that $-V_{OSC}$ can be either −3 volts or −1.5 volts and $+V_{OSC}$ can either be 0 or −1.5 volts. For one battery a $-V_{OSC}$ voltage is applied to the control electrode 204 of the transistor 170 so that when $-V_{OSC} = -1.5$ volts (with the source at −3 volts) the latch is reset so $P_{On}$ goes to 0. For the other battery, when $-V_{OSC} = -3$ volts, a 16 hz I/O signal from a pad 174 is utilized for resetting the latch and is coupled through a lead 176 to the gate electrode of an N-type transistor 178 inturn having its drain coupled to $+V_{OSC}$ and its source coupled to a lead 180 which in turn is coupled to the drain and the gate electrode of a transistor 184. The source of the transistor 184 is coupled to the drain of a transistor 186 of an N-type having its gate electrode coupled to the signal $P_{ON}$ and having its source coupled to −3 volts. The drain of the transistor 186 is coupled to the source of an N-type transistor 190 having its drain coupled to the drain of a P-type transistor 192 in turn having its source coupled to the voltage $+V_{OSC}$. The drain of the transistor 190 is coupled through a lead 194 to the drain of a P-type transistor 196 having its source coupled to the voltage $+V_{OSC}$ and its control electrode coupled to the signal $P_{ON}$. When $P_{ON}$ is a logic 1, transistor 196 is not conductive and current is not drawn.

The 16hz I/O signal on the lead 176 swings between 0 and −3 volts so that when it is 0 volts, the transistor 178 conducts and a high voltage (−1.5 bolts) is applied to the lead 180. Transistor 190 conducts and the voltage on the lead 194 goes to a binary 0, the transistor 196 being maintained biased out of conduction. A high voltage or a binary one is applied to the lead 200, the transistor 170 turns on, the voltage on the lead 164 goes low and the latch is reset, that is, $P_{ON}$ goes to a low voltage. When $P_{ON}$ goes to a low voltage, the transistor 196 is biased into conduction to insure a low voltage on the lead 200 after passing through an inverter 198. It is to be noted that if the set button is pushed by a person utilizing the illustrated watch, the signal $P_{ON}$ goes high (thus energizing the serial chip) and remains high until operation is returned to a single battery so that $+V_{OSC}$ goes to −1.5 volts or $-V_{OSC}$ goes to −1.5 volts.

Figure 8:
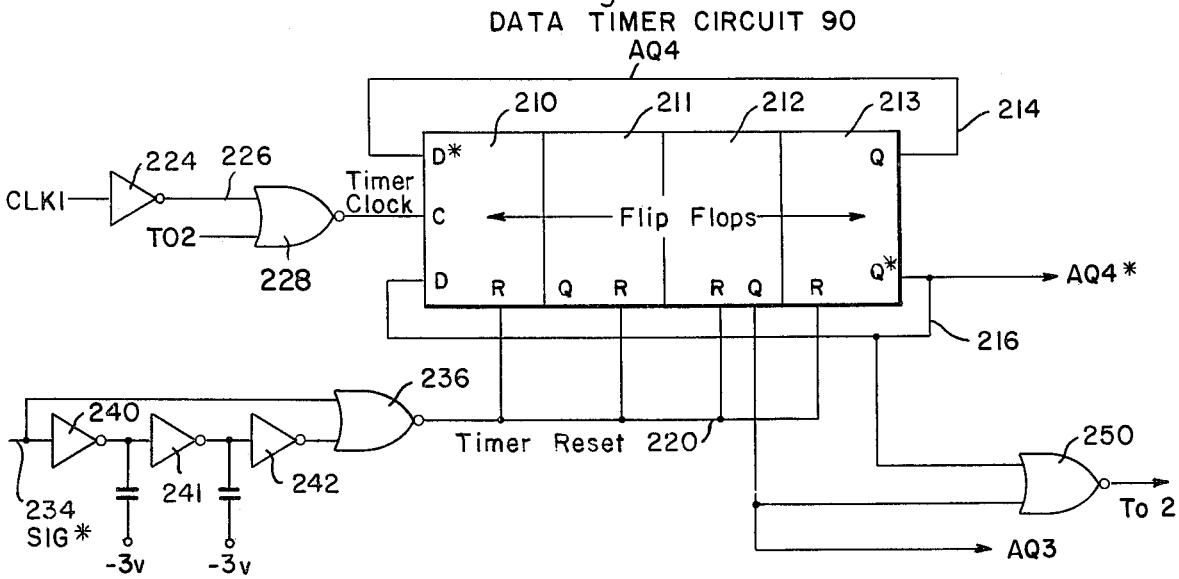
FIG. 8 is a schematic circuit and block digram of the data timer circuit that may be utilized in the serial interface unit.

Referring now to FIG. 8, the data timer circuit 90 includes four D-type flip-flops 210 to 213 arranged as a shift register which is a four bit Johnson counter. The flip-flops 210 and 213 have the D* input of the flip-flop 210 coupled to the Q output of the flip-flop 213 by a lead 214. The D input of the flip-flop 210 is coupled through a lead 216 to the Q* output of the flip-flop 213 which is also the signal AQ4*. The reset terminals of each of the flip-flops 210 to 213 is coupled to a timer reset lead 220. At the input to the circuit, a clock one signal CLK 1 is applied to an inverter 224 and through a lead 226 to a NOR gate 228 which in turn develops the timer clock signal on the lead 230 which is applied to the clock input of the flip-flop 210. The time out signal TO2 is also applied to the NOR gate 228. The timer reset input is derived from SIG* being applied on a lead 234 to a NOR gate 236 which in turn is coupled to the timer reset lead 220. The other SIG* input from the lead 234 is applied through inverters 240, 241 and 242 to provide delay so that a timer reset pulse is formed from an edge of SIG* on the timer reset lead 220. Suitable capacitors are coupled from the outputs of the inverters 240 and 241 to −3V terminals. A NOR gate 250 generates the TO2 signal from an AQ3 input which is from the Q output of flip-flop 212 and from the AQ4* signal on the lead 216. The TO2 signal reads the serial shift register codes that are received by the watch module and loads the data into the latches. The AQ3 signal is utilized to decode the pulse width modulation signals from the LED data entry. It is to be noted that the states of the flip-flops 210, 211, 212 and 213 are as follows:

| | | AQ3 | AQ4 | |
|---|---|---|---|---|
| 0 | 0 | 0 | 0 | |
| 1 | 0 | 0 | 0 | |
| 1 | 1 | 0 | 0 | |
| 1 | 1 | 1 | 0 | |
| 1 | 1 | 1 | 1 | |
| 0 | 1 | 1 | 1 | |
| 0 | 0 | 1 | 1 | |
| 0 | 0 | 0 | 1 | TO2 |
| 0 | 0 | 0 | 0 | RESET |

The timer runs until a timer reset pulse is provided or a TO2 pulse is formed. In between bursts of pulses from the LED, the TO2 signal occurs and SIG* remains high as determined by the processor, to determine the duration of T02. While the signal T02 is high, clock pulses cannot pass through the gate 228. Also, at the end of each SIG* pulse, a timer reset pulse is generated so as to prevent a T02 pulse from being formed in the gate 250.

Figure 9:
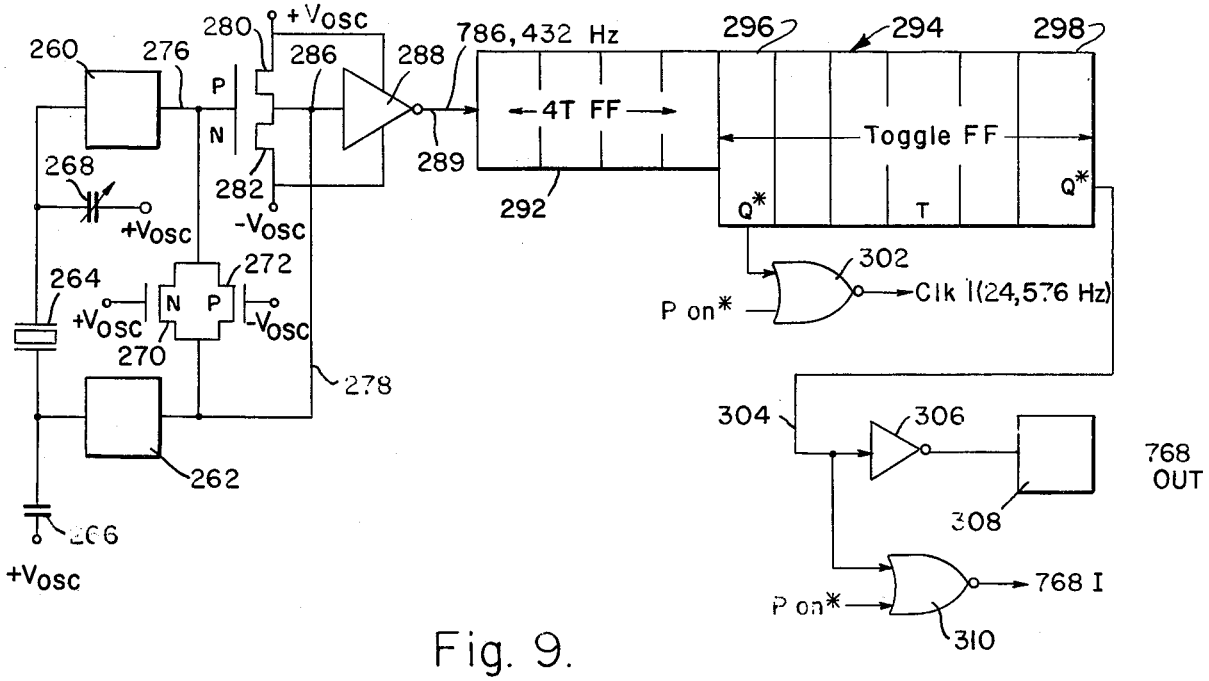
FIG. 9 is a schematic circuit and block diagram of the oscillator divider circuit which may be utilized in the interface unit.

Referring now to FIG. 9, the oscillator divider circuit 96 receives from pads 260 and 262 signals from a quartz crystal 264 coupled to capacitors 266 and 268 to form a typical $\tau$ network for the crystal to oscillate. An N-type transistor 270 and a P-type transistor 272 are coupled between leads 276 and 278 to form a bias resistor for the oscillator. The control electrodes of transistors 270 and 272 are respectively coupled to $+V_{OSC}$ and $-V_{OSC}$. The lead 276 is coupled to the control electrodes of a P-type transistor 280 and an N-type transistor 282 to form an amplifier for the oscillating signals. The source of the transistor 280 is coupled to $+V_{OSC}$ and the source of the transistor 282 is coupled to $-V_{OSC}$, with the drains of the two transistors being coupled to a lead 286 which is in turn coupled through an inverter 288 to a lead 289. The oscillating signal on the lead 289 is then applied through four toggle flip-flops which may be of the dynamic type for dividing by sixteen, the four flip-flops being indicated as 292. The signal from the flip-flops 292 are then applied to static toggle flip-flops 294 including a first flip-flop 296 and an end flip-flop 298. As is well known in the art for a divider chain, the input is the clock input of a flip-flop and the Q output of that flip-flop is coupled to the clock input of the subsequent flip-flop. The Q* output of flip-flop 296 is applied to a NOR gate 302 in combination with $P_{ON}$* being at a logical zero to generate the CLK 1 signal. The Q* output of the flip-flop 298 is applied through a lead 304 and inverter 306 to the output pad 308 which provides the signal 768 out. The lead 304 also provides an input to a NOR gate 310 which in combination with a $P_{ON}$* signal being at a logical zero generates the internal clock signal 768I. In the illustrative arrangement, the oscillator 264 may oscillate at 786,432 hz providing a signal on the lead 289 of 786,432 hz and the CLK 1 signal being at 24,576 hz which is principally utilized in the timer. The 768 (hz) signal is generated explicitly for use in the watch.

Figure 10:
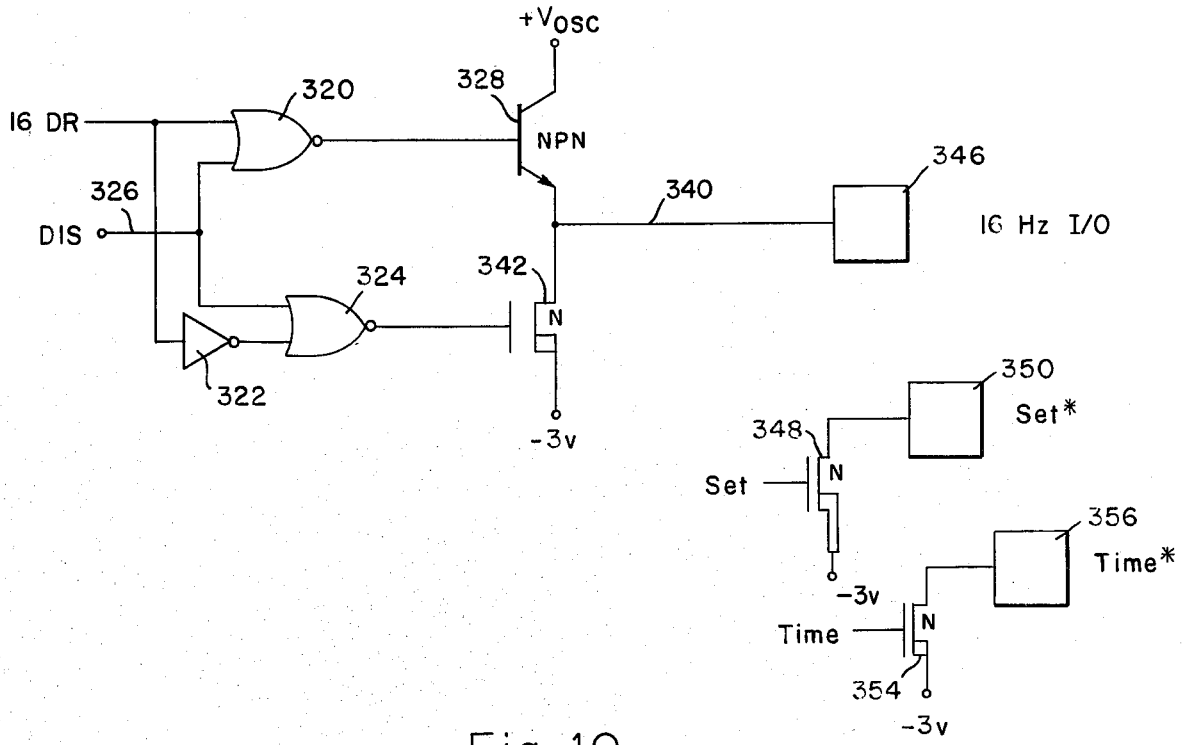
FIG. 10 is a schematic circuit diagram of the output buffer circuits that may be utilized in the interface unit.

Referring now to the output buffer circuits 102 of FIG. 10, the signal 16DR is applied to a NOR gate 320 and through an inverter 322 to a NOR gate 324. The signal DIS is also applied through a lead 326 to inputs of both NOR gates 320 and 324 for disabling the circuit operation when the signal DIS goes high to prevent their responding to the 16DR pulses. The output of the NOR gate 320 is applied to the base of an NPN transistor 328 having its collector coupled to a $+V_{OSC}$ voltage source and its emitter coupled to an output lead 340 as well as to the drain of an N-type transistor 342 having its source coupled to a $-3$ volts terminal and its control electrode coupled to the output of the NOR gate 324. Thus, when the output buffer circuit is enabled by DIS being low, the 16DR signal which may be at 5 khz as previously explained, is applied to the lead 340 and to a pad 346 which is an input of the initial divider stage of the watch. When the output signal from the gate 320 is high, the transistor 328 is biased into conduction and the transistor 342 is biased out of conduction to form the pulses on the lead 340. When the transistor 328 is non-conductive, the transistor 342 is conductive to apply the $-3$ volts to the lead 340. The set signal is applied to the control electrode of an N-type transistor 348 having its source electrode coupled to ground and its drain coupled to a pad 350 from which the watch receives the SET* signal. An N-type transistor 354 responds to the TIME signal applied to the control electrode thereof and has its drain coupled to a pad 356 to which the TIME* signal is applied to the watch.

Figures 11, 11A:
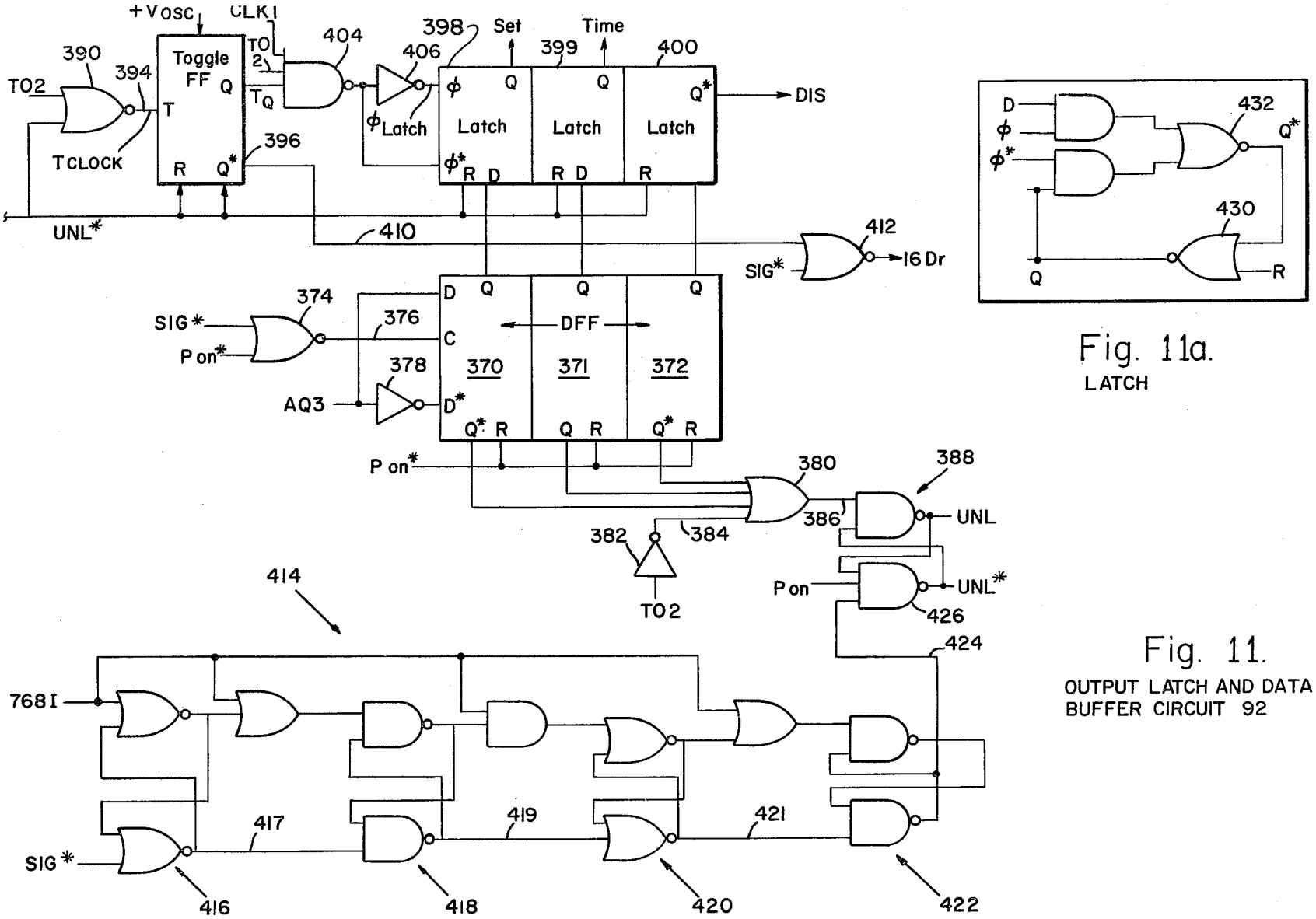
FIG. 11 is a schematic circuit and block diagram of the output latch and data buffer circuit that may be utilized in the interface unit.
FIG. 11*a* is a schematic circuit diagram of a latch that may be utilized in the system of FIG. 11.

Referring now to the output latch and the data buffer circuit 92 of FIG. 11, the circuit provides control and decoding of the command bits for transfer to latches for their utilization and controls the transfer of the string of pulses 16DR after command bits have been latched. The shift register for the serial command bits is provided by flip-flops 370, 371 and 372 which may be D-type flip-flops. The clock input of the flip-flop 370 is coupled to a NOR gate 374 having SIG* and $P_{ON}$* as its two inputs. It is to be noted that the flip-flops utilized in the illustrative system of the invention shift or clock on the negative transition, that is when the pulse falls on a lead 376. When $P_{ON}$* is zero and SIG* rises the trailing edge or fall of potential on the lead 376 clocks the flip-flop input with AQ3 which is coupled to the D input and through an inverter 378 to the D* input so that the pulse width is decoded and a value is stored in the flip-flop 370. In response to two other clocks, all three flip-flops 370, 371 and 372 are energized to store the informational command bits. For the unlock operation the UNL* is energized as a one and the command code 101 is stored in respective flip-flops 370, 371 and 372, the outputs from the three flip-flops applied to a NOR gate 380 are logical zero and upon the rise of the signal T02 an inverter 382 applies a zero to a lead 384 and a 1 is applied to the lead 386 at the input to a toggle 388 so that the signal UNL goes to a logical one and UNL* goes to a logical zero. It is to be noted that UNL* prior to a setting operation is a logical one which is the normal condition to protect the watch from any response from ambient light conditions. Because UNL* was previously a 1 from being reset, a NOR gate 390 does not respond to TO2 and a 0 is maintained on a toggle lead 394 which is the $T_{CLOCK}$ signal. Thus, a toggle flip-flop 396 which has been previously reset by UNL* remains reset so that TZ (Which is a O) does not allow the unlock code to be transferred from the flip-flops 370 to 373 into latches 398, 399 and 400. Because, during this unlock period, TQ and TO2 are 0, the output of a NAND gate 404 remains 1 and the signal $\phi$ latch at the output of an inverter 406 into the latch 398 remains 0. CLK 1 is applied to gate 404 to eliminate race problems. It is to be noted that the inputs $\phi$ and $\phi$* are applied to all three latches 398 to 400 and a logical 1 signal applied to $\phi$ of each latch transfers the contents of the shift registers in parallel into the latches. Thus, during the unlock period, the contents of the shift registers are not applied to the latches. At the same time, during unlock, the toggle flip-flop 396 being in its reset state provides a logical 1 signal on an output lead 410 which is applied to inhibit a NOR gate 412, also receiving the signal SIG*, from providing an output signal 16DR. Thus, only during the unlock operation, a train of pulses does not follow the command code.

The next operation that occurs in the resetting of the watch and the SIG* code 000 is transferred as 111 (SIG) into the flip-flop 370 to 372 to place the watch in a master reset condition. The NOR gate 374 in response to the falling edged SIG*, clocks AQ3 into the flip-flops as 111. It is to be noted that UNL* which had previously been 1 is now 0 and remains at 0 as an input to NOR gate 390 so that gate will pass the TO2 pulses. When TO2 falls to logical 0, $T_{CLOCK}$ on the lead 394 rises to the higher level. The signal UNL* remains at a low level and with TO2 being low, logical 1 remains on the lead 394 as the T clock pulse. When TO2 rises, $T_{CLOCK}$ falls, TQ rises and with TO2 and CLK 1 high, a zero is applied to the output of the NAND gate 404 and $\phi$ latch goes to a 1 during the time of occurrence of the TO2 signal to transfer the contents of the shift registers 370 to 372 into respective latches 398 to 400. The alternate operaton which is transferring a burst of pulses SIG*, is in response to the flip-flop 396 toggling so that Q* goes to a 0 to energize the NOR gate 412 and pass a string of pulses to the output as 16DR. During this alternate operation, the latches are undisturbed.

It is to be noted that the string of pulses as SIG* also clock the shift register of flip-flops 370 to 372 and provide contents therein, but the contents during the pulse transmission has no effect on TO2 and $\phi_{LATCH}$ and has no effect on the latched command.

For causing the interface chip or circuit to be unlocked, that is having UNL* go to 1, a delay circuit 414 is provided and when SIG* remains low as provided by the processor for an extended delay such as two milliseconds, UNL* is set at 1 and UNL is set to 0, discontinuing the Time or Message setting operation. The delay is provided by four toggles 416, 418, 420 and 422 which may be of a conventional type utilizing NOR gates and NAND gates and clocks from the clock source 768I. The signal SIG* as a logical 0 is applied to the lower NOR gate of the first toggle switch 416 and provides a 1 on a lead 417, a 0 on a lead 419, a 1 on a lead 421 and a 0 on the lead 424 to cause UNL* to go to a logical 1. Thus, if the processor provides a delay for a required number of clock periods, a 0 is applied to the lead 424 and the output of an AND gate 426 of the toggle 388 goes to a 1. Also, the signal $P_{ON}$ is applied to the gate 426 to force UNL* to a logic 1 when $P_{ON}$ is a logic 0.

FIG. 11*a* shows a typical type of clocked latch that may be utilized for latches 398, 399 and 400 which shows that the inputs $\phi$ and $\phi^*$ are affecting the clock input and the D or data input. Feedback is provided through a NOR gate 430 also receiving a reset signal for retaining a latched condition in which either the output of the NOR gate 430 or a NOR gate 432 is high or a logical 1.

Figure 12:
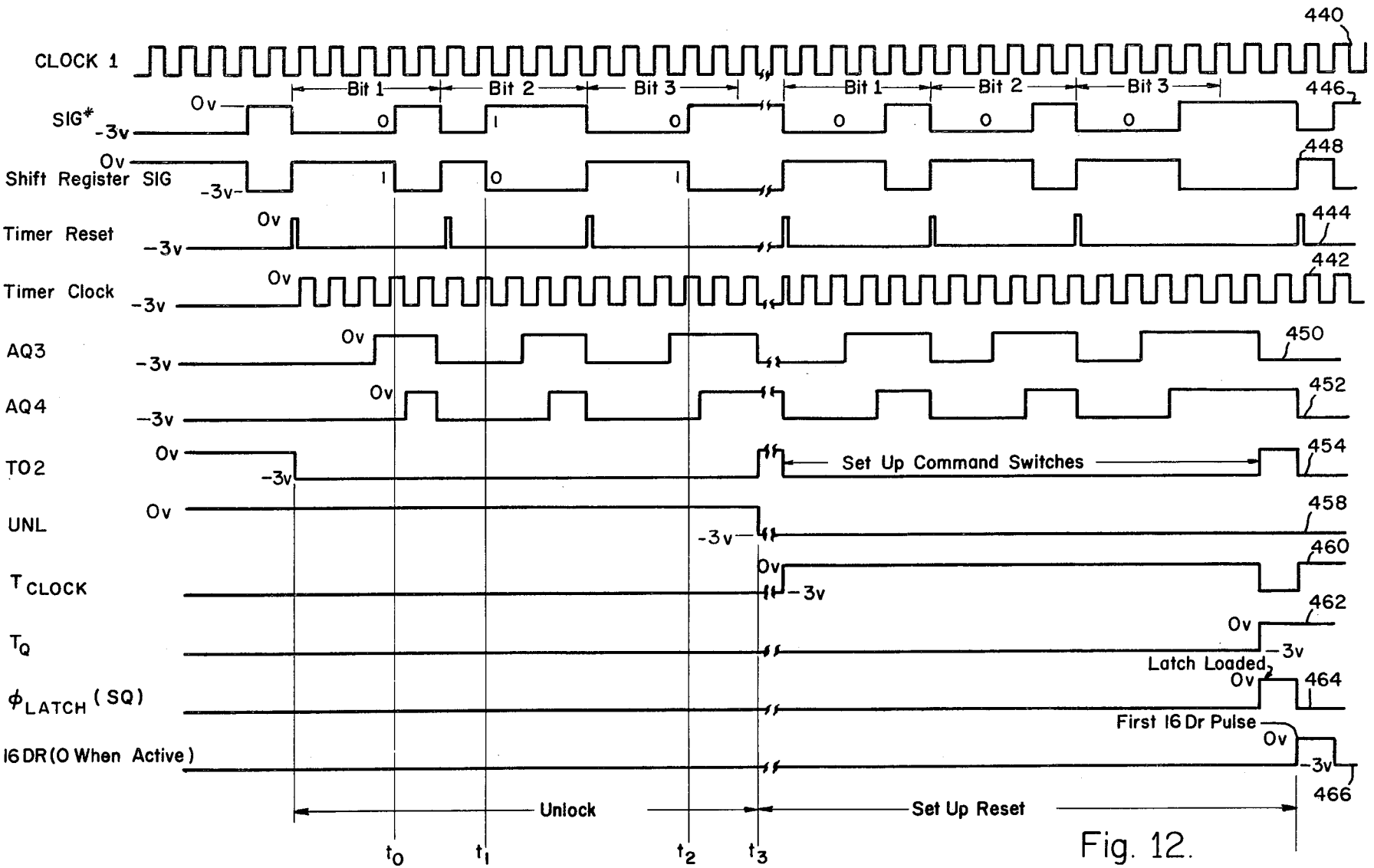
FIG. 12 is a schematic diagram of waveforms showing voltge as a function of time for further explaining the operatin of the serial interface unit.

Referring now to the timing diagram of FIG. 12, the operation of the serial interface will be explained in further detail. Because the data timer of the serial interface is basically timed from clock 1 (CLK 1), which for example, may be at 24,576 hz, a waveform 440 is shown for clock 1 and a timer clock signal of the waveform 442 (FIG. See 8), which only occurs when TO2 is at a low level, is shown at the same frequency. A timer reset pulse of a waveform 444 is generated by SIG* of a waveform 446 going negative as explained relative to FIG. 8 and each timer reset pulse occurs when SIG* makes a transition from a logic 1 (0V) to a logic 0 (−3V). It is to be noted that the shift register signal of a waveform 448 is the inverted form of the SIG* signal of the waveform 446 and is the clock for the shift registers of FIG. 11. Thus, it is to be understood that the contents of the flip-flops 370 to 372 and the latches 398 to 400 of FIG. 11 are determined by the waveform 448. The signal AQ3 generated in the data timer circuit of FIG. 8 is utilized for decoding the pulse width modulation at the input to the flip-flop 370 of the shift register of FIG. 11. Thus, at the time of the first rise of the SIG* pulses of the waveform 446, the level of the signal AQ3 of a waveform 450 is stored in the flip-flop 370. For example, at times $t_0$, $t_1$ and $t_2$ in response to a SIG* of 010 acting as a clock, a binary 101 is stored in the shift register of FIG. 11 in response to the 0 or 1 levels of AQ3 being clocked into flip-flop 370 of FIG. 11. A signal AQ4 of a waveform 452 is shown because it is utilized (in its inverted form) in FIG. 8 to generate the signal T02. The signal T02 of a waveform 454 has positive pulses which may vary in width, as indicated by the break in the first pulse, as a function of the required computer processing time and are controlled by AQ3 and the timer reset pulses of the waveform 444 in response to SIG* falling in level. It is to be noted that in the illustrated system, the T02 pulse width is a constant 950 microseconds. The circuit of FIG. 8 is continually attempting to generate the T02 signal but is prevented by SIG* of the waveform 446 going negative at the termination of the command setting operation or a pulse of a pulse train going negative and the timer reset signal causing the counter of FIG. 8 to start over again. The unlock or UNL signal of a waveform 458 remains at the higher 1 condition prior to being unlocked and once the system is unlocked at a time $t_3$ remains low until termination of the setting operation as explained relative to FIG. 11. The toggle or $T_{CLOCK}$ signal as shown in FIG. 11 indicated in FIG. 12 as a waveform 460 remains negative during the unlock period then positive with the fall of the T02 pulse. Also, the $T_{CLOCK}$ signal of the waveform 460 goes negative at each T02 time to control the toggling of the flip-flop 396 of FIG. 11. The TQ pulse of a waveform 462 responds to the T02 signal for passing a train of pulses and alternately goes low for latching a command as explained relative to FIG. 11. The $\phi_{LATCH}$ pulse of a waveform 464 substantially follows T02 for loading the commands from the shift registers into the latches in FIG. 11. The 16DR pulses of a waveform 466 shows a first 16DR pulse which is gated into the system when the toggle flip-flop 396 of FIG. 11 is in the true state, and the waveform continues on with the required number of pulses as determined by the processor for either time setting or message setting or to provide pulses for a command to activate the watch.

Figure 13:
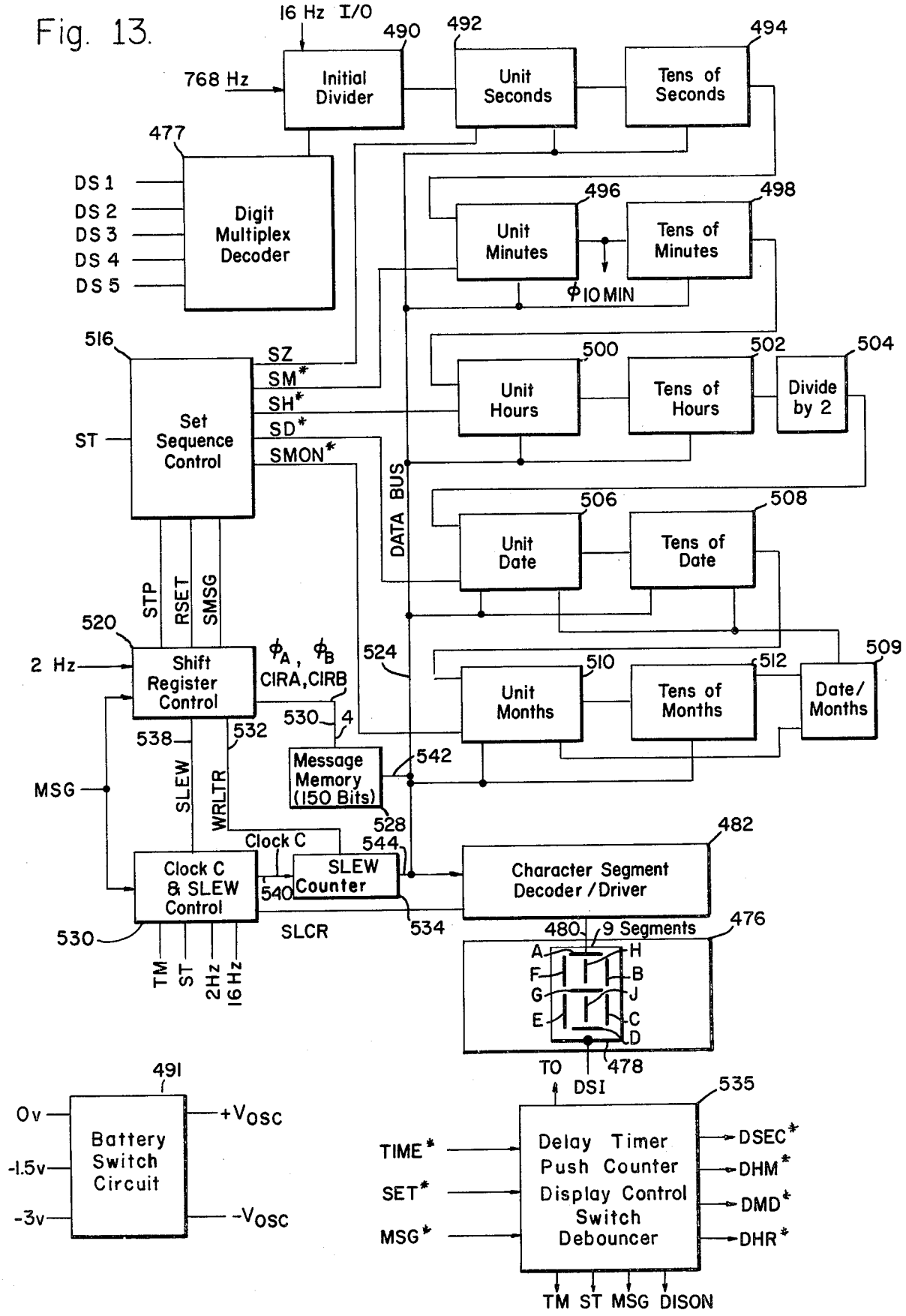
FIG. 13 is a schematic block diagram of an illustrative example of a digital watch module having time and message display capability and that can be set in accordance with the invention.

Referring now to FIG. 13, a block diagram is shown of a typical time and message watch in which the principles of the invention may be utilized, as an illustration of the high speed time setting and message setting that may be performed in accordance with the invention. The illustrated watch has a display 476 which may consist of five nine segment light emitting diode (LED) display devices such as 478 or may be any suitable display such as a liquid crystal display. A digit multiplex decoder 477 sequentially selects each display device such as 478 in response to a signal DS1 and the leads of a composite nine segment lead 480 selects the segments in response to a segment decoder and driver 482. The signals DS1 to DS5 from the multiplex decoder 477 respectively select 5 different character positions.

Although it is to be understood that the principles of the invention are not to be limited to any particular digital watch, the watch in FIG. 13 includes an initial divider 490 responsive to 768 hz from an oscillator as previously discussed which oscillates at a substantially constant frequency. All the circuits of the watch are powered by two compact size batteries (not shown) which may be mounted on the bottom of the watch so that the entire structure can be mounted in a wristwatch or similar device. The initial divider 490 has a 16 hz input pad and output pulses of 1, 2 and 16 cycles per second and these pulses selectively clock the various counter or dividers such as a unit seconds counter 492 driven by 1 hz, which may be a standard counter which counts up to 10 (0 to 9). The unit seconds counter in turn provides an overflow pulse to drive a tens of seconds counter 494 which must count up to 6 (0 to 5) to satisfy the requirements of 60 seconds per minute. All successive counters are designed so that at the end of each normal count sequence, an overflow pulse is sent to the next counter in the sequence. This counter sequence can be thought as a consecutive chain of dividers from which various points in the divider chain may be tapped to produce the desired seconds, minutes, hours, days and months outputs, the outputs being standard four bit binary coded decimal numbers. The tens of seconds counter 494 drives the unit minutes counter 496 which is a decade counter and this unit minute counter 496 then drives the tens of minutes counter 498 (with a $\phi_{10\ MIN}$ pulse) which in turn drives the unit hours counter 500 which is also a decade counter. Continuing the chain of divide counters, the unit hours counters 500 then drives the tens of hours counters 502 and because the output signal from the tens of hours counters occurs twice a day, this output is connected through a divide by two counter 504 to the input of a unit date counter 506 which advances once per day. It is to be noted that the counter 504 stores the information as to whether or not it is antimeridian or post meridian. The unit days counter 506 which emits a signal every ten days supplies a signal to a tens of date counter 508 which is linked to unit date counter 506. The counters 506 and 508 receive signals from a Date/Month circuit 509 so that when the total attempt to pass 29, 30 or 31 days is determined by the month counter, the counter 508 resets to 0 and counter 506 resets to 1. This reset advances the units months counter 510 which drives the tens of months counter 512. The counter 510 is arranged to count from 1 to 12 and with the counter 512 control the date per month which is predetermined in the Date/Month circuit 509 as to whether the days are reset in 29, 30 or 31 days.

The illustrated watch setting is controlled by set sequence control unit 516 which controls time setting through a plurality of leads labelled SMON* (set month), SD* (set date), SH* (set hours), SM* (set minutes) and SZ (reset seconds). The set sequence control unit 516 receives an ST (set button) signal and a clear set or RSET signal and transfers an STP (set pulse) and an SMSG (set message) pulse to a shift register control unit 520. The shift register control unit supplies message codes to a message memory 528 through a composite lead 530 which receives or passes signals $\phi_A$, $\phi_B$, CIRA and CIRB. A clock and slew control unit 530 applies slew signals to the shift register control unit 520 which in turn applies the signal WRLTR through a lead 532 to a slew counter 534. The shift register control unit 520 also receives a 2 hz input signal and a message (MSG) button input, although it is to be understood that in the illustrated message setting system in accordance with the invention, the message button is not utilized. The clock and slew control unit 530 receives a debounced time button signal TM for time information, a debounced set button signal ST for set information, a 2 hz signal and a 16 hz signal and receives a signal SLCR (slew clear) from the segment decoder driver 482 which signal is utilized for fast slewing. It is to be noted that TM and ST are inverted from TIME* and SET* in the debouncing circuit. The principal output from the clock and slew control unit 530 besides the slew signal on a lead 538, is CLK C (clock C) on a lead 540 which is applied to the slew counter 534 for slewing to a character as determined by 16 DR. The data bus 524 includes a separate lead from the message memory 150 which is a composite lead 542, and a composite lead 544 from the slew counter 534 which leads are applied to the segment decoder and driver 482. It is to be noted that in the illustrated watch, pushing the Time and Set buttons simultaneously which is Master Set (MS) causes the time and date to be reset to 1:00:00 a.m. January 1.

A unit 535 includes a delay timer, a push counter, a display control, and a switch debouncer circuit. The principal signals received by the circuit 535 are TIME*, SET* and MSG*. The principal signals provided by the unit 535 are TM, ST, MSG and DISON. Also provided are DSEC* (display seconds), DHM* (display hours and minutes) DMD* (display month and date) and DHR* (display hours). The timer signal T0 is generated by a one second timer (not shown) initiated by signal TMR*, which will be subsequently explained. A battery switching circuit 491 receives three voltages, OV, −1.5V and −3V from a source such as two batteries (not shown) and provides the voltages $+V_{OSC}$ and $-V_{OSC}$.

The watch illustrated in FIG. 13 is a message watch so that the system of the invention provides either time setting or time setting and message setting. The message watch of the present invention can be programmed by the watch user to display a message of up to any five words, with each word having up to five letters. In operation, one push of the time button causes the hours and minutes information to be displayed on the nine segment LED readout 476. Two pushes of the time push button causes the month and date information to be displayed, and if the time push button is held in, the seconds information will be displayed. If the time push button is pushed three times, hands-off seconds will be displayed (the seconds will count off automatically after the three pushes of the time push button without any further pushes of the time push button). The next push of the time push button results in hands-off seconds disappearing. A single depression of the message button will cause the message to be displayed, one word at a time, until all five words have sequentially been displayed.

The above description describes a two button version message watch. It is to be understood that the principles of the invention are equally applicable to other types such as a one button version message watch in which one push of the manually operated time button will display the hours and minutes information and then the seconds information after one second if the button is held in. Two pushes in one second of the single Time push button in that type of watch arrangement will display the month and date information and three pushes in two seconds will display the message.

In the illustrated system of the invention the watch module is converted to a one button module by MR being true so that the message button is not utilized for automatic setting of messages. The set button, which is well known in the art, is normally a recessed button that is used to reset the horological information and to set or program the alpha numeric message. The set button control is the same for both a one or two button watch. One push of the set button causes the month information to flash and be displayed at a 2 hz rate; two presses of the set button causes the date information to be flashed at a 2 hz rate; three presses of the set button causes the hours information to be flashed at a 2 hz rate; four presses of the set button causes the minutes information to be flashed at a 2 hz rate five to nine presses of the set button causes the message words (5 words) to be flashed at a 2 hz rate. On pressing the set button once more or the tenth time, the watch returns to normal operation and there is no flashing display presented. Thus, upon the fifth push of the set button, the watch enters the set message mode and the first character of the first word is caused to flash at a 2 hz rate. Pushing the time button then causes the first character of the first word to slew to all possible characters at a 2 hz rate. A further depression of the time button causes the slewing to stop at the desired character. Slewing always starts at A for the first letter of each word but starts at whatever character was last flashing for each other letter in the word. If the time button is pushed and held in for one second, the watch would be in the fast slew mode which will cause it to quickly slew to selected characters of the sequence of characters. The advantage of the fast slew is to allow the watch user to slew through the majority of the characters at a rapid rate and to program the watch message in a matter of a few minutes instead of having to very slowly slew through each of the characters. After obtaining the correct character for the first space for the first word, the watch user then proceeds to the second character of the first word by depressing the message button which causes the second character to flash and, further depression of the time button causes the second space to slew the character till the desired character is then obtained and selected by again pushing the time button. Slewing for the second character always starts where the previous character stops and the third, fourth and fifth spaces of the first word are selected in a similar manner. When all five spaces of the first word have been programmed, the watch user returns to the first character of the first word. A depression and release of the SET button then causes the display to advance to the first character of the second word. The second, third, fourth and fifth words are programmed in the same manner as the characters of the first word, that is, for manually programming. In the one-button version of a message watch as well as in the illustrated watch, the function of the message button in the message set mode is replaced by two pushes in one second of the time button.

Figures 14, 14A:
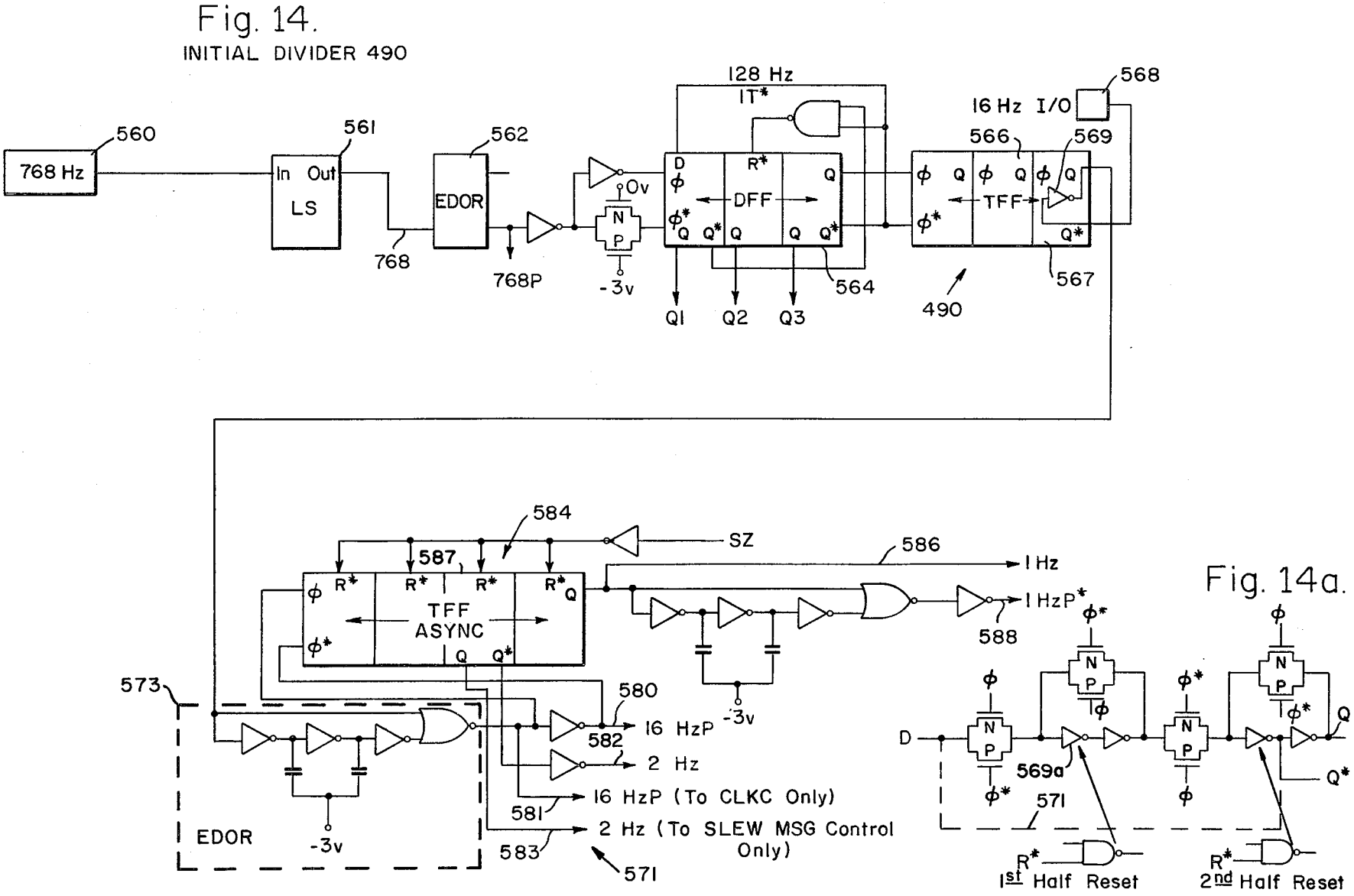
FIG. 14 is a schematic circuit and block diagram of the initial divider that may be utilized in the divider chain of FIG. 13.
FIG. 14*a* is a schematic circuit diagram of a basic toggle T flip-flop that may be utilized in the system of the invention.

Referring now to FIG. 14 which shows the initial divider 490, the illustrated watch will be explained in further detail. The 768 hz signal is applied from a pad 560 through a level shifter 561 and an edge detector 562 to a divide by six shift register 564 utilizing D-type flip-flops. Toggle flip-flops of a register 566 divides the pulse frequency by eight at the output of a flip-flop 567. A 16 hz in/out pad 568 is coupled to the Q* output of the flip-flop 567 and is the connecting point to which the 5 khz signal from the processor is applied, after being gated through the interface unit, for rapid and automatic time setting. The Q output from the flip-flop 567 is applied to a logic circuit 571 which supplies a 16 hz signal on a lead 580 and a 2 hz signal to clock C only on a lead 581. An edge detector (EDOR) 573 is provided at the input to the logic unit 571. The Q* and Q outputs of a flip-flop 587 of a divider chain 584 provide a 2 hz signal on a lead 582 and a 2 hz signal on a lead 583 to the slew message control circuit. The outputs from the D-type flip-flop divider chain 584 are 1 hz on a lead 586 and 1 hzp*, which is a 1 hz pulse, on a lead 588. The SZ pulse which is reset seconds is applied to the register 584. The SZ signal allows the seconds to be cleared by resetting the register 584 (actually within 1/16 of a second) while delaying the minute slewing by 2 to 3 seconds. These types of divider chains are well known in the art and need not be explained in further detail.

Referring now to FIG. 14*a*, a basic toggle or T flip-flop that may be utilized is shown with gates and inverters including an inverter 569*a* such as the inverter 569 indicated in flip-flop 567, an input D and outputs Q and Q*. When a connection 571 shown dotted is provided, the D-type flip-flop is a toggle flip-flop. When first half and second half reset gates are provided, to replace the indicated inverters, the T and D flip-flops are converted to asynchronous reset flip-flops.

Figure 15:
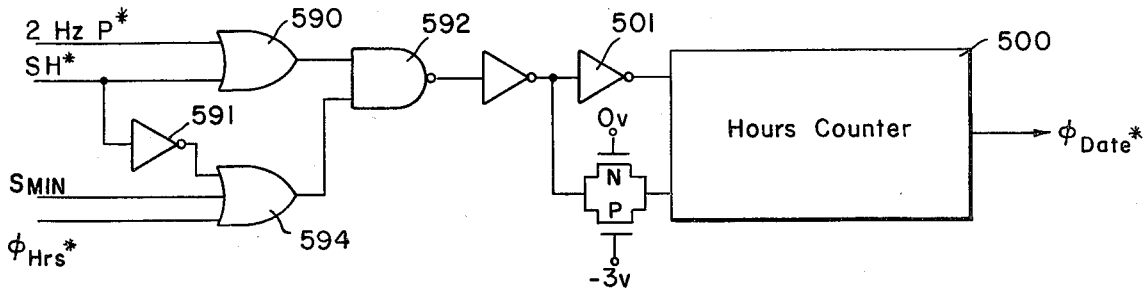
FIG. 15 is a schematic circuit and block diagram showing a portion of the hour counter control as an illustrative example of the divider chain control that may be utilized in the watch module of FIG. 13.

Referring now to FIG. 15, which is the hours counter 500 of FIG. 13, the arrangement of setting a couner having time stored therein such as hours and preventing an overflow from being received from the minutes counter when the minutes counter is being set, will be explained. The Signals 2 Hzp* and SH* are applied to an OR gate 590 and in turn to a NAND gate 592 also receiving a signal from a OR gate 594. The signals applied to the OR gate 594 are the signal set hours inverted (SH*) in an inverter 591, $S_{MIN}$ and $\phi_{HRS}$*. The signal $S_{MIN}$ is the control for setting the minutes counter, $\phi_{HRS}$* is the carry from the minutes counter and SH* is set hours inverted and is zero for setting hours. It is to be noted that the 2 Hzp* signal during automatic setting in accordance with the invention operates at a very high pulse rate.

The normal signal into the hours counter 500 is $\phi_{HRS}$* which is the negative carry pulse from the minutes counter and passes through the gate 592 which is gated on by SH* being a logical 1 (hours not being set) and letting carry pulses pass through the gate 592. If SH* is a logical 0 which is when hours are being set then a one from the inverter 591 turns the gate 592 on to pass the negative 2 hzp* pulses through the gate 592. If $S_{MIN}$ equals a binary one during set, that is minutes are being set in the divider chain, then two ones are being applied to the gate 592 to provide a zero output and prevent $\phi_{HRS}$* from passing through to the hours counter. If SH* is a one, then the 2 hzp signal is prevented from passing through the gate 592.

Figure 16:
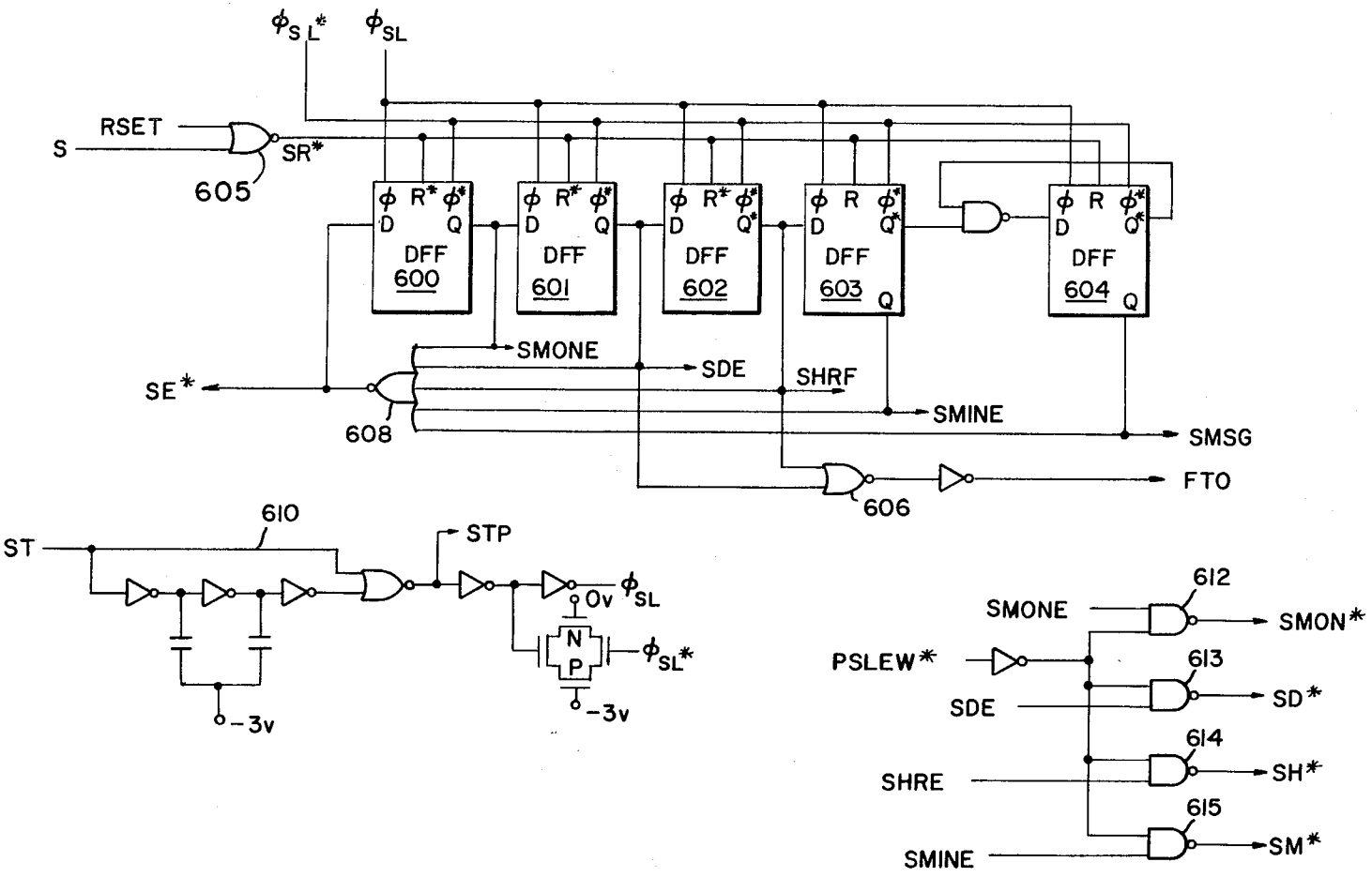
FIG. 16 is a schematic circuit and block diagram of the set sequence control unit of FIG. 13.

Referring now to FIG. 16, the set sequence control unit 516 of FIG. 13 which controls the sequence of time and message setting will be explained in further detail. The set sequence control unit has a principal function of developing the setting logic and provides signals for setting the month SMON*, setting the day SD*, setting the hour SH*, and setting the minutes SM*, all of which signals are utilized for selecting the time setting counters to be set. Also, the unit 516 locks in a SMSG signal condition for the 5 message words to be set. The above-mentioned time setting terms are formed when PSLEW* which is the slew term for incrementing the display, is operative, being generated by actuating the time button. The circuit includes D flip-flops 600 to 604 acting as a shift register with respective outputs SMONE, SDE, SHRE, SMINE and SMSG respectively presenting set month enable, set date enable, set hours enable, set minutes enable, and set message enable. A signal FTO generated by a NOR gate 606 is used to blank the display when it sets the date or sets minutes to turn off the first two digits on the display. The term S from a timer is a safety factor so that if the watch is left in the set mode for certain periods such as ten to twenty minutes, then S goes to logical 1 to terminate the set sequence by controlling a NOR gate 605 and to turn the display off. A term SE*, which is set enable inverted, is generated by a NOR gate 608 and remains at a low level when any of the outputs from the flip-flops 600 to 604 is a 1. A circuit 610 including a NOR gate and a number of inverters is responsive to signal ST which is the debounced set signal to provide a signal STP which is ST differentiated to give a pulse and to further provide the signals $\phi_{SL}$ and $\phi_{SL}$, which two latter signals are utilized for the two phase flip-flop setting logic. NAND gates 612 to 615 enable the different stages of the time setting as $\phi_{SL}$ and $\phi_{SL^*}$ change in response to the debounced set signal ST so that sequentially different flip-flops 600 and 604 are energized.

Figure 19:
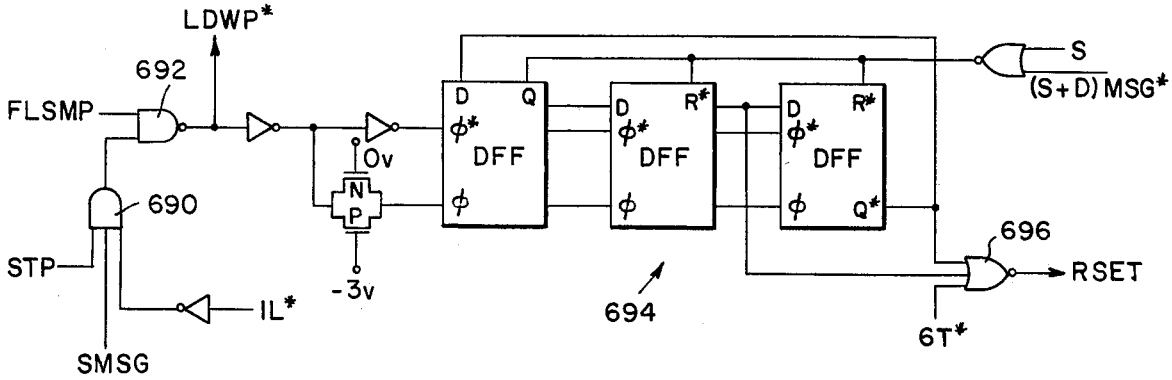
FIG. 19 is a schematic circuit and block diagram of the word counter which is a portion of the shift register control unit of the watch of FIG. 13.

Once in the SMSG mode, further pushes of the set button only advance the word counter (FIG. 19). The signal RSET is produced by the word counter when it advances to 5 and the RSET signal clears the flip-flops in FIG. 16.

Figure 17:
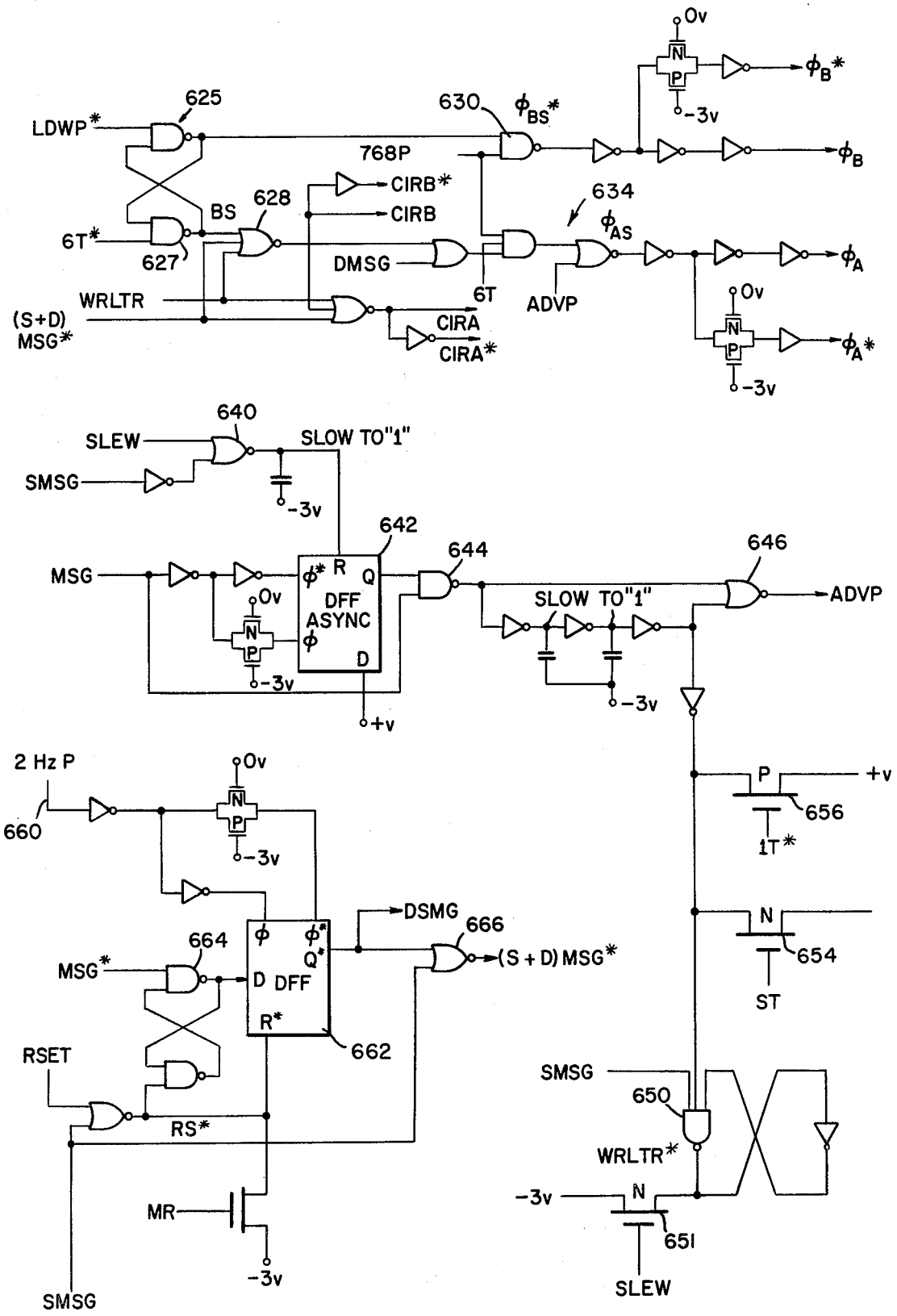
FIG. 17 is a schematic circuit and block diagram of the shift register control unit of FIG. 13.
Figure 18:
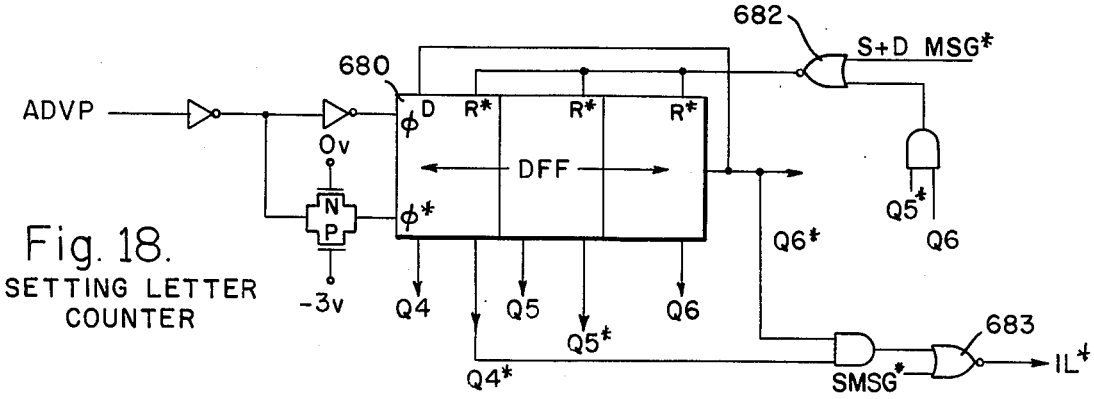
FIG. 18 is a schematic circuit and block diagram of the setting letter counter which is a portion of the shift register control unit of FIG. 13.
Figure 22:
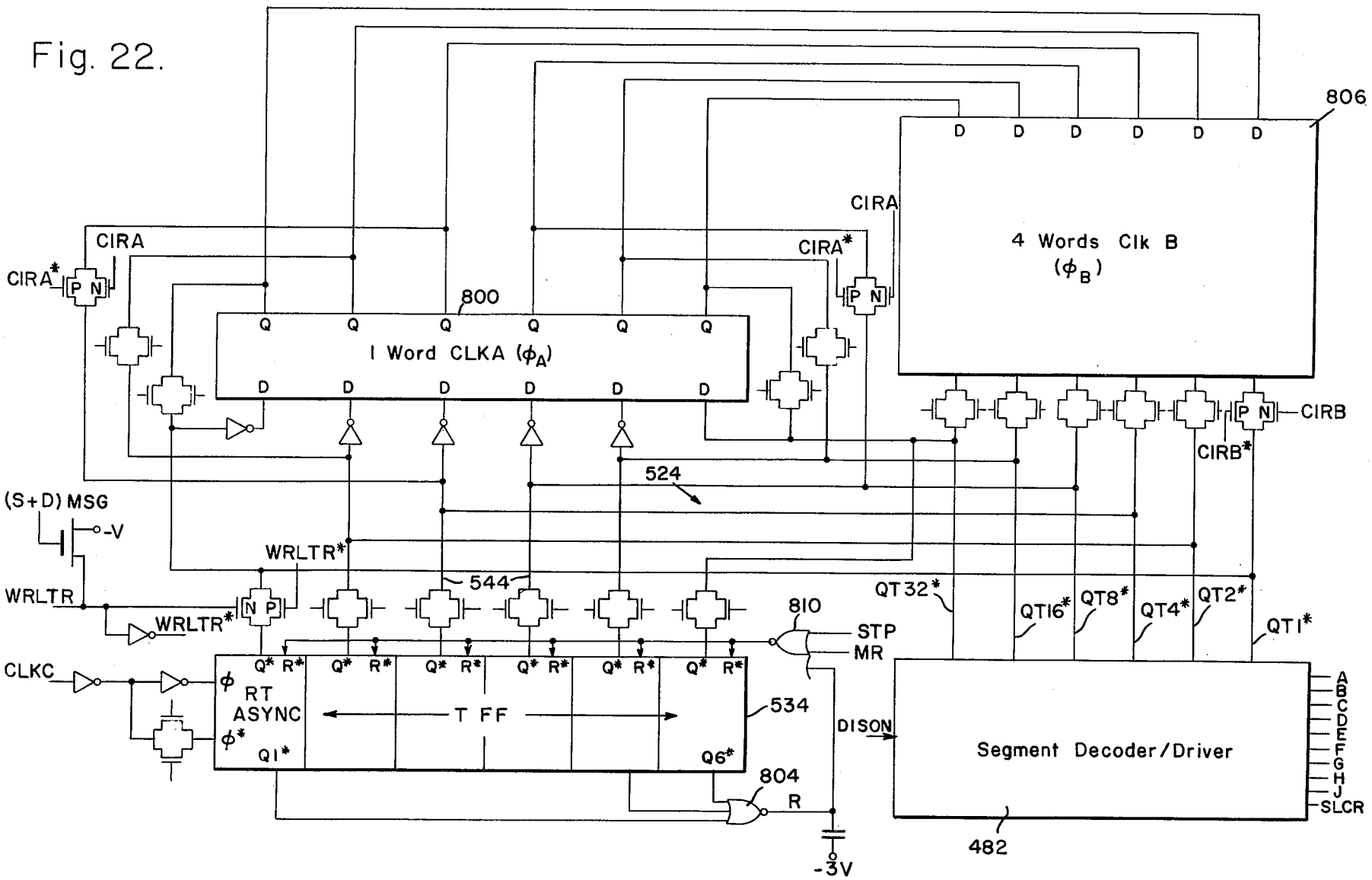
FIG. 22 is a schematic circuit and block diagram of the message memory unit and slew counter unit of FIG. 13.

Referring now to FIG. 17 the shift register control unit 520 will be described. Portions of the shift register control unit are also shown in FIGS. 18 and 19. The shift register control unit 520, which is directed principally to setting the proper messages into the shift register memory 528 (FIG. 13), generates $\phi_A$ and $\phi_B$ which function as the shift register clocks and CIRA and CIRB which control the transmission gates. The signal LDWP* and 6T* respectively representing load word pulse inverted and the synchronization timing period are applied to opposite ends of a toggle flip-flop 625 which in one stage controls the generation of a signal $\phi$ BS at the output of a NAND gate 630 and in the other state applies a signal BS to a NOR gate 628. When the signal LDWP* goes low, the input to the NAND gate 630 goes high and 768P pulses are applied to the output thereof to form $\phi_B$ and $\phi_B$*. For clearing the toggle 625, 6T* is applied to a NAND gate 627 and a 0 is applied to the NOR gate 628 and with WRLTR being 0 and (S+D)MSG* being 0, a one is applied to the output of NOR gate 628 so CIRB becomes 1. In reponse to 6T* the output of NOR gate 628 causes a complex gate 634 to pass 768P pulses as $\phi_A$ and $\phi_A$*. As can be seen in FIG. 22, $\phi_B$ transfers data from the data bus into the clock B shift register. The signals CIRA and CIRB are never true at the same time being respectively the controls for transferring data from the clock A register to the data bus and from the clock B shift register onto the data bus. Thus, the circuit of FIG. 17 controls the transfer of data between the shift registers and the data bus for display. Generation of th pulse ADVP, which is an advance pulse to the next letter at the end of which WRLTR* is removed, will be explained. The signal WRLTR allows the contents of the slew counter 534 to be transferred to the data bus. A set message signal SMSG and SLEW pulse are applied to a NOR gate 640 which in turn applies a slow to one signal to reset flip-flop 642, which may be an asynchronous D type flip-flop. A MSG signal which is a function of the message button or of two pushes of the time button is applied to the flip-flop 642 for setting it in the 1 state. A NAND gate 644 in combination with MSG being one then applies a 0 signal directly and through delay circuits to a NOR gate 646 to develop the pulse ADVP which controls advancing from one character to the next. Upon obtaining the advance pulse ADVP, signal WRLTR* which was reset and latched by signal slew is set and latched to terminate transfer of the character on the data bus to the shift register. Also, the latch including the NAND gate 650 is cleared by signal ST being applied to an N-type transistor 654 and a delay is provided to maintain WRLTR* by a P-type transistor 656 receiving 1T*. The SLEW signal at the control electrode of a transistor 651 causes WRLTR* to go false so that the slew counter is connected to the data bus.

For normal message display which utilizes a signal (S+D) MSG* a 2 hzp pulse is applied on a lead 660 as clock inputs to a D type flip-flop 662 whose D inputs comes from a latch 664 which is set by the signal MSG*. When the flip-flop 662 is clocked to a logic 1, a NOR gate 666 which also receives SMSG, goes to a logical 1 and provides a signal (S+D) SMG*. The signal RSET, which is reset set, resets the latch 664 as well as the flip-flop 662 to terminate the signal (S+D) MSG*. Also MR or master reset will reset flip-flops 662 and 664.

Referring now to the setting letter counter of FIG. 18 which keeps track of which letter is being displayed whether slewing or not slewing, the advance pulse signal ADVP is applied to a counter 680 so that it counts to the next letter, that is the outut Q4 to Q6 change to the next letter. The counter 680 is reset at the count of five by complex gate 682 responding to Q5* and Q6 going to one or (S+D) MSG* going to a 1. Thus, the letter counter counts only when it is either setting or displaying a message. A signal IL* is generated by a gate 683 wich signal is utilized to prevent changing words (FIG. 19) unless the first letter is being displayed.

Referring now to FIG. 19, which is the word counter to keep track of the word of the message that is being slewed or displayed, the first letter signal 1L* which is (Q6* and Q4*) or SMSG* inverted is applied to an AND gate 690 with SMSG and STP (set pulse). These terms cause a NAND gate 692 to generate LDWP* in the presence of FLSMP which is the flash message pulse. This action causes a counter 694 of D-type flip-flops to count each word of five words and to be reset when either S or (S+D) MSG* goes to 1. The timing pulse 6T* is utilized in a NAND gate 696 to generate the signal RSET which clears the set sequence when the last character of the fifth word is set.

Figure 20:
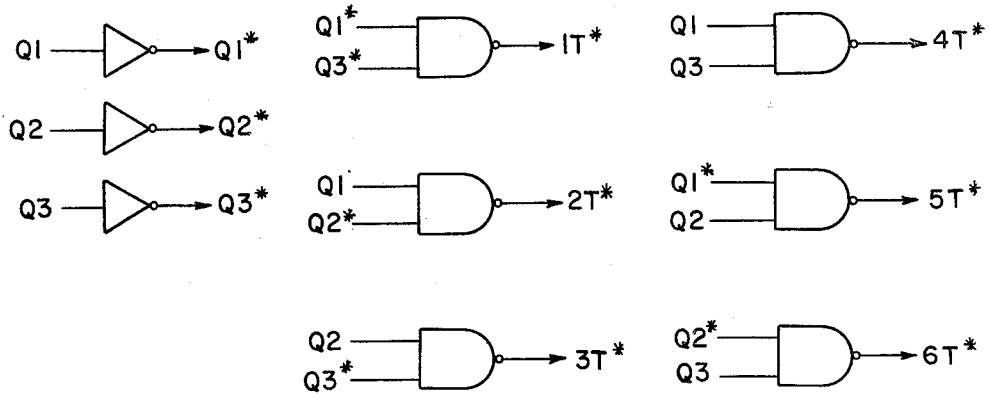
FIG. 20 is a schematic circuit diagram of the display time slot logic for the watch of FIG. 13.

Referring now to FIG. 20, the digit multiplex signals 1T* to 6T* are generated by combinations of Q1, Q2 and Q3 from the initial divider circit and define the five time slots for the display with 6T* being utilized for synchronization. For example, the signals IT* to 5T* are utilized in the digit multiplex decoder 477 of FIG. 13 for energizing the 5 display characters.

Figure 21:
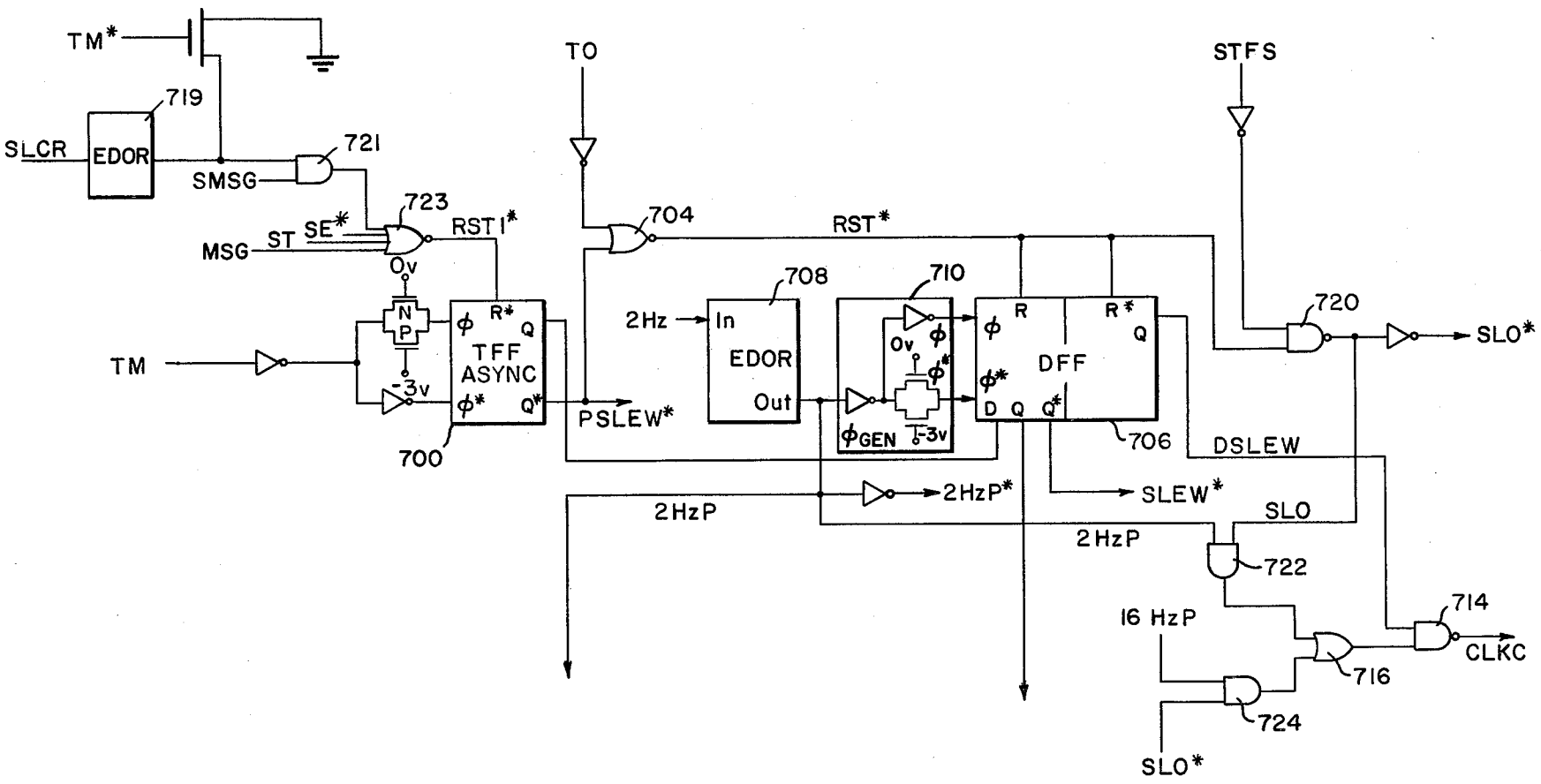
FIG. 21 is a schematic circuit and block diagram of the clock and slew control unit of FIG. 13.

Referring now to FIG. 21, which shows the clock and slew control unit 530 of FIG. 13, the principle function is to generate SLEW* for message setting PSLEW* for time setting and CLK C for message setting. The signal TM, which is the debounced and inverted input signal for TIME*, is applied through an inverter to a synchronus T-type flip-flop 700 to generate the signal PSLEW* as a 0. This signal PSLEW* and an inverted form of a time out signal T0 are applied to a NOR gate 704 which generates a RST* pulse for resetting a shift register 706 having D-type flip-flops. It is to be noted that the signal T0 occurs at the same time as TIME*. An edge detector circuit 708 (EDOR) receives a 2 hz input to provide a pulse from the falling edge of the 2 hz signal which is then applied to a generator 710 functioning as a clock generator for the shift register 706. The output of the second flip-flop of the register 706 is DSLEW which is applied to a NAND gate 714 which when receiving a 1 as well as a 1 from an OR gate 716 generates a 0 level as a negative clock C pulse. A NAND gate 720, in response to RST* and an inverted form of STFS, generates SLO which in combination with a 2 hzp applied to an AND gate 722 generates clock C for 2 hz operation. The signal STFS if formed by the time button being held in or energized for a relatively long time such as 1 second. An AND gate 724 in response to SLO* and 16 hzp generates clock C for 16 hz or fast slew operation. For fast slewing to certain letters as defined by a separate bit of the segment code the slew clear signal SLCR is applied to an edge detector (EDOR) 719. The edge detectors 708 and 719 may be similar to that shown on FIG. 14. In response to the signal SLCR and SMSG, and AND gate 721 energizes a NOR gate 723 to generate RST1* wich resets the flip-flop 700 causing PSLEW* to go to one and stopping the slewing operation by resetting the register 706 and terminating the formation of CLK C pulses. The NOR gate 723 also receives SEF, ST and MSG signals. In operation RST1* from gate 723 stops slewing if MSG or ST are True and will stay reset anytime that the watch is not in the set mode. Slewing will also stop if the watch is in the set message mode and have a SLCR signal from the segment decoder and the TM signal is true. Also, if the time button is pushed and slewing is being performed, the slewing stops and the flip-flop 700 is reset. It is to be noted that every 8 of the 16 hz pulses forms one CLK C pulse as eight 16 hz pulses are required for each 2 hz pulse. Thus, 8 times as many pulses as calculated by the processor are required for time or message slewing. Also, a predetermined number of pulses for each command signal received from the processor is required for the circuits including flip-flops and delays to respond to the commands.

Referring now to FIG. 22, which shows the slew counter 534, the message memory 528 and the segment decoder and driver 482, the operation will be explained in further detail. The slew counter 534 responds to the CLK C signal to generate a sequential number of codes representative of each character with the slewing continuing until termination of clock C pulses. The term WRLTR is utilized to transfer the ontents of the counter 534 onto the bus 544 and onto the data bus 524 which is the data bus also receiving time data. The data on the bus 524 is then displayed on the display after passing through the segment decoder and driver unit 482 (DISON is true). The signal $\phi_A$ is a clock that shift the word from the data bus to a display word memory 800 (one word capacity) and CIRA is a control term that transfers a single character from the register 800 to the data bus. The signal $\phi_B$ is a clock that transfers the word in the display word memory 800 to main memory 806. CIRB is a control term that transfers the next word from the main memory 806 to the data bus 524. The slew counter 534 is reset by the signals STP or MR controlling a NOR gate 810 in combination with the 49th state of the slew counter 534 decoded in a NOR gate 804. The term WRLTR is combined with the term (S+D) MSG from the slewing logic so that a word is not transferred while the slew counter 534 is receiving CLK C. The term DISON, which is a display enable term, is applied to the segment decoder and driver unit 482. As can be seen in FIG. 13, the nine outputs A through J are the nine segments which selectively energize a predetermined number of the segments for generating the LED display. The term SLCR is a tenth bit for A, J, S, O and + for slewing rapidly to and stopping on those characters during manual operation.

Figure 23:
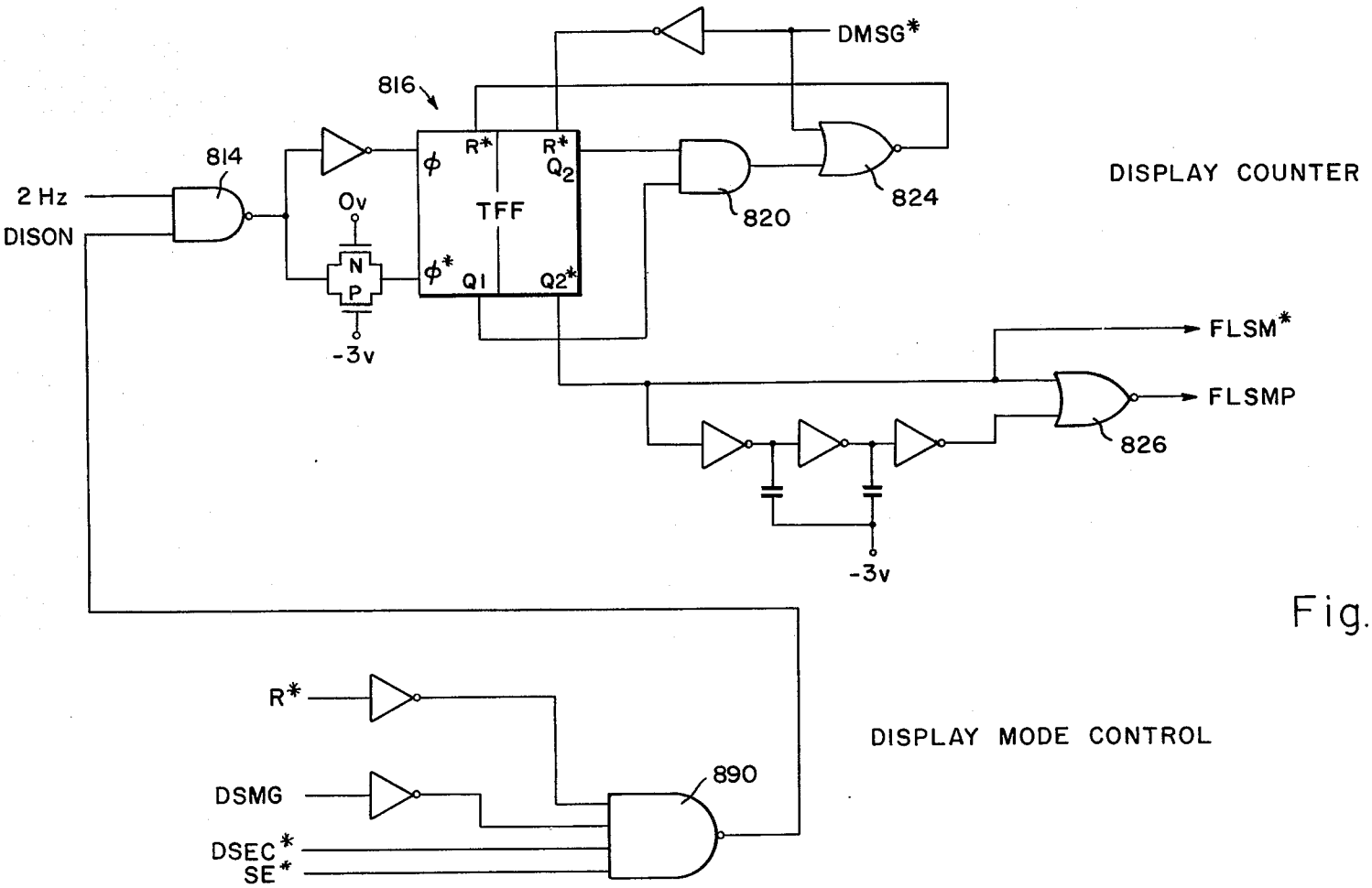
FIG. 23 is a schematic circuit and block diagram of the display counter and mode control unit of FIG. 13.

Referring now to FIG. 23, the display counter and display mode control which are part of the shift register control unit 520 will be explained. The signals 2 hz and DISON which are true when the display is on and is a function of R* are applied to a NAND gate 814. When DISON is true the 2 hz clock is applied to a first T or toggle flip-flop of a shift register 816 which has a Q1 output applied to an AND gate 820. In response to the next 2 hz pulse supplied to the counter 816, the Q2 signal goes high and a 1 at the output of AND gate 820 is applied to a NOR gate 824 which resets the first flip-flop of the register 816. The term DMSG* going to a logic 1 also resets both flip-flops. The Q2* output of the second flip-flop of the register 816 which is the signal FLSM* is applied to a NOR gate 826 which in combination with the delayed signal generates a pulse term FLSMP. The signal FLSM* is zero for one second and one for one-half second to flash the display message (the word changes when the display flashes off).

The term DISON is generated by a NAND gate 890 responsive to R* inverted (reset for the push counter), DMSG inverted, DSEC* and SE*. The signal SE* represents the set mode and DSEC* indicates that seconds are to be displayed. The watch does not display seconds if a message is being displayed and it is in the set mode.

Figure 24:
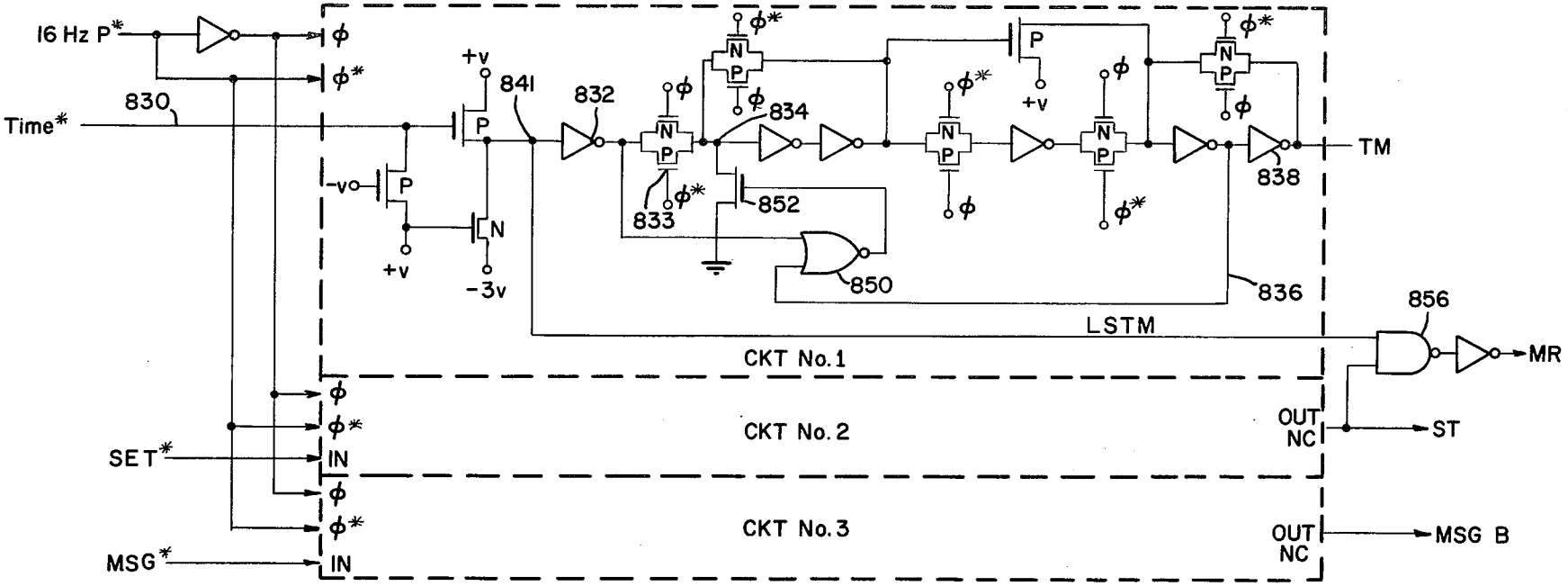
FIG. 24 is a schematic circuit diagram of the debouncing circuit in the system of FIG. 13.

Referring now to FIG. 24, the debouncing circuit is shown which responds to TIME* the SET* which are two of the signals received from the interface unit, in accordance with the invention. Also, a term MSG* is received by the debouncing unit but in the illustrated system of the invention, this would be a term from the message push button. In response to a negative going TIME* signal which corresponds to pushing the time button, the signal on a lead 830 goes high, and when 16 hzp goes high, a signal on a lead 834 goes low, on a lead 836 goes low and on an output lead 836 goes high which is the signal TM, the debounded time button signal. This signal TM is generated by the 16 hzp* clock signal applied to the series of chains of transistors. The TIME* signal going high is equivalent to the release of the time button. When a logical 1 appears on the lead 830, a 0 appears on the lead 841, a 1 appears on a lead 834 when 16 hzp goes to a 1, a 1 appears on the lead 836 and a 0 appears as the debounced time button signal TM, on the subsequent 16 hzp pulse. Thus TIME* and SET* are inverted in the debouncing circuit. A NOR gate 850 is responsive to the signal on the lead 832 which is normally a 0 during release of the button. The NOR gate 850 receives a logical 0 from the lead 836 when TM is a logic 1. A bounce or a 0 on the lead 832 applies a logical 1 or high level to the control electrode of a transistor 852 to clear the series path controlled by the 16 hzp* input. The term LSTM, on the lead 841 is applied to a NAND gate 856 which in combination with a debounced set signal ST generates the master reset signal MR. The master reset signal changes the illustrated watch to a one button watch so that two pushes of the time button (or the equivalent electrical signal) changes the display to the next character. It is to be noted that the circuit for generating the signal MSGB is similar to the debounding circuit for generating the debounce time button signal TM or the signal ST.

Figure 25:
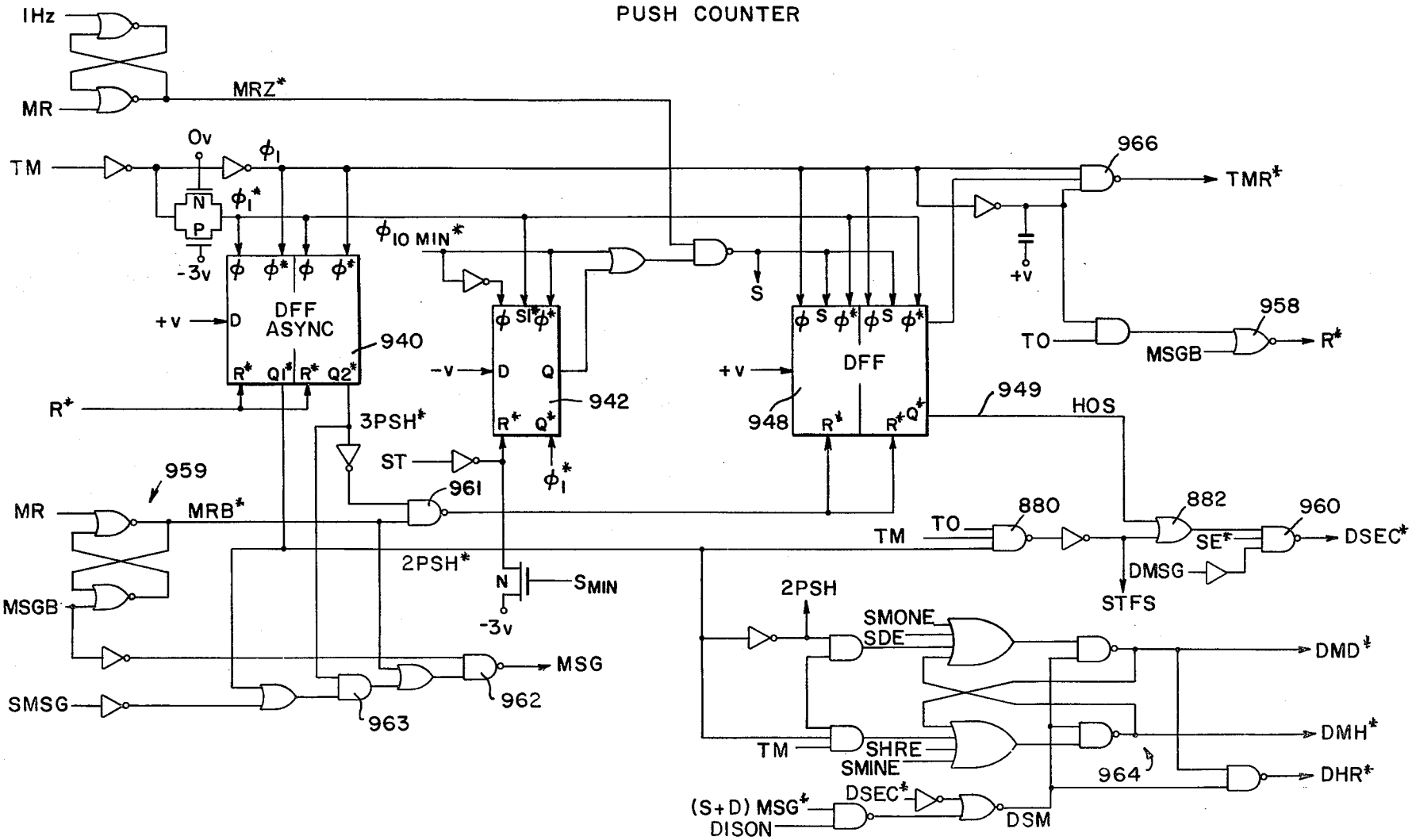
FIG. 25 is a schematic circuit and block diagram of the push counter circuit of FIG. 13.

Referring now to FIG. 25, the watch push counter circuitry will be explained. A flip-flop register 940 which may be formed of asynchronous D-type flip-flops and is the push counter register, responds to the debounced time signal TM to generate 2 PSH* and 3 PSH* signals. A flip-flop 942 which is the S generator flip-flop responds to TM and $\phi$10MIN* (occurs every 10 minutes) to provide a signal to a two flip-flop register 948 to terminate HOS (hands-off-seconds). A NAND gate 960 generates the signal DSEC* for displaying seconds after holding the TIME button down for 1 second. The signal MSG is generated in a gate 962 and signals DMD*, DHM* and DHR* are generated is a circuit 964. A TMR* signal is generated in a NAND gate 966.

A time out or TO signal which is 0 when time is running and a TM or debounced time button signal are applied to a NAND gate 880 with a 2PSH* signal for generating after inversion a signal STFS which with a signal HOS is applied to an OR gate 882. The TO signal is a 1 second deviation time signal. The NAND gate 960 responds to the output of the OR gate 882, a set enable signal SE* and an inverted display message signal DMSG to generate the signal DSEC*. Also, a signal R* which is the reset term for the push counter 940 and indicates that the display is on, is generated by a NOR gate 958 responding to a MSGB signal and the output of an AND gate 888, the latter receiving the debounced time signal TM and the time out signal TO.

An RS flip flop 959 is energized so MRB* goes to a logical O level to convert the watch to a one button watch. Thus the HOS is disabled by a gate 961 and 3 pushes of the time button displays the message by energizing an AND gate 963. When the flip-flop 959 is in the one button condition a first push of the TIME button removes the reset signal R* and a second push of the time button in one second as controlled by TO, causes Q1* of the first flip flop of push counter 940 to go to zero and MSG goes true if SMSG is a 1.

Figure 26:
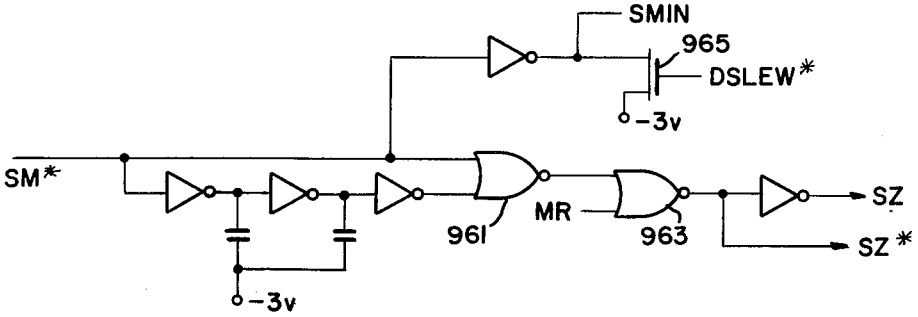
FIG. 26 is a schematic circuit diagram of the slew control circuit that may be utilized in the watch of FIG. 13.

Referring now to FIG. 26, the signal SM* which starts minutes slewing and clears seconds is applied to a NOR gate 961 which in turn passes a signal to a NOR gate 963 also receiving master reset MR to generate the signal SZ*. A trnasistor 965 responsive to DSLEW* controls the SMIN Signal. When SM* goes to zero and an SZ pulse is developed the seconds are cleared. However the SMIN signal is not generated until DSLEW* goes to zero in about 2 seconds. Thus the operator has 2 seconds to turn off the slew minutes request.

Figure 27A:
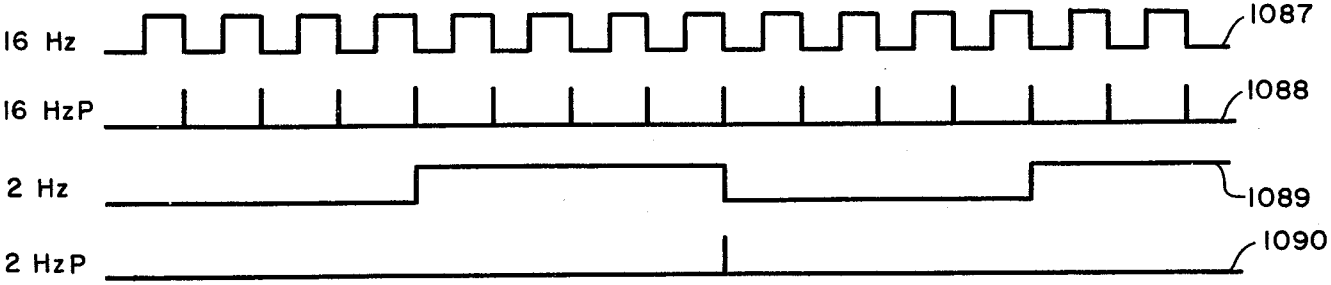
FIGS. 27*a*, 27*b*, 27*c* and 27*d* are time versus voltage waveforms respectively showing the initial divider timing, the clock C timing for fast and slow slew of the message counter, the display message signals controlling the message memory and its connections to the data bus and the debouncer timing.

Referring now to FIG. 27*a* which shows the timing of the initial divider of FIG. 14, the 16 hz and 16 hzp signals of waveforms 1087 and 1088 are shown and it is to be understood that for fast setting, the 16 hz signals may be forced to a frequency of 5 khz. The 2 hz and 2 hzp pulses also generated by the initial divider are shown by respective waveforms 1089 and 1090. It is to be noted that the logical voltage levels for all of the waveforms of FIG. 27*a* as well as FIGS. 27*b*–27*d* are 0 volts and −3 volts.

Figure 27B:
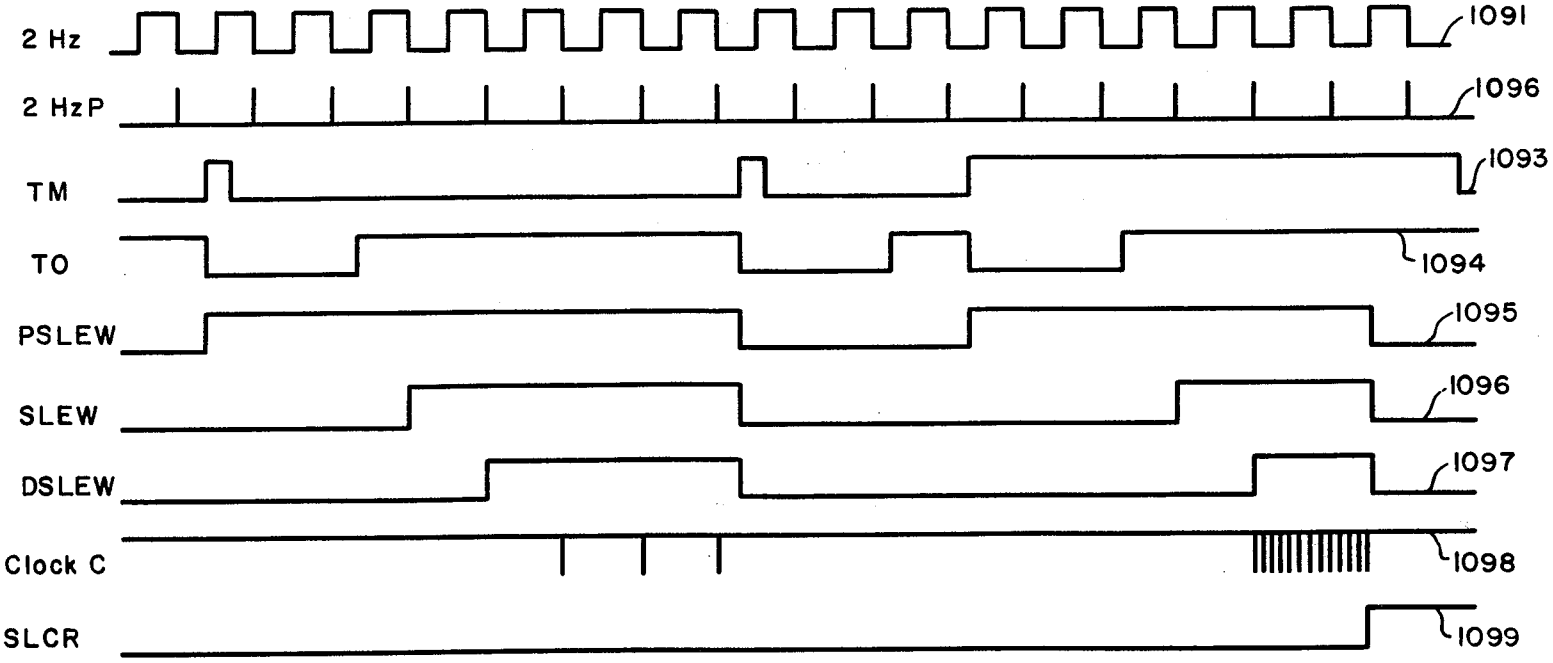

FIG. 27*b* shows the clock C timing for SLO (slow) slew and fast slew as controlled principally by the circuit of FIG. 21. The pulses of the waveforms 1091 and 1092 show the 2 hz and 2 hzp signals and the TM signal of a waveform 1093 shows a short period single push for slow slew and an elongated push for fast slew at 16 hz which causes STFS to go to a one level. The one second timing signal TO is shown by a waveform 1094 and the time setting signal PSLEW is shown by a waveform 1095. The signal SLEW for both slow and fast slew is shown by a waveform 1096 and DSLEW which gates clock C is shown by a waveform 1097. Clock C slow and fast is shown by a waveform 1098, and when controlled by the system of the invention, the slewing is at the rate of approximately 5 khz. The slew clear signal SLCR shown by a waveform 1099 funcions to control manual slewing rapidly to certain letters. It is to be noted that in operation with the illustrated setting system in accordance with the invention, the watch operates in the SLO slew mode.

Figure 27C:
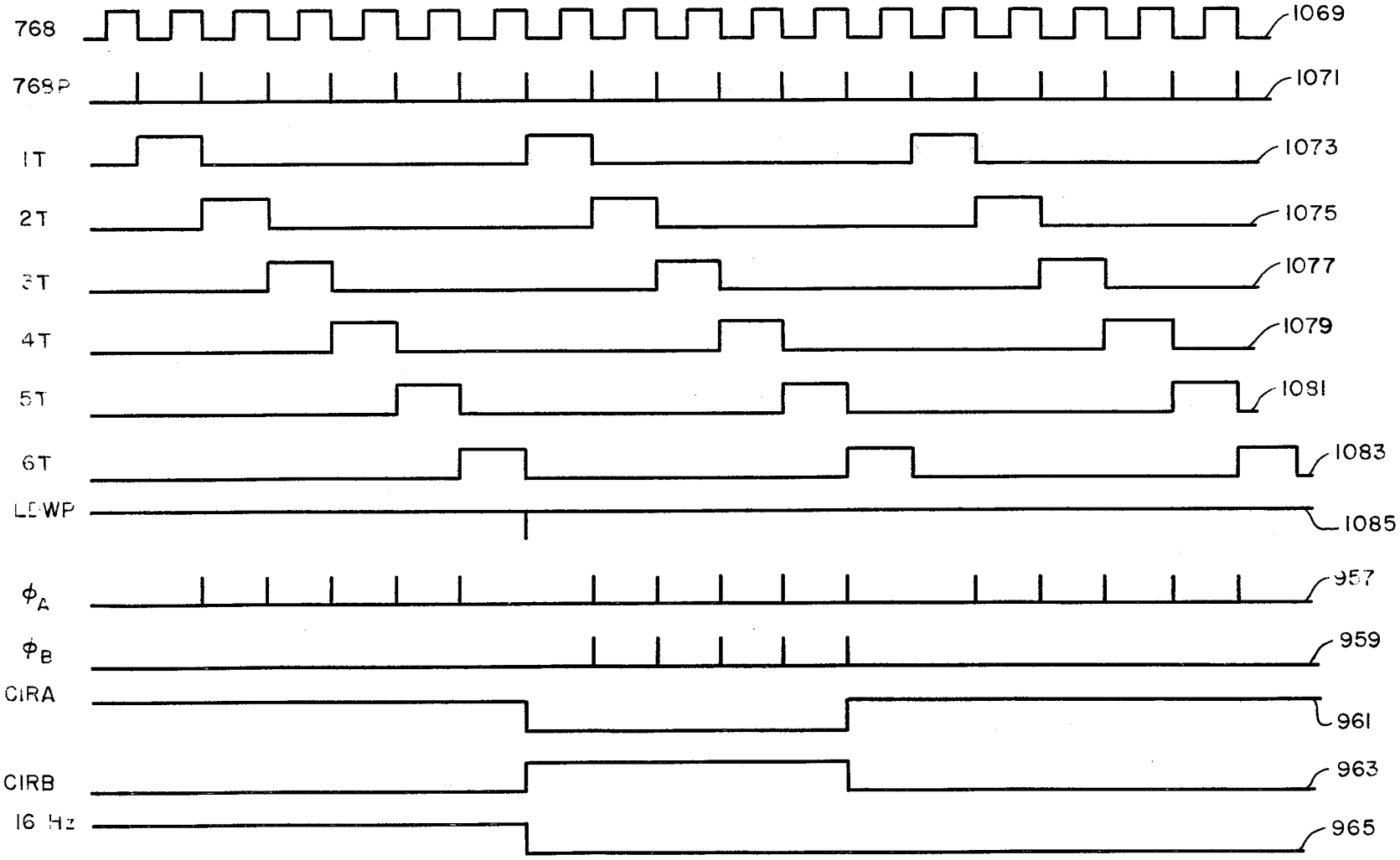

Referring now to FIG. 27*c*, the shift register control of FIG. 22 and the digit multiplexer of FIG. 20 will be explained in further detail. The 768 hz and 768 hzp signals of respective waveforms 1069 and 1071 show the signals derived from the initial divider. The signals of waveforms 1073, 1075, 1077, 1079, 1081 and 1083 show the respective signals 1T to 6T, the first five of which define the display time slots. The signal LDWP* of a waveform 1085 for loading a word into the register occurs at the end of the synchronization pulse 6T. The signals $\phi_A$ and $\phi_B$ for transferring letters or words into the registers of FIG. 22 are shown by waveforms 957 and 959. The signals CIRA and CIRB of waveforms 961 and 963 control the transfer from and to the data bus in the system of FIG. 22. The 16 hz signal is shown by a waveform 965. During the first group of pulses of the waveform 957 a character is shifted out of register 800 and into its input at the data bus. During the second group of pulses of the waveform 957, a word is shifted from register 806 to the data bus. During the third group of pulses of the waveform 957 a new character is circulated from the output to the input of register 800.

Figure 27D:
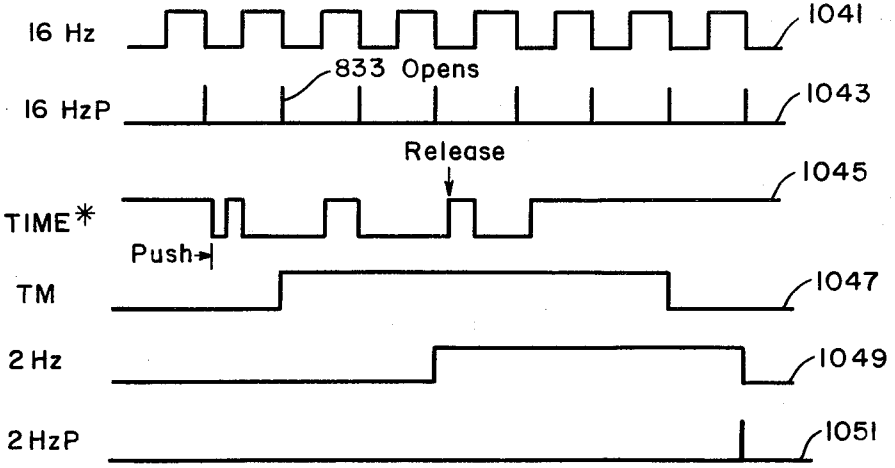

Referring now to FIG. 27*d* which shows the debounce timing for the debounce circuit of FIG. 24, the 16 hz and 16 hzp pulses are shown by waveforms 1041 and 1043 and the TIME* button is shown with two bounces after being pushed and one bounce after being released by a waveform 1045. The signal TM of a waveform 1047 after termination of the bouncing falls only after two 16 hzp pulses have occured. The 2 hz and 2 hzp pulses of waveforms 1049 and 1051 are shown to further clarify the relationship of the 16 hz and 2 hz signals.

Figure 28:
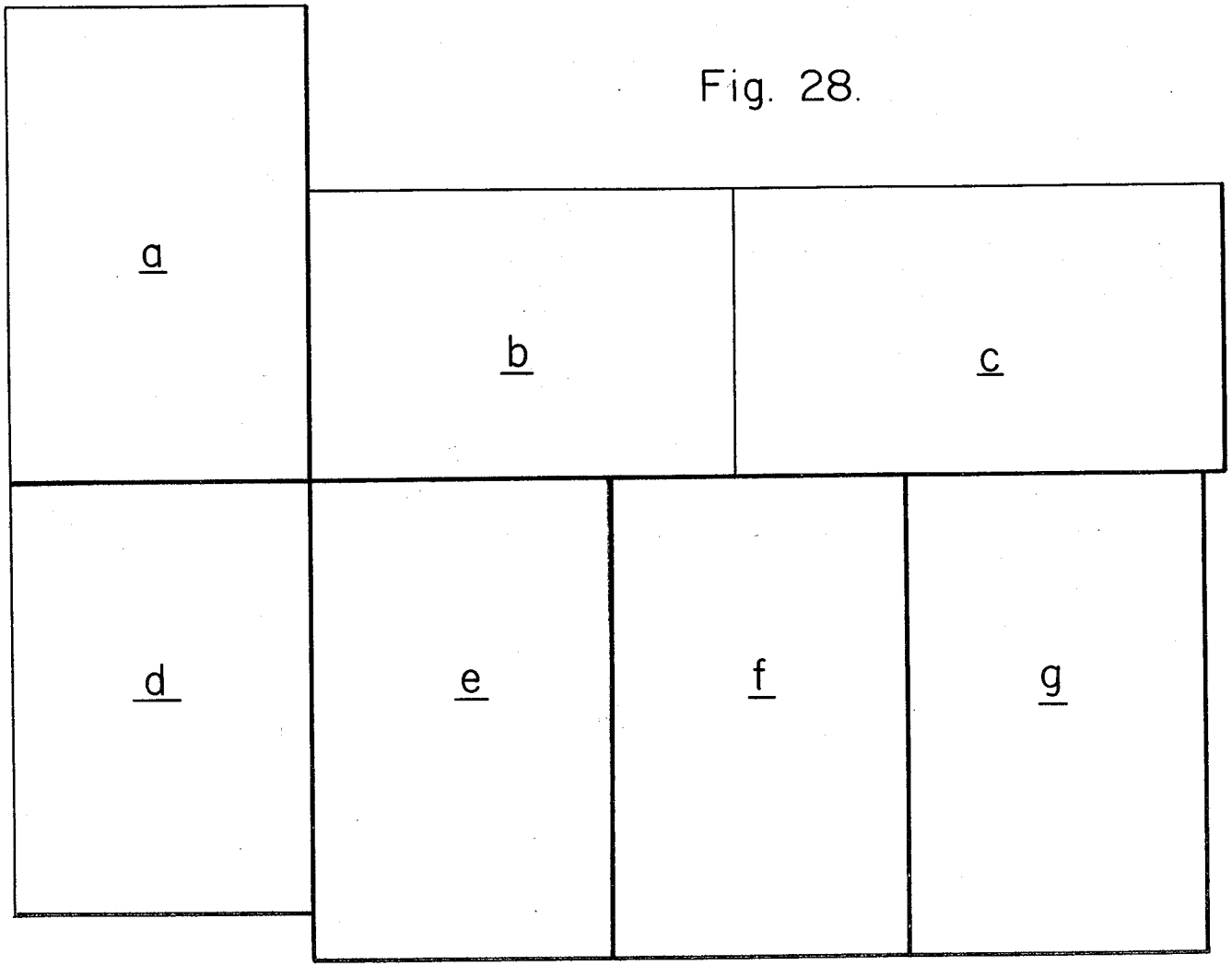
FIG. 28 is a schematic diagram for showing the arrangement of the FIGS. 28*a* to 28*g* which together show the data entry unit.
Figure 28A:
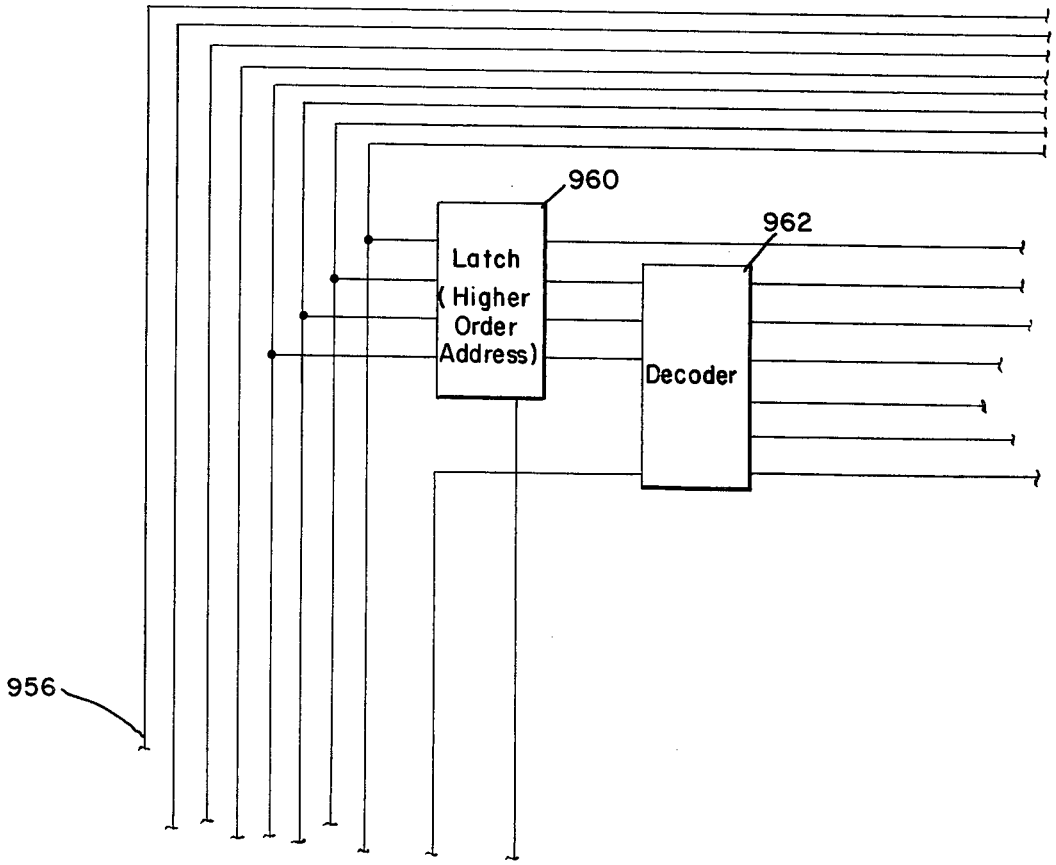
Figure 28B:
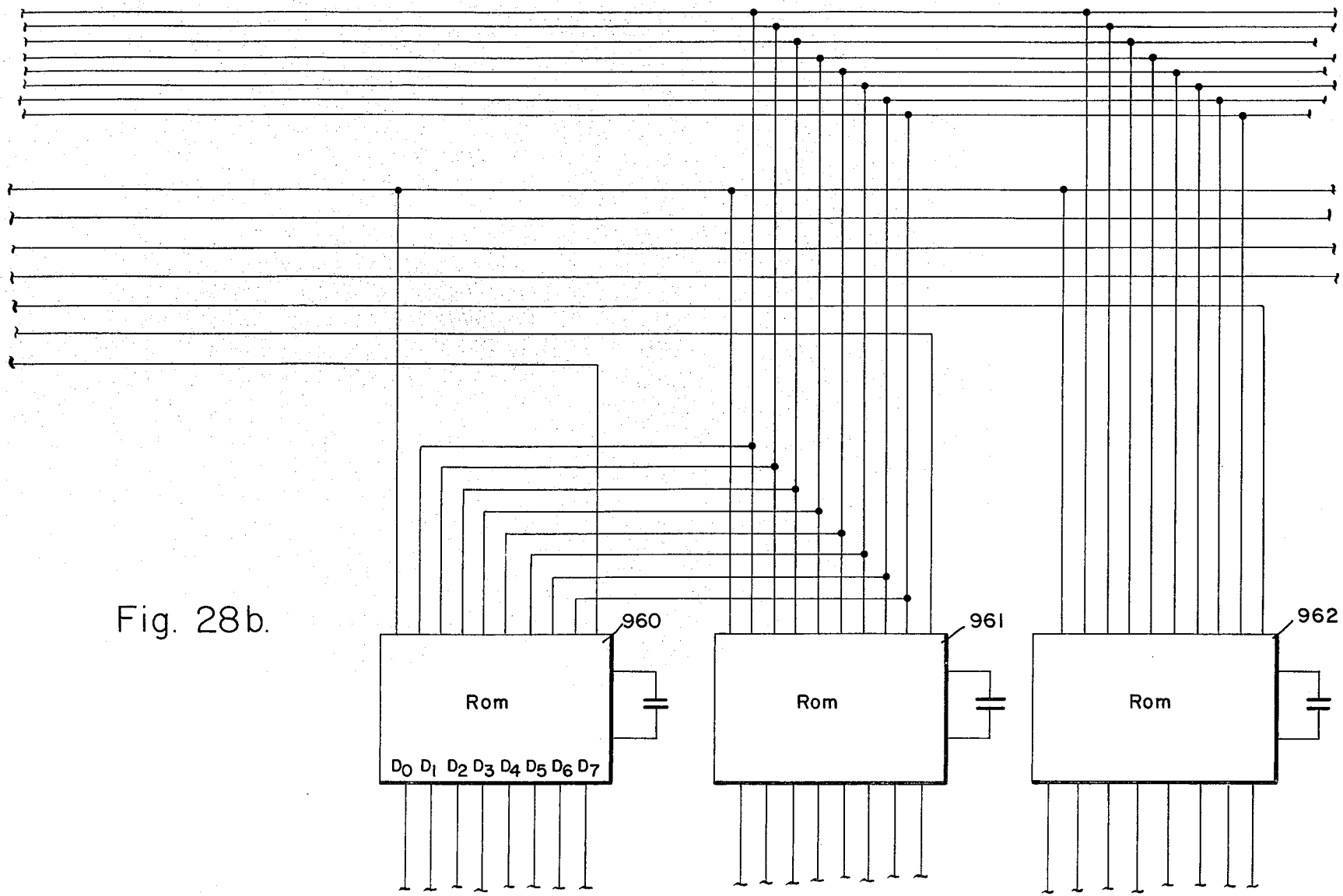
Figure 28C:
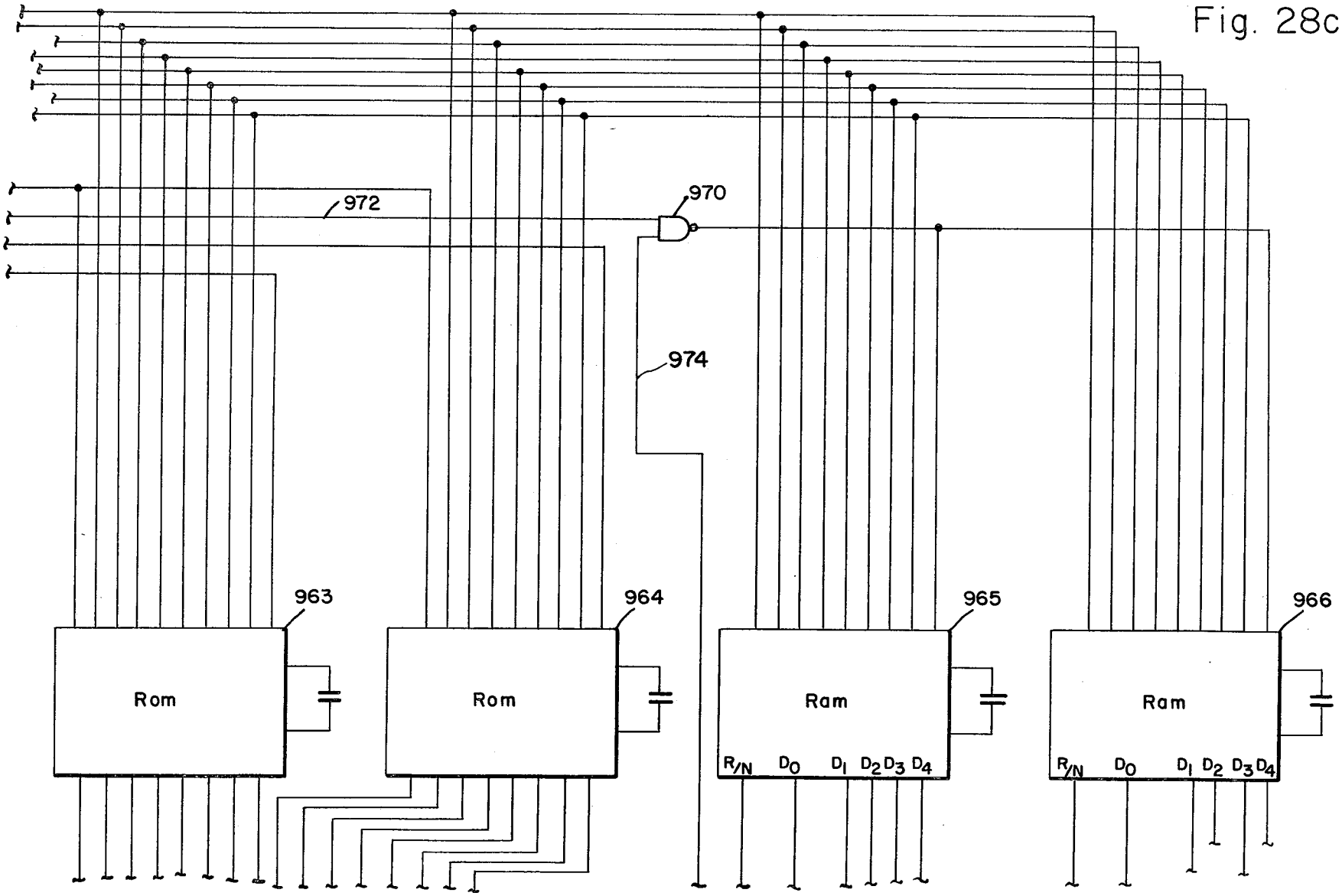
Figure 28D:
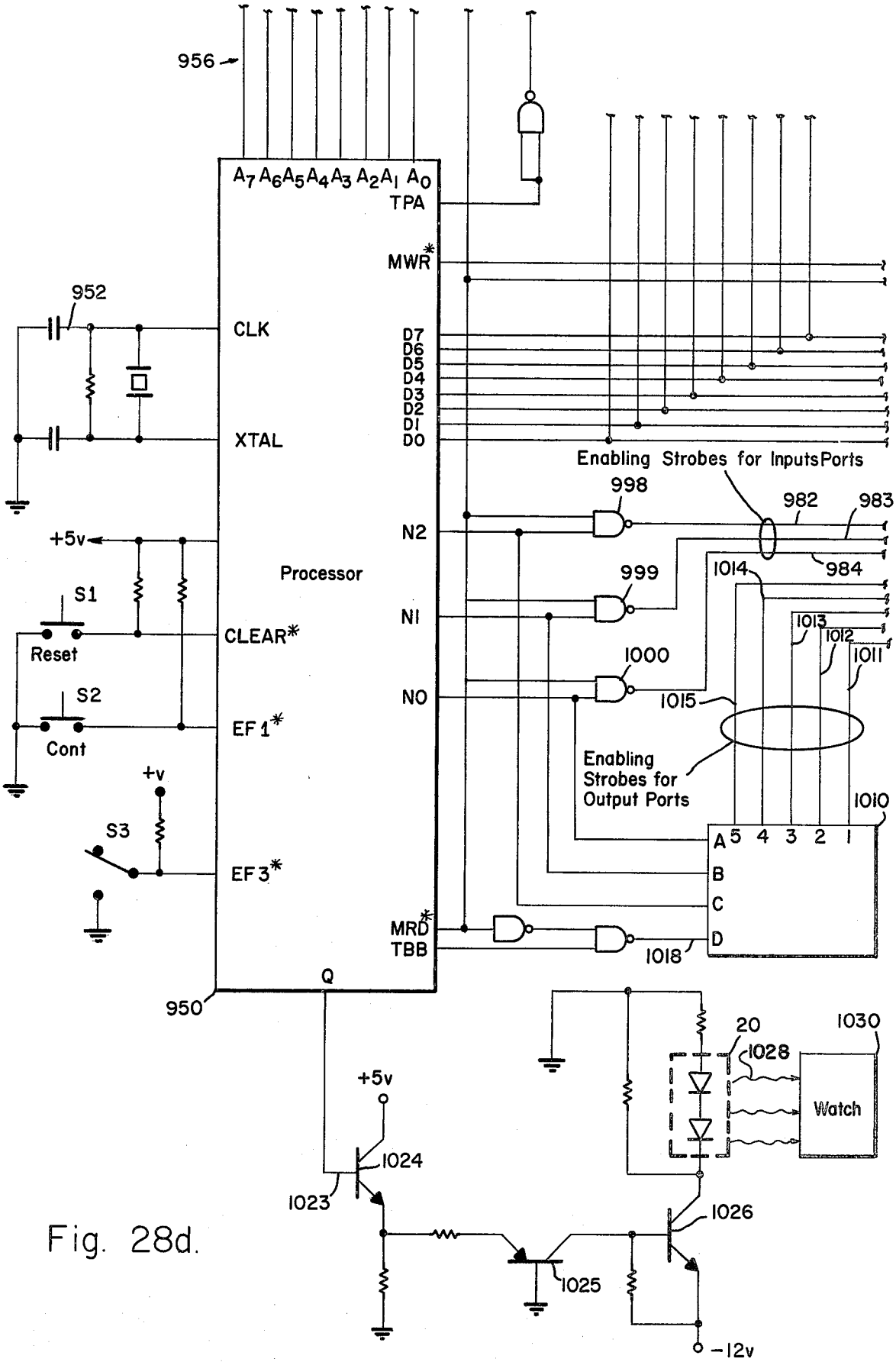
Figure 28E:
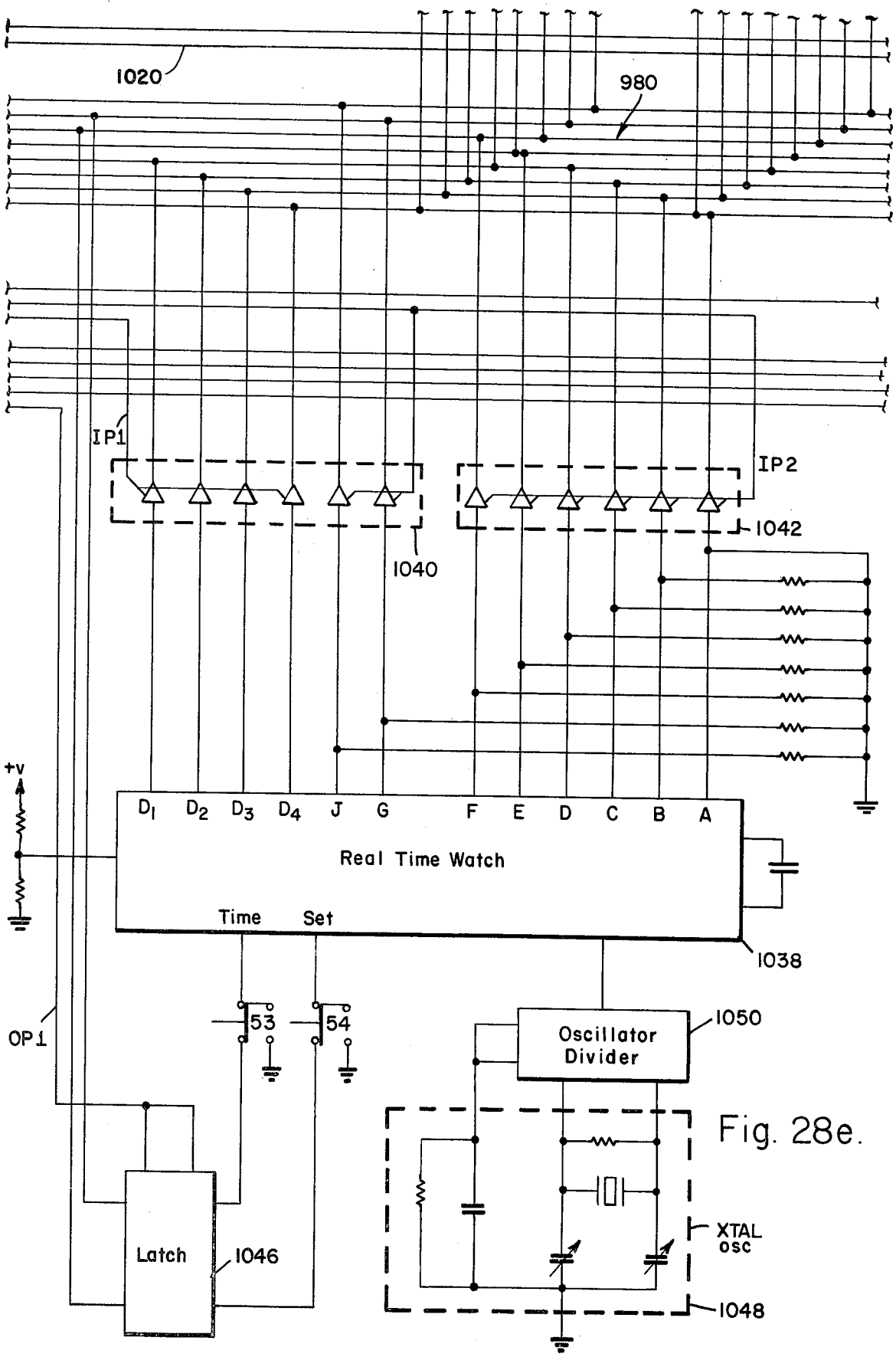
Figure 28F:
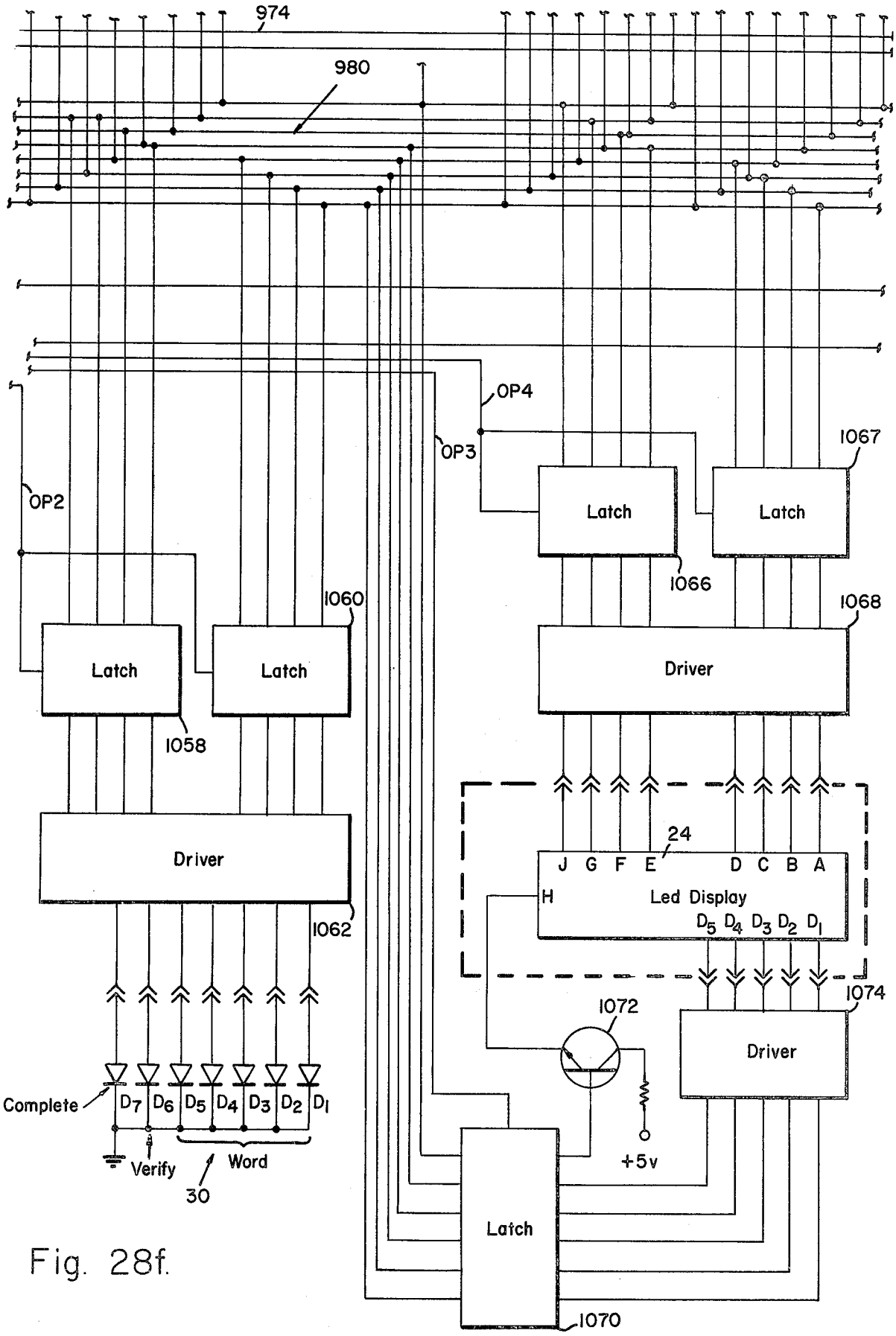
Figure 28G:
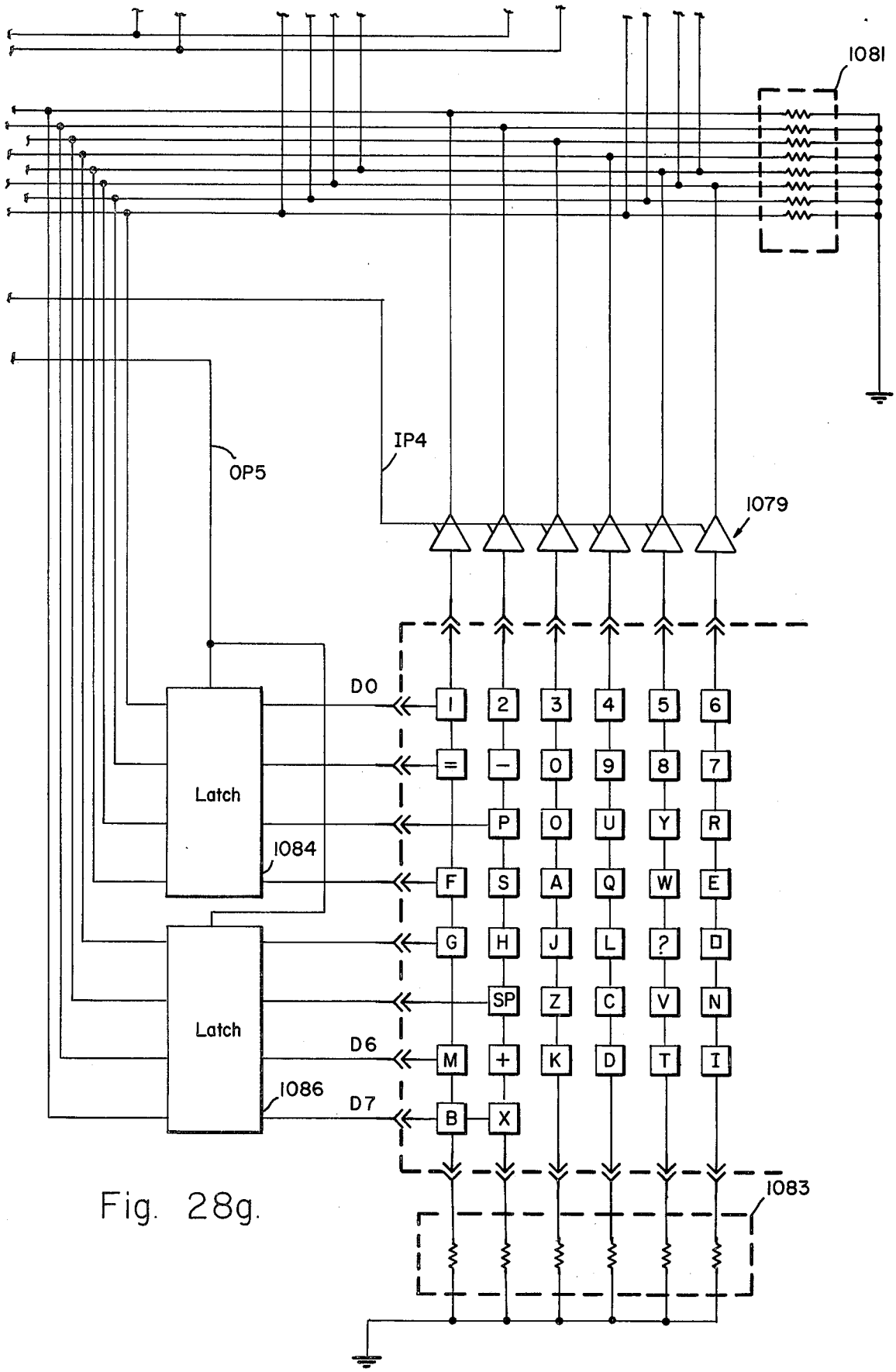

Referring now to FIGS. 28*a* to 28*f* which together (as illustrated in FIG. 28) show the data entry unit or the time and message set unit, in accordance with the invention, to provide the serial coded signals from an LED (or any suitable light source), will be explained. A processor 950 which for example may be an RCA CD1802 includes a clock source 952 which, for example, may be a typical $\pi$ network controlling a crystal oscillator to provide a CLK signal to the processor and includes connections through reset and continue switches S1, S2 to ground which respectfully provide the signals CLEAR* and EF1*. The continue switch S2 effectively provides an external flag connection for the processor. A toggle switch S3 provides a flag EF3 for indicating whether Time is to be set or message and time are to be set into the watch. The processor 950 is coupled through an address bus 956 to five read only memories (ROM) 960 to 964 as well as being coupled to two random access memories 965 and 966. The computer system utilizes an eight bit address multiplexed in time to effectively provide a 16 bit address. The higher order address of lines A0 to A3 are applied to a latch 960 which applies signals through a decoder 962 to select one of the ROM memories 960 to 964. It is to be noted that the instructions of the program are stored in the ROM memories 960 to 964 but writing therein is not required, only reading programs therefrom after addressing. The lower address, that is signal A4 to A7 for addressing the memory cell of a selected memory chip is applied to the bus 956 after latching has occurred for selection of a memory 960 to 964. It is to be noted that the same address bus 956 is utilized for the RAM memories 965 and 966. A NAND gate 970 is utilized to disable the output of the RAM memories 956 and 966 if they are going to be written into. The NAND gate 970 receives a signal on a lead 972 and a signal on a lead 974 MWR* which is at a low logical level when the processor is going to write into the scratch pad memories 965 and 966. A bus 980 from the processor 950 with separate leads designated D0 to D7 is the data bus and sequentially receives instructions of the program from the selected ROM memories 960 to 964 followed by either transmission or reception of data to the RAM memories 965 and 966.

The RAM memories 965 and 966 each include 4 bits so 8 bit words are simultaneously written therein or read therefrom. A signal MRD* tells the scratch pad memory when to read and transfer the data to the processor or when to write data from the processor 950. When MWR* is at a low level, the processor writes into the RAM memories 965 and 966 and when MRD* is low, the processor reads words from the RAM memories 965 and 966. Enabling strobes for the input ports of the system are included on leads 982, 983 and 984 respectively derived from NAND gates 988, 999 and 1000 in turn each responding to the respective signals N2, N1, N0 along with the signal MRD* representing that the processor is reading data. The three processor input port lines 982, 983 and 984 are also respectively labelled IP4, IP2 and IP1. A decoder 1010 provides five enabling strobe lines for the processor output ports 1011 to 1015 also respectively labelled OP1 to OP5. The decoder 1010 receives the three signals N0 to N2 as well as a signal on a lead 1018 indicating that the data bus is valid in time, that is, it is the proper time for the processor to apply data to its output ports. Each of the RAM memories 965 and 966 also receives the signal MRD* on a lead 1020 connected to D0 of the memory indicating that it is the proper time to write into those two scratch pad memories.

The Q signal from the processor 950, which signal may be between 0 and +5 volts is applied on a lead 1023 to the base of an NPN-type transistor 1024 operating as a voltage follower to apply a signal to the emitter of a PNP-type transistor 1025 connected as a common base transistor for level conversion. The collector of the transistor 1025 is applied to the base of a power driver transistor 1026 of the NPN-type having its collector coupled between ground and a plurality of LEDs fo the LED array 20 which may be any desired number including one and may be arranged in any suitable arrangement such as an array of LEDs in a circle. The LED array 1027 transfers light pulses as indicated by a line 1028 to a watch 1030. The system has been found to operate satisfactorily to transfer the data with six spectronics #SE 3453-004 infrared LEDs arranged in a circle. For puposes of this invention, the term array means any arrangement of a plurality of LEDs to provide a light or energy source. It is to be noted that the system in accordance with the invention may operate to emit or transmit and to receive energy signals in the visible light region, and in the IR (infrared) region, or in any suitable spectral region such as RF or ultrasonic. For the purposes of this invention, the term light means any frequency region over a bandwidth of the IR and visible light spectrum and the term energy includes any suitable frequency which can be transmitted and received in accordance with the principles of the invention.

The phototransistor 48 of FIG. 5 is shown without an amplifier in the lead 88. It is to be understood that within the scope of the invention, a suitable amplifier may be utilized at the output of the phototransistor 48 and in some arrangements this amplifier would simplify the amplifying arrangement at the LED array 20 of FIG. 28*d*. Further, it is to be noted that the principles of the invention are not to be limited to the amplifying structure of FIG. 28*d* or to any specific number or arrangement of LEDs and the concept of the invention includes any other suitable light or energy source for transferring the data pulses as well as any suitable signal receiver illustrated as the phototransistor.

The first input port to the processor 950 is a real time watch 1038, and the term IP1 on the lead 984 opens the gates of lines DI to D4 of units 1040 and the term IP2 on the lead 983 opens the gates of lines J and G and A-F of unit 1042 so that segment information A to G, J and digit information DI to D4 passes into the bus 980 and into the processor 950. A latch 1046 also receiving the signal OP1 and two bits from the data bus 980 previous to reading the reference watch energizes either the SET or TIME inputs of the real time watch 1038 so that the proper information year, month, day, hour, minute or second appears on the output bus. All of the time in the illustrated watch is provided by energizing the SET signal except seconds which is provided as a result of energizing the TIME signal. It is noted that the real time watch is not limited to this particular arrangement but the SET input was utilized because in the illustrated watch if hours and minutes are read, seconds come on automatically. The crystal oscillator for the real time watch 1038 is provided by a crystal oscillator unit 1048 as is well known in the art and an oscillator divider 1050. The real time watch 1038 applies signals D1 to D4 in response to a signal IP1 on the lead 984 and applies the signals A to F, J and G to the bus 980 in response to the signal IP2 on the lead 983 so that the processor has a choice of receiving either segment or digit data.

For the console display lights, the signal OP2 on the lead 1012 is applied to latches 1058 and 1060 so that an output can be provided from the processor 950 to the LEDs D1 to D7. The processor applies the signals to select the LEDs through the data bus 980 and after signals are latched in the latches 1058 and 1060 they are applied to a driver 1062 to energize the LEDs selected by the processor logic. The LEDs D1 to D7 respectively correspond to display lights 30 to 34, 36 and 37 of FIG. 1.

For outputting information to the LED display on the console indicated as display 24 also seen in FIG. 1, the signal OP4 on the lead 1015 is applied to latches 1066 and 1067 so that data on the bus 980 is stored therein for being applied through a driver 1068 to the LED display 24. The signal OP4 latches the segment data as derived from the data bus 980 and a signal OP3 on the lead 1013 is applied to a latch 1070 and latches the digit information as well as in the illustrated arrangement the term H for the segment data. A NPN-type transistor 1072 acts as a driver for the segment signal H and a driver 1074 acts as a driver for the digit signals D1 to D5.

A signal to input the column data from the keyboard IP4 on the lead 982 energizes a gate unit 1079 so that if any of the keys of the keyboard are pressed, the processor senses a 1 in that column. Prior to this, the processor writes a 1 or applies a high voltage on each row of the keyboard. If the processor reads a 1 on one of the columns, then energizes signal OP5 which latches the signals from each of the rows of the keyboard, the processor then through the data bus 980 checks each row one at a time to see if a high level signal is thereon. The arrangement of the processor and its memory chips, address lines, data lines is well known in the art as described in RCA manual MPM 201 RCA Microprocessor 1800 User Manual for the CDP 1802, COSMAC Microprocessor, copy-righted 1976 by RCA Corporation. All of the units utilized in the test set in the illustrative example may be the following RCA or National units.

Decoder 960, MM74C175
Decoder 962, MM74C42
Processor 950, CD1802.
ROM memories 960 to 964, MM5204Q which are 512×8 EPROM memories chips.
RAM memories 965, MM2101-IN which is 256×4 bit RAM.
Decoder 1010, CD4028
Gates 1040 and 1042, 80C97
Real time watch 1038, suitable digital watch such as a Hughes Aircraft digital watch.
Latch 1046, CD4013
Latch 1058, Latch 1060, 74C175
Driver 1062, DS8867N
Latches 1066 and 1067, 74C175
Driver 1068, DS8867N
Driver 1074, DS8877N
Latch 1070, 74C174
Latches 1084 and 1086, 74C175N and
Resistors Chips 1081 and 1083, 4116R-001-104.

Now that the setting circuit has been described, the program operative in the illustrated processor will be explained for providing the serial Q data to the watch to provide the time setting or message setting in accordance with the invention. The program will be explained in sufficient details so that it can readily be programmed into the illustrated CD1802 processor or any other suitable type of processor by those skilled in the art.

Figure 29:
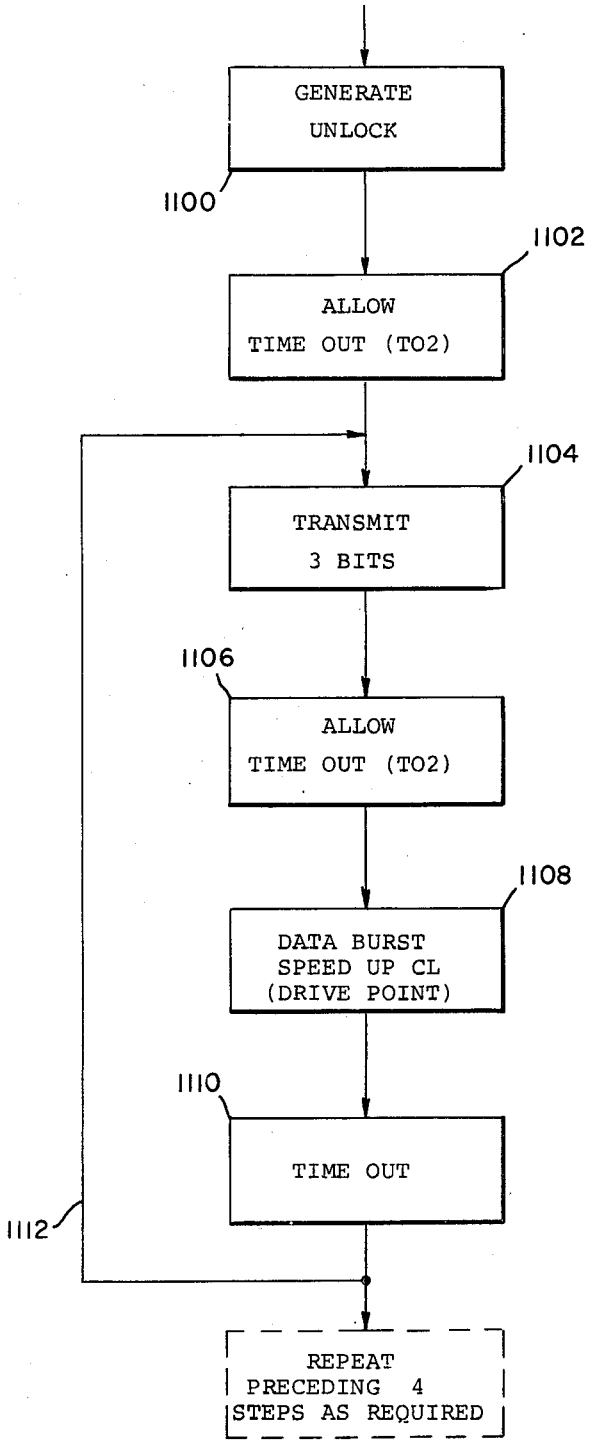
FIG. 29 is a general flow diagram for explaining the serial data transfer to the watch module.

Referring first to the flow diagram of FIG. 29 as well as to the timing diagram of FIG. 4, the data entry unit first generates unlock from an unlock code in a box 1100 which as previously explained is stored as a code in the ROM. A time out TO2 period, in a box 1102 is followed by transmission of three command bits in a box 1104 again followed by a time out period in a box 1106. This time out period is followed by a data burst of a box 1108 having a predetermined number of pulses which are applied at a high pulse rate to the serial interface to speed up the clock in the watch module being set. The data bursts, as well as the command bits may, for example, have a 5 khz rate in the illustrated system. After the box 1108, a time out or TO2 period is again provided in a box 1110 and the preceeding four steps are repeated through a path 1112 as many times as are required to complete time setting or message and time setting in accordance with the invention. It is to be noted that except for unlock, the SIG* pulses transmitted by the LED is repetitively three instruction bits followed by a calculated or predetermined number of bursts of data pulses.

Figure 30:
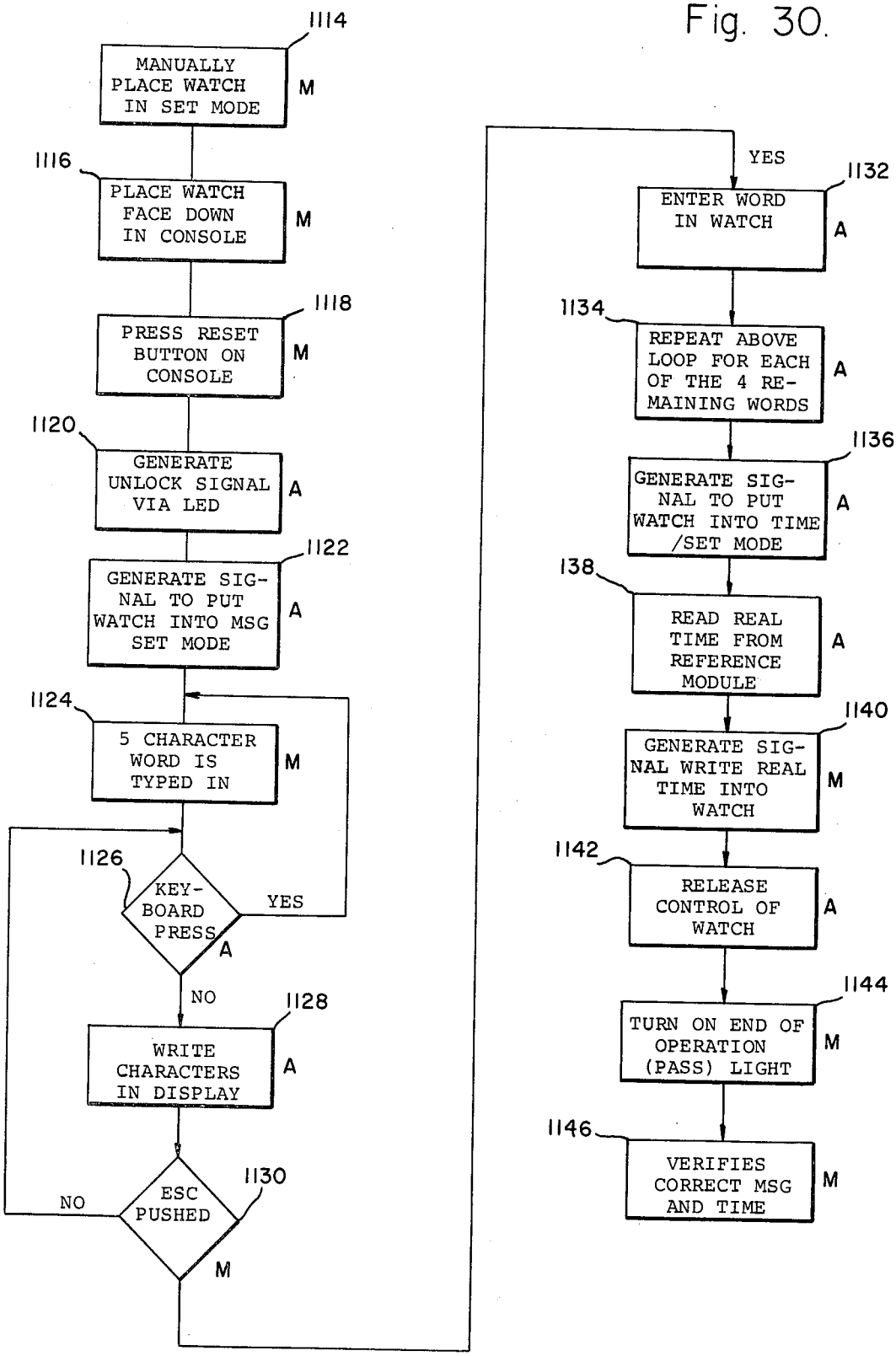
FIG. 30 is a general flow diagram for explaining the overall sequence of time setting and message setting.
Figure 31:
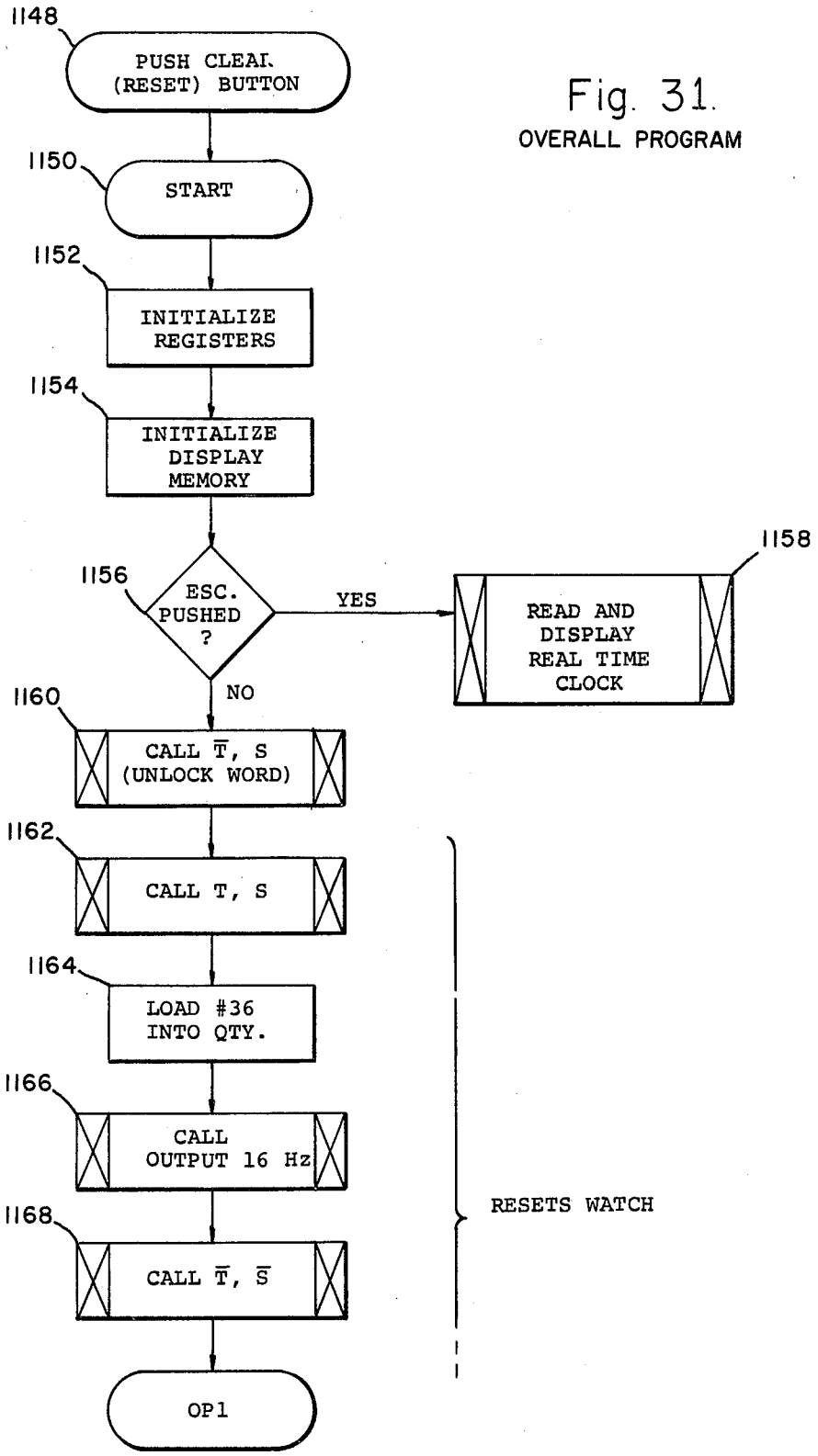
FIGS. 31 through 34 are flow diagrams of the OVERALL PROGRAM that may be utilized in the processor in accordance with the invention.
Figure 32:
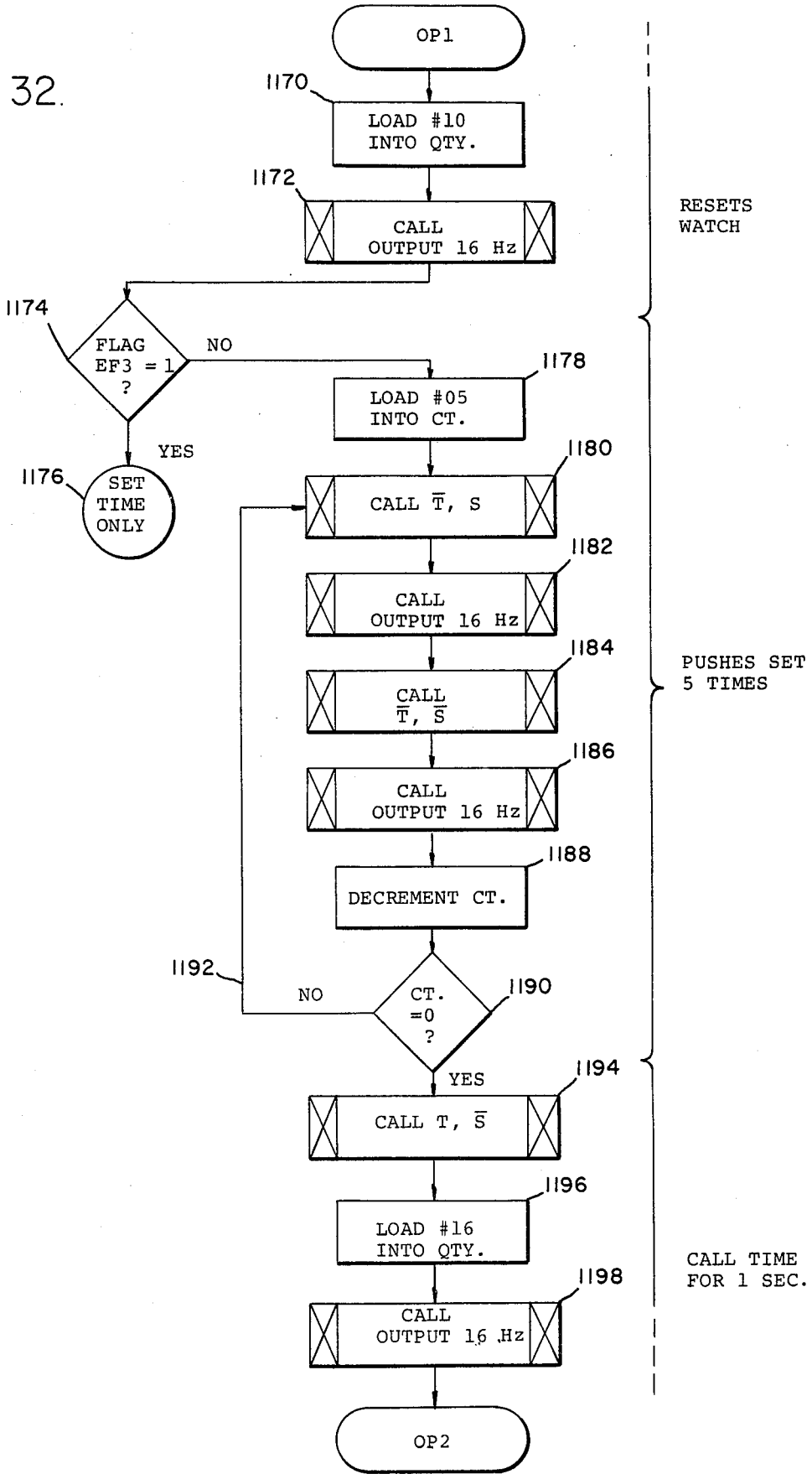

Referring now to FIG. 30, an overall flow diagram showing the control of the test unit of FIG. 1 for message set followed by time set will be explained in which an M by a box represents a manual operation and an A by a box represents an operation controlled by the processor. As indicated in a box 1114, the watch to be set is manually placed in the set mode, such as by pushing the recessed set button. In a box 1116, the operator places the module face down in the console and then presses the reset button on the console in a box 1118. The processor responds in a box 1120 to generate the unlock signal which is transferred as light from the LED 20 to the serial interface in the watch. In a box 1122, the processor generates a signal to put the module into the message set mode and in a box 1124, the operator types in a five character word into the scratch pad memories. In a box 1126, the keyboard is pressed and if the word is improper, the five character word is again typed in as indciated in the box 1124. If the word is proper, the characters are written into the display as indicated in a box 1128, and in a box 1130, the escape button is pushed so that the processor enters this word into the watch module in a box 1132. A box 1134 indicates that the message typing loop is repeated for each of the four remaining words that are to be entered into the watch, the illustrative watch holding five characters each. In a box 1136, the operator then generates a signal to put the watch into the time/set mode and in a box 1138, the processor reads the real time from the reference module. In a box 1140, the operator generates a signal to write real time into the watch. The processor, in a box 1142, releases control of the watch by leaving the signal SIG* low for a predetermined length of time. In a box 1144, the operator then turns on the end of operation or pass light and verifies that there is a correct message and time, if desired, in a box 1146. It is to be noted that the above flow diagram is for a message watch in which the message is first automatically set into the watch followed by the time being set into the watch. However, it is to be understood as will be explained subsequently, that the principles of the invention are equally applicable to setting only the time into a watch.

Referring now to FIGS. 31 to 36, the OVERALL PROGRAM will be first explained. To start, the reset button is manually pushed and relased to clear the test set in a box 1148. The processor operation then starts in a box 1150 and the registers are initialized and display memories initialized in boxes 1152 and 1154. If the escape button was previously pushed by the operator, a box 1156 branches to a subroutine READ AND DISPLAY REAL TIME CLOCK of a box 1158. If the escape button is not pushed, the program proceeds to CALL $\overline{T}$, S of a subroutine box 1160 which unlocks the serial interface. The next subroutine of a box 1162 is, CALL T, S followed by loading number 36 into a predetermined register in a box 1164. The next subroutine is CALL OUTPUT 16 hz in a box 1166 followed by CALL $\overline{T}$, $\overline{S}$ in a box 1168, that is, not time and not set which is equivalent to release of the buttons. In a box 1170, the number 10 is loaded into a predetermined memory position and in a subroutine of a box 1172 CALL OUTPUT 16 hz is performed. At this point, the watch has been reset. In a box 1174 if, the switch was previously selected (Flag EF3=1), the program proceeds to a set time only routine indicated by a circle 1176 and if the switch is not pushed, the routine proceeds to box 1178 (for memory set followed by time set), which is, load the number 5 into a selected memory cell. The box 1180 subroutine call $\overline{T}$, S (set and not time) is then performed, in box 1182 the subroutine CALL OUTPUT 16 hz is performed, in a box 1184 the subroutine of CALL T, S (not time and not set) is performed and in a box 1186 the CALL OUTPUT 16 hz subroutine is performed. In a box 1188, the count 5 is decremented and in a box 1190, a check is made to see if it is zero and if it is not zero, the path of a line 1192 is followed back to the box 1180. Thus, this routine effectively pushes the set button on the watch being set five times which is the requirement in the illustrated watch for setting in a message.

When the determination in the box 1190 indicates a 0, the watch is then ready for setting a message and in a box 1194, CALL T, $\overline{S}$ (time and not set) is called. The number 16 is loaded into a selected memory position in a box 1196 followed by the subroutine of CALL OUTPUT 16 hz in a box 1198. In a box 1200, the subroutine CALL $\overline{T}$, $\overline{S}$ is performed followed by CALL OUTPUT 16 hz in a box 1202, completing the routine of calling time for one second. In a box 1204, the processor sets the word light which is one of five word lights, followed by the subroutine of box 1206 which is CALL READ KEYBOAD. The next operation is CALL MUX DISPLAY in a box 1208 followed by a decision in a box 1210 of whether the fifth digit is typed and if the answer is no, repeating the character operation in a path of a line 1212. When the fifth digit is typed, the processor sets the verify light in a box 1214 and then in a box 1216 sets the keyboard pointer to digit one. If the operator has not pushed the escape button in a box 1218, the operation proceeds to a box 1219 which is the subroutine CALL MUX DISPLAY. If the keyboard key is not pressed in a box 1220, the routine returns to the box 1218 and if it is pressed, the routine goes to a box 1222 which is reinitialize the display memory and returns to the CALL READ KEYBOARD subroutine of the box 1206. If the escape button is pushed in the box 1218, the routine goes to a box 1224 which is a subroutine CALL SET WORD INTO WATCH followed by a box 1226 which is a subroutine CALL SEQUENCE WATCH SET. A decision box 1228 then determines whether the fifth word is set and if the answer is no, the operation proceeds to a box 1230 which shifts the word counter to the next word. From the box 1230, the routine then returns to the box 1206 and this operation is repeated until the fifth word is set. When the fifth word is set in the box 1228, the routine proceeds to box 1234 which is reset word number lights. The routine then proceeds to SET TIME ONLY indicated by the circle 1176.

Figure 35:
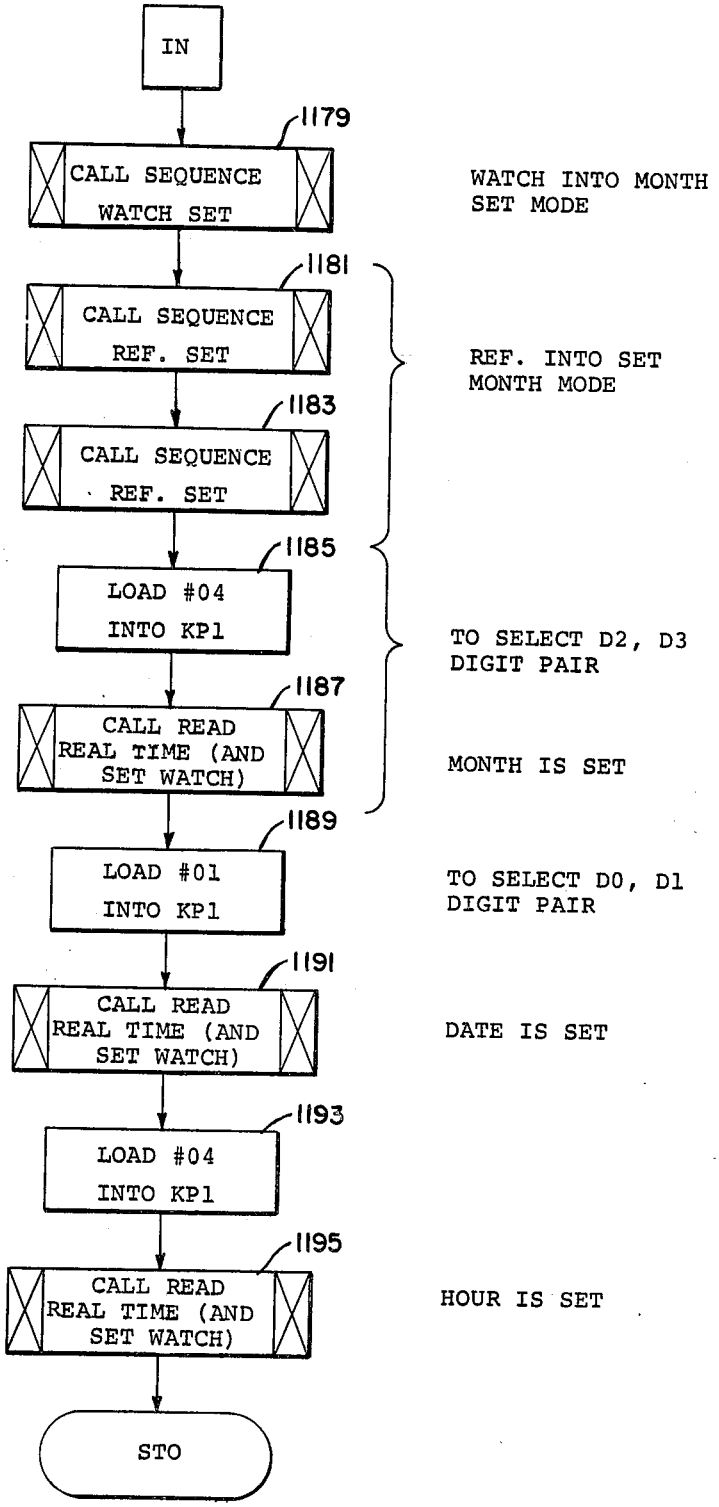
FIGS. 35 and 36 are flow diagrams for SET TIME ONLY.
Figure 36:
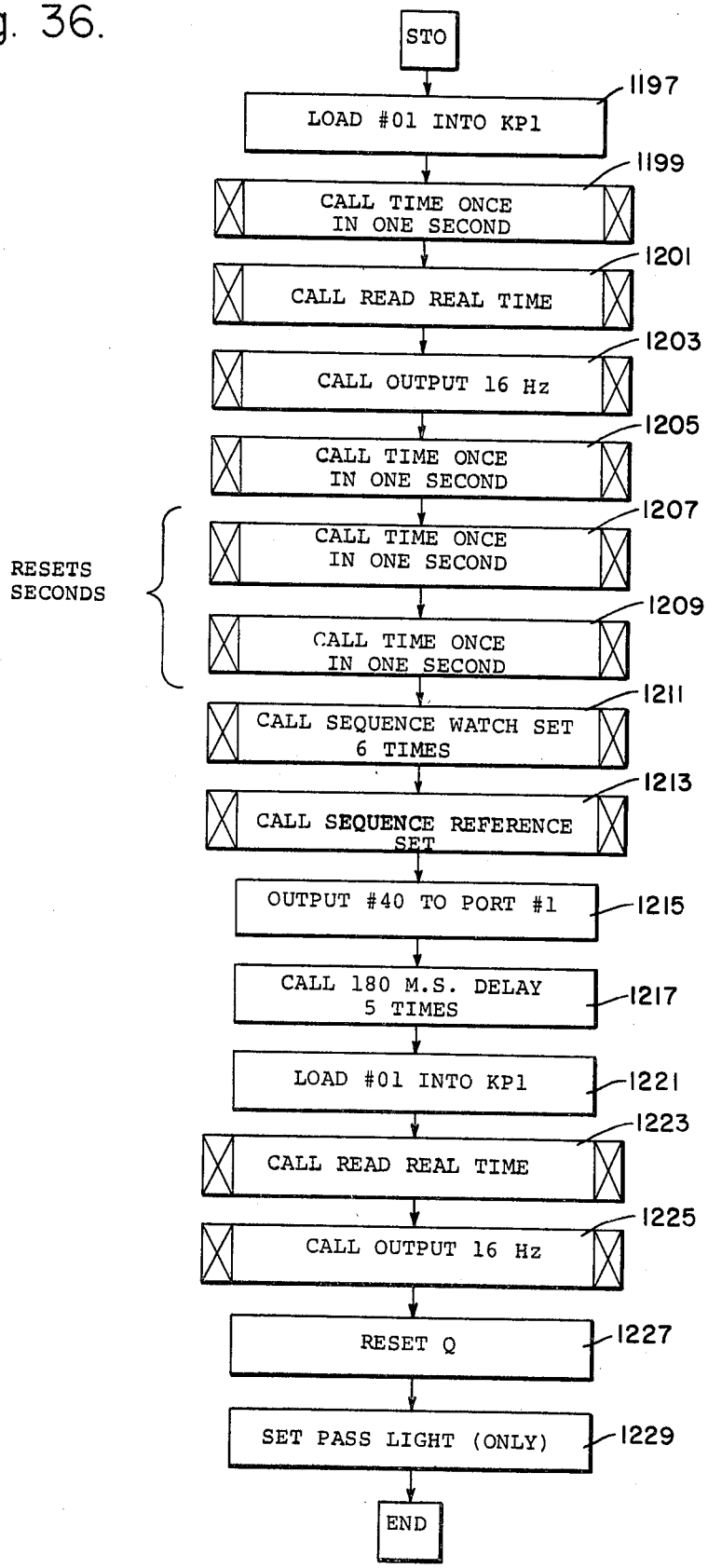

Referring now to FIGS. 35 and 36, which is the SET TIME ONLY routine, the first operation is CALL SEQUENCE WATCH SET in a box 1179 which sets the watch to be set into the month set mode. This routine is followed sequentially by CALL SEQUENCE REFERENCE SET in boxes 1181 and 1183 which is performed twice so that the watch module goes into the month set mode and a year set mode is skipped (the year mode is programmed therein for watches that do have the year mode display). The next sequence of a box 1185 is load number 4 into memory position KP1 to select the digit pairs D2 and D3 from the reference watch. It is to be noted that in the memory positions 1, 2, 3 and 4 are respectively D3, D2, D1 and D0 pulses. D2 and D3 are a digit pair transferred to the watch. A month is then set in a subroutine 1187 which is CALL READ REAL TIME (AND SET WATCH) followed by loading the number 01 into memory position KP1 to select the D0 and D1 digit pair in a box 1189. In a subroutine 1191, the date is set by the CALL READ REAL TIME (AND SET WATCH) followed by the routine in a box 1193 which is load number 04 into memory position KP1. In a box 1195 which is CALL READ REAL TIME (AND SET WATCH), the hour is set in the watch module being set.

Referring now to FIG. 36, in a box 1197 the number 01 is loaded into memory position KP1, and the minutes are set. The watch and the reference are then out of the set mode. The next subroutine is a box 1199 CALL TIME ONCE IN ONE SECOND, followed by a box 1201 CALL READ REAL TIME, followed by a box 1203 CALL OUTPUT 16 hz which in turn is followed by a box 1205 CALL TIME ONCE IN ONE SECOND. It is to be noted that CALL TIME ONCE IN ONE SECOND starts or stops the slewing of the watch and CALL OUTPUT 16 hz is utilized to output the number of pulses that are being transmitted over to the watch. In boxes 1207 and 1209 which are CALL TIME ONCE IN ONE SECOND, theseconds are reset and in a box 1211 a subroutine is performed CALL SEQUENCE WATCH SET, six times, followed by a box 1213 CALL SEQUENCE REFERENCE SET. The function of box 1211 is repeated 6 times so that the watch goes all of the way out of the set mode. In a box 1215, output number 40 goes to port number 1, which is to call real time from the reference watch and provide a display. In a box 1217 which calls a 180 millisecond delay five times, provision is made to allow the hour-minute display to go off and seconds to be displayed. In a box 1221 the number 01 is loaded into memory position KP1 followed by CALL READ REAL TIME a box 1223. The next operation is CALL OUTPUT 16 hz in a box 1225 in which the number of seconds pulses are determined and seconds are set. In a box 1227, now that the seconds have been set and the routine has been completed, a reset Q operation is performed so that SIG* is low to force the automatic shut down of the time setting circuits of the system and the removal of power from the interface chip. The next operation is set pass light (only) of a box 1229 and this completes the operation as the setting is continued and the watch may be removed from the time and message setting position.

Figures 37, 37A:
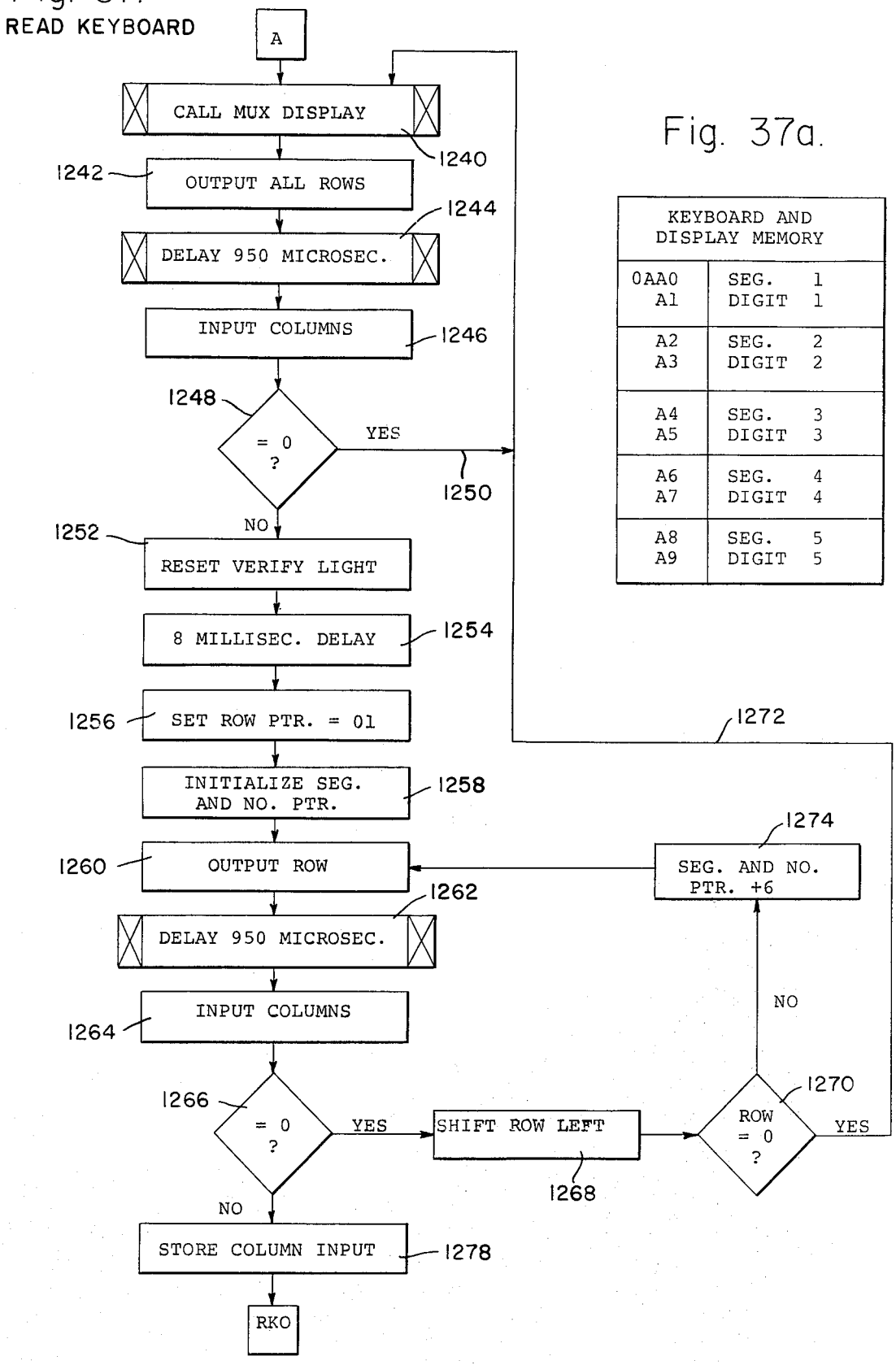
FIGS. 37 and 38 are flow diagrams for READ KEYBOARD and store if key is pressed.
FIG. 37*a* is a table showing the keyboard and display memory.
Figure 38:
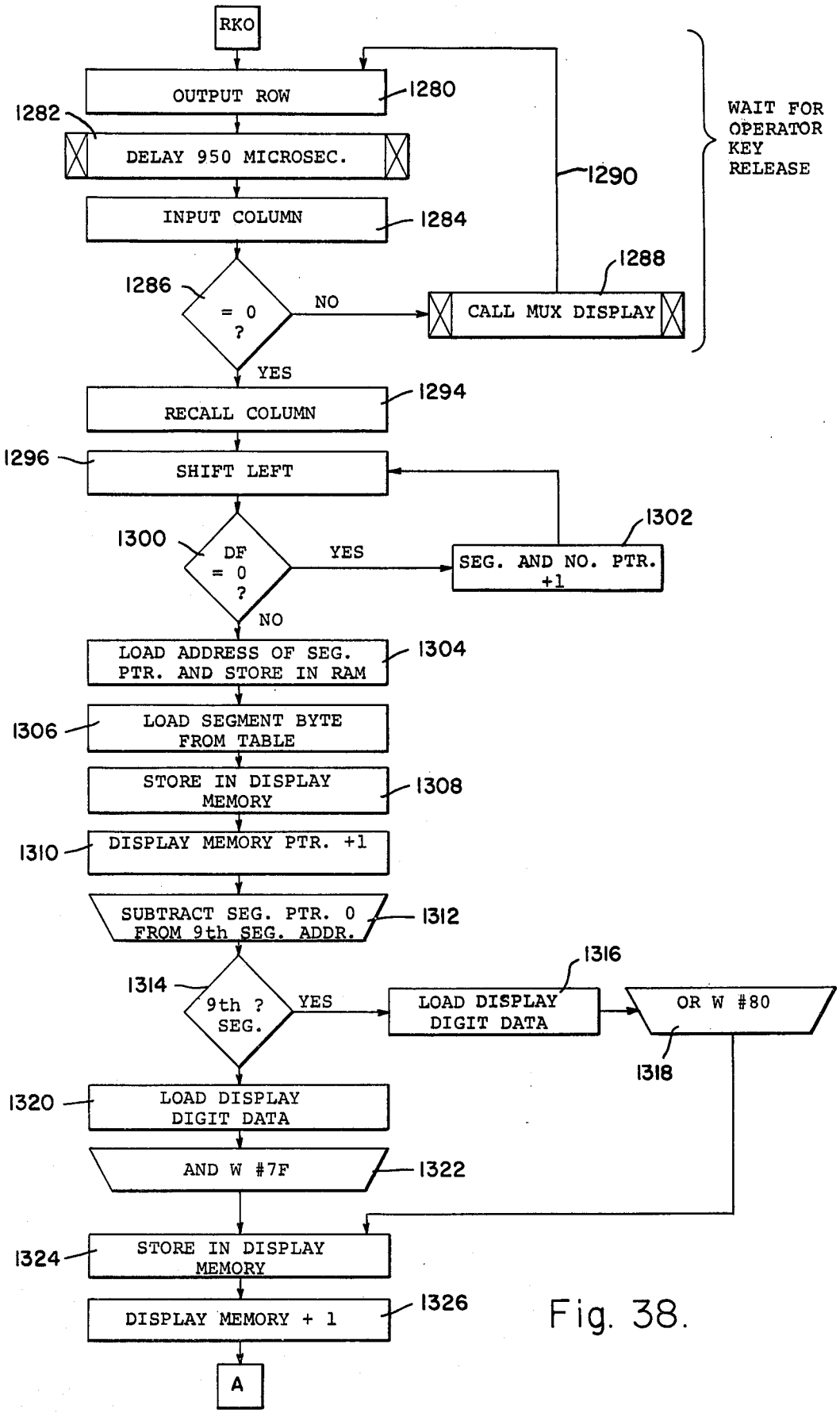

Referring now to FIGS. 37, 37*a* and 38, the READ KEYBOARD subroutine which also stores its key press will be explained in further detail. In a box 1240, following the A circle of FIG. 33, the CALL MUX DISPLAY subroutine is performed for a first pass and all rows of the keyboard are outputted in a box 1242. In a subroutine of a box 1244, DELAY 950 MICROSECONDS, a delay is provided and the input from the columns is read in a box 1246. In a box 1248, a decision is made if the columns are equal to 0, and if the columns are equal to 0, that is, a key is not pressed, a path 1250 is followed for repetition of the subroutine. If a key is pressed, the operation proceeds to a box 1252 which is reset verify light. An 8 millisecond delay is provided in a box 1254 followed by a set row pointer to 01 in a box 1256, in turn followed by initialize segment and number pointer in a box 1258 which is initializing the address in a register of Look-Up Tables I and II to their starting or initial points.

The Table I which is the segment Look-Up Table and the Table II which is the number Look-Up Table are permanent Tables showing the look-up address, sequence number in the hexidecimal system and output character designated. A pointer which is a counter holding a table address is provided for each Look-Up Table.

TABLE I

| | Seq. Mem. Address | Hexidec. Seq. Number | | Character | |
|---|---|---|---|---|---|
| | | | | (FIG. 37) SEGMENT LOOK-UP TABLE | |
| TSLU: | 0005 | #80 | ... | -BLANK- | BEGIN TIME HERE |
| | 06 | #86 | ... | −1 | |
| | 07 | #DB | ... | −2 | |
| | 08 | #CF | ... | −3 | |
| | 09 | #00 | ... | BLANK | |
| INITIAL M out | 0A | #06 | ... | 1 | |
| | 0B | #5B | ... | 2 | |
| | 0C | #4F | .. | 3 | Row 1 |
| | 0D | #66 | .. | 4 | |
| | 0E | #6D | .. | 5 | |
| | 0F | #7D | .. | 6 | |
| Row 2 | 10 | #48 | .. | — | |
| | 011 | #40 | .. | — | |
| | 12 | #3F | .. | 0 | Row 2 |
| | 13 | #6F | .. | 9 | |
| | 14 | #7F | .. | 8 | |
| | 15 | #07 | .. | 7 | |
| | 16 | #00 | .. | SPARE | |
| | 17 | #73 | .. | P | |
| | 18 | #3F | .. | O | |
| | 19 | #3E | .. | U | |
| | 1A | #E2 | .. | Y | |
| | 1B | #F3 | .. | R | |
| | 1C | #71 | .. | F | |
| | 1D | #6D | .. | S | |
| | 1E | #77 | .. | A | |
| | 1F | #BF | .. | Q | |
| | 20 | #BE | .. | W | |
| | 21 | #79 | .. | E | |
| | 22 | #3D | .. | G | |
| | 23 | #76 | .. | H | |
| | 24 | #1E | .. | J | |
| | 25 | #38 | .. | L | |
| | 26 | #53 | .. | ? | |
| | 0027 | #20 | .. | ! | |
| | | | | SEGMENTS (FIG. 38) | |
| | 0028 | #00 | .. | SPARE | |
| | 29 | #80 | .. | BLANK SPACE | |
| | 2A | #5B | .. | Z | |
| | 2B | #39 | .. | C | |
| | 2C | #A2 | .. | V | |
| | 2D | #37 | .. | N | |
| | 2E | #37 | .. | M | These Characters Have 9 Segments |
| | 2F | #C0 | .. | T | |
| | 30 | #74 | .. | K | |
| | 31 | #8F | .. | D | |
| | 32 | #81 | .. | T | |
| | 33 | #89 | .. | I | |
| | 34 | #CF | .. | B | |
| | 0035 | #E4 | .. | X | END OF SEG. TABLE |

TABLE II

| | NUMBER LOOK-UP TABLE | | | | |
|---|---|---|---|---|---|
| | Look-Up Memory Add | Hexidec Seq. No. | | Character | |
| INITIAL | 0050 | #21 | .. | 1 | |
| MNLU | 51 | #22 | .. | 2 | |
| | 52 | #23 | .. | 3 | Row 1 |
| | 53 | #24 | .. | 4 | |
| | 54 | #25 | .. | 5 | |
| | 55 | #26 | .. | 6 | |
| Increment | 56 | #2D | .. | = | |
| By 6 | 0057 | 2C | | — | Row 2 |
| | 58 | 20 | | 0 | |
| | 59 | 29 | | 9 | |
| | 5A | 28 | | 8 | |
| | 5B | 27 | | 7 | |
| | 5C | 00 | | NOT USED | |
| | 5D | 11 | | P | |
| | 5E | 10 | | O | |
| | 5F | 18 | | U | |
| | 60 | 1C | | Y | |
| | 61 | 13 | | R | |
| | 62 | 05 | .. | F | |
| | 63 | 16 | | S | |
| | 64 | 00 | | A | |
| | 65 | 12 | | Q | |
| | 66 | 1A | | W | |
| | 67 | 04 | | E | |
| | 68 | 06 | | G | |
| | 69 | 07 | | H | |
| | 6A | 0B | | J | |
| | 6B | 0D | | L | |
| | 6C | 2F | | . | |
| | 6D | 2E | | . | |
| | 6E | 00 | | NOT USED | |
| | 6F | 09 | | BLANK SPACE | |
| | 7C | 1D | | Z | |
| | 71 | 02 | | C | |
| | 72 | #19 | | V | |
| | 73 | 0F | .. | N | |
| | 0074 | #0E | .. | M | |
| | 75 | 2B | | T | |
| | 76 | 0C | | K | |
| | 77 | 03 | | D | |
| | 78 | 17 | | T | These Characters Have a 9th Seg. |
| | 79 | 08 | | I | |
| | 7A | 01 | | B | |
| | 7B | 1B | .. | X | END OF MESS. NUMBERS |

In the box 1258, the pointer is then pointing to the first character in the first row as seen in FIG. 37*a*. In a box 1260, the row 01 is outputted to the keyboard row port followed by the subroutine DELAY 950 MICROSECONDS in a box 1262. The processor samples the inputs from the columns in a box 1264 and determines if the columns areall equal to 0 in a box 1266. If a key is not pressed in that row then the row counter shifts over one in a box 1268 which is entitled Shift Row Left, the decision in a box 1270 being then made if this is the last row. If the decision is yes in box 1270, then all rows have been checked without detecting a row and the routine proceeds along the path 1272 waiting for a key press. If all rows have not been gone through (NO), the routine goes to a box 1274 where the segment and number pointer are incremented by +6 to seq. memory address 10 of the Table I. The routine then goes to the box 1260 and takes the output to the processor from the next row of the keyboard. This operation is repeated until a column output is detected in the box 1266 (Col. is not=to 0). If in the box 1266 it is found that a key is pressed in that row (a no condition), the routine passes through to store a column input in a box 1278. It is to be noted that we have now stored information for the entire number of columns and a specific row, so the row has now been determined. It is to be noted that when the columns are read in the box 1264, all columns are read at once from a particular row.

Referring now principally to FIG. 38 and boxes 1280, 1282, 1284, 1286 and 1288, the system waits for the operator to release the key by passing through the output row box 1280, the 950 MICROSECOND DELAY box 1282, the input column 1284 and into the decision box 1286. If the key release has not been performed by the operator, that is the key is still pressed, a CALL MUX DISPLAY routine of the box 1288 passes the operation through a path 1290 into the output row function of box 1280 and the operation remains in this closed loop. When the key is released as determined by the decision box 1286, the routine proceeds to recall column information in a box 1294 and a determination will now be made as to which character locations a one will be found. In a shift left box 1296, the column is shifted one column to the left and a decision box 1300 determines if there is an overflow(in the Processor Accumulator register) in that column and if the decision is yes, the operation in a box 1302 increments the segment and number pointer by 1 and the routine returns to shift left box 1296. If the decision is no, that is, the data flag=1, then the Table pointers now point to the key that was pressed. A store number in RAM memory is performed in a box 1304.

If for an illustrative example in segment Table I the – (minus) character key is pressed, $0011_{16}$ is stored during the function of box 1304. In boxes 1306 and 1308, the segment information or byte from Table I (which is HEX $\#40_{16}$) is stored as segment 1 for digit 1 in the keyboard and display memory of FIG. 37*a*. In a box 1310, the keyboard and display memory pointer is incremented by one and it now points to address A1 which is the digit information for the first character. In a box 1312, the processor subtracts the segment pointer address $0011_{16}$ from the first character of the ninth segment field or $002E_{16}$. If a negative answer is derived, then there is a ninth segment and in a decision box 1314, the answer is YES.

In boxes 1316 and 1318, the digit 1 information from the Keyboard and Display memory is loaded into the accumulator register and it is logically ORed with the number 80 to light the ninth seg. (seg. H) with digit information (FIG. 28 display 24). The following example illustrates the step of box 1318.

| | |
|---|---|
| Digit 1 - | 0000 0001 |
| 80 - | 1000 0000 |
| Result | 1000 0001 |

The digit 1 and the ninth segment are now stored in the keyboard and display memory at location A1 during the function of a box 1324.

The output of the box 1314 goes to a box 1320 when there is not a ninth segment, where the digit 1 information from the keyboard and display memory is loaded into the accumulator register. In a box 1322 the ninth segment information is removed and in the box 1324 the digit 1 information is stored in address A1 of the keyboard and display memory. The following is an example of the ANDing operation in box 1322 for an 8 segment word. This logic AND operation insures D7=0 which is the 9th seg. character.

| D7 | D0 | |
|---|---|---|
| 1000 | 0001 | digit 1 |
| 0111 | 1111 | $\#7F_{16}$ |
| 000 | 00001 | |

Figure 33:
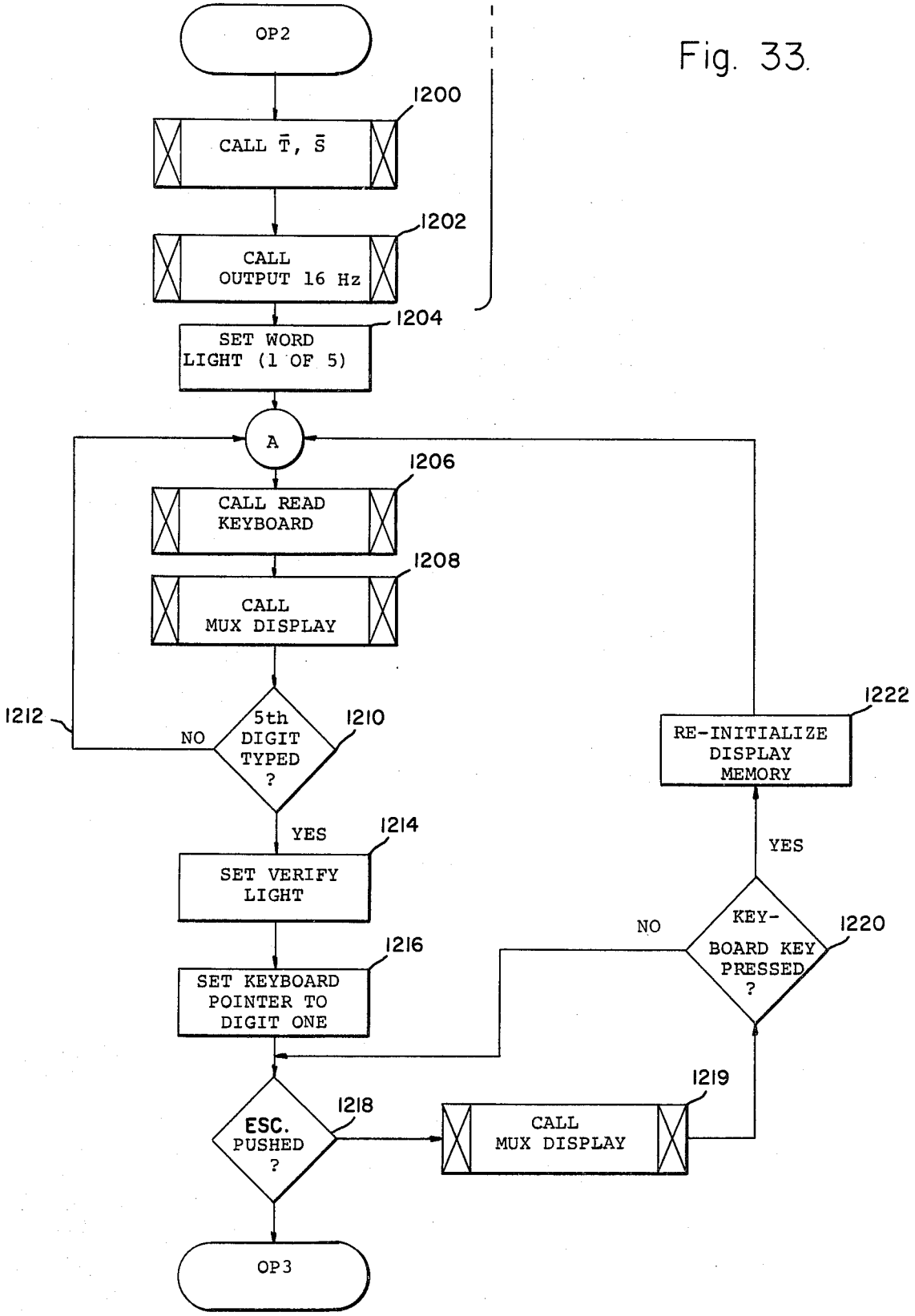
Figure 34:
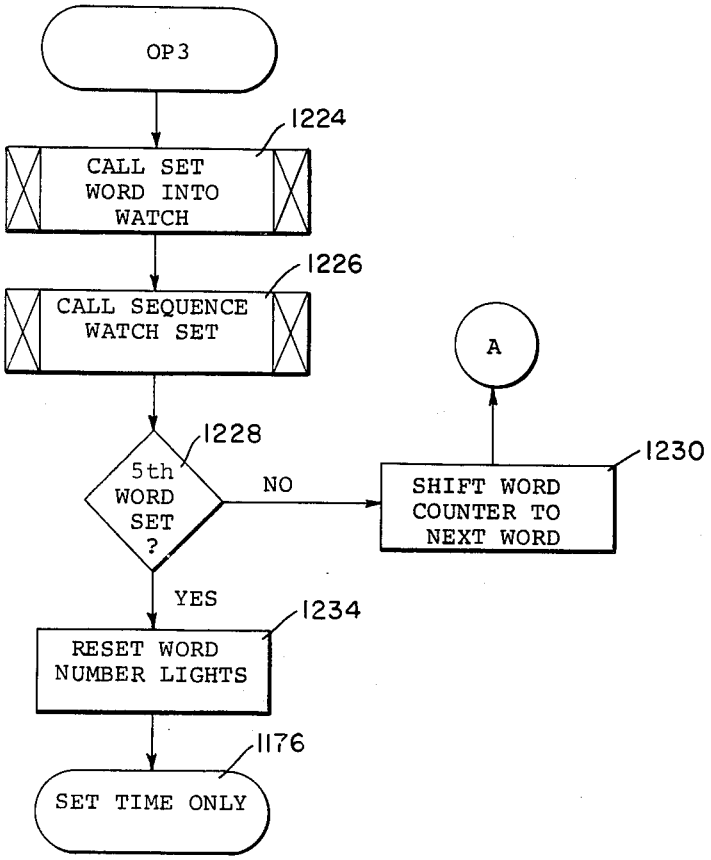

In a box 1326, the keyboard and display memory pointer is incremented by 1 to point to A2 and the operation returns to FIG. 33 and to CALL MUX DISPLAY.

Figure 39:
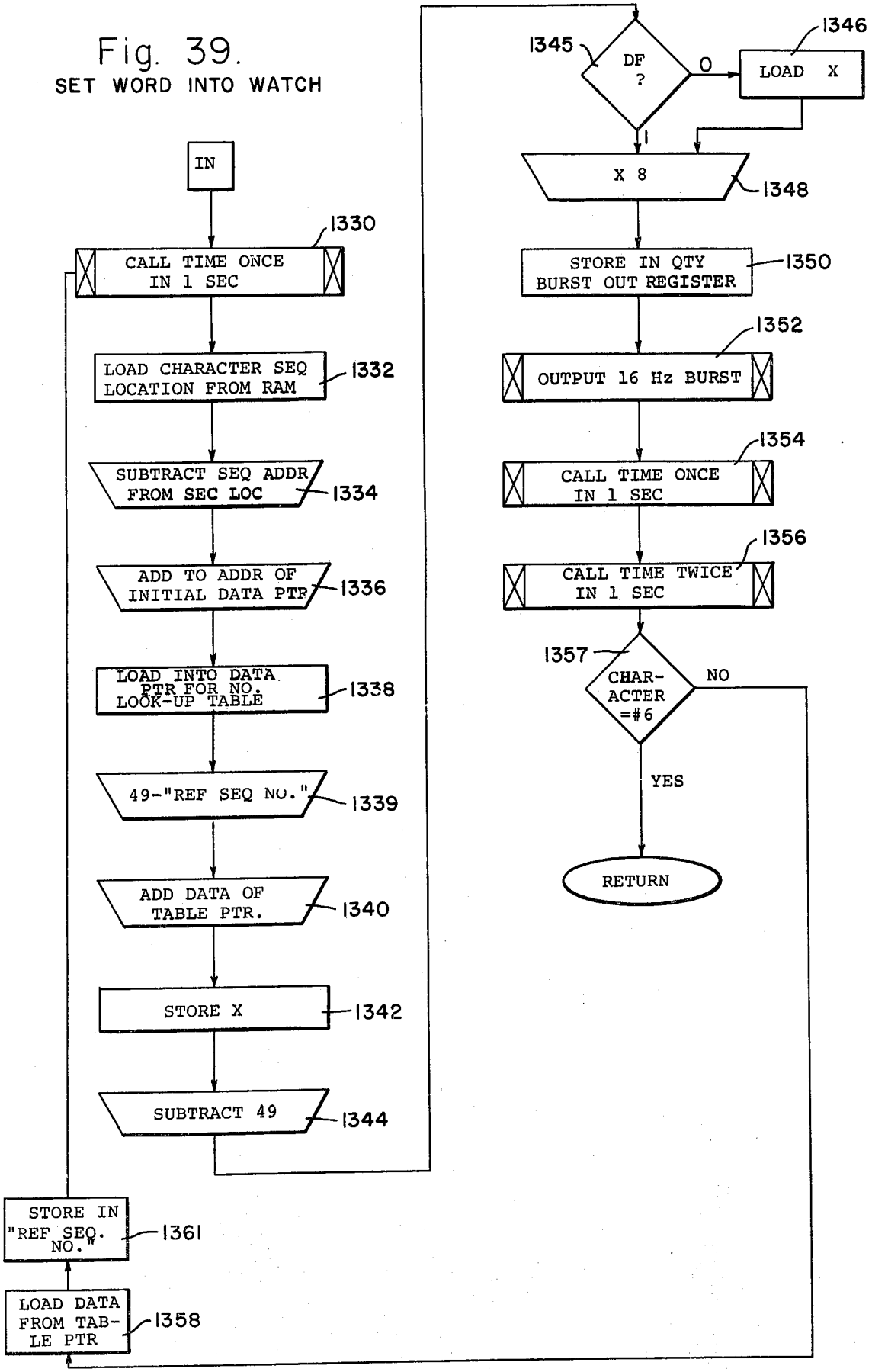
FIG. 39 is a flow diagram for SET WORD INTO WATCH.

Referring now to SET WORD INTO WATCH in FIG. 39, the computation of the number of memory pulses for writing in the desired word will be explained. In a box 1330 slewing is started by CALL TIME ONCE IN ONE SECOND. In a box 1332, the stored address of the segment location that was stored in the RAM during performance of box 1304 (FIG. 38) is recalled.

Referring now back to the segment Look-Up Table I, the initial memory location will be subtracted from the just recalled memory location in a box 1334 to provide the number of locations that the character is from the initial sequence number. In a box 1336 that calculated number of steps is added to the initial memory address to define a new memory address (or pointer) in Number Look-Up Table II, which is stored in a processor register PTR during the performance of box 1338. In a box 1339, the sequence number of the character from the Number Look-Up Table of the previously set character is subtracted from 49 (which is the total number of characters in the Table). In a box 1340, the sequence number of the present character as obtained in the box 1332 is added to the results of box 1339 and the value of this sum is stored in a memory location X in the scratch pad memory in a box 1342. The number 49 is subtracted from the sum or value in location X in a box 1344. In a box 1345, if the result is negative, the memory location X is loaded in a box 1346 and used in a box 1348. If the result of box 1345 is positive, then the result from the box 1344 is utilized rather than the value in memory location X.

In a box 1348, the chosen number is multiplied by 8 and stored in a QTY register (R3) in a box 1350. The CALL OUTPUT 16 hz burst subroutine occurs in a box 1352 and in a box 1354 the slewing is stopped CALL TIME ONCE IN ONE SECOND. In a box 1356, which is CALL TIME TWICE IN ONE SECOND the watch setting controls are moved to the next character. A box 1358 causes the sequence number of the character just set to be loaded into a register from Table PTR. In a box 1361, the loaded reference sequence number is stored in the scratch pad memory. When a box 1357 indicates all 5 characters have been set, the operation returns to the main routine. The following are examples of the calculation of FIG. 39 for the two characters HA:

| | | | |
|---|---|---|---|
| | First Character H | | |
| | 49 | | |
| | 0 | (A) | (1339) |
| | 49 | | |
| New No. | 07 | (H) | (1340) |
| to be Set | 56 | X | |
| | −49 | | (1344) |
| | 7 | | |
| | DF = 1 | | (1345) |
| | X8 | | |
| | $56_{10}$ or $38_{16}$ pulses | | (1348) |
| | Second Character A | | |
| | 49 | | |
| | −7 | (A) | (1339) |
| | 42 | | |
| New No. | 0 | (H) | (1340) |
| to be Set | 42 | X | (1342) |
| | −49 | | (1344) |
| | XX | | |
| | DF = 0 | | |
| | 42 | | |
| | X8 | | (1348) |

-continued

| |
|---|
| $336_{10}$ or $0150_{16}$ pulses |

The following Tables III and IV shows the segment and number look-up that may be stored in the memory when utilized for transferring the time set into the watch module.

TABLE III

SEGMENT LOOK-UP TABLE

| | Program Memory Address | HEX | Character | |
|---|---|---|---|---|
| INITIAL TSLU | 0005 | #80 | −BLANK | BEGIN TIME HERE |
| | 06 | #86 | −1 | |
| | 07 | #DB | −2 | |
| | 08 | #CF | −3 | |
| | 09 | #00 | BLANK | |
| | 0A | #06 | 1 | |
| | 0B | #5B | 2 | |
| | 0C | #4F | 3 | |
| | 0D | #66 | 4 | |
| | 0E | #6D | 5 | |
| | 0F | #7D | 6 | |
| | 10 | #48 | = | |
| | 11 | #40 | − | |
| | 12 | #3F | 0 | |
| | 13 | #6F | 9 | |
| | 14 | #7F | 8 | |
| | 15 | #07 | 7 | |
| | 16 | #00 | SPARE | |
| | 17 | #73 | P | |
| | 18 | #3F | O | |
| | 19 | #3E | U | |
| | 1A | #E2 | Y | |
| | 1B | #F3 | R | |
| | 1C | #71 | F | |
| | 1D | #6D | S | |
| | 1E | #77 | A | END OF TIME SEQ. |

TABLE IV

NUMBER LOOK-UP TABLE

| | Program Memory Address | HEX | Character | |
|---|---|---|---|---|
| INITIAL TNLU | 0050 | #00 | −BLANK | BEGIN TIME HERE |
| | 51 | #01 | −1 | |
| | 52 | #02 | −2 | |
| | 53 | #03 | −3 | |
| | 54 | #00 | BLANK | |
| | 55 | #01 | 1 | |
| | 56 | #02 | 2 | |
| | 57 | #03 | 3 | |
| | 58 | #04 | 4 | |
| | 59 | #05 | 5 | |
| | 5A | #06 | 6 | |
| | 5B | #00 | NOT USED | |
| | 5C | #00 | NOT USED | |
| | 5D | #00 | 0 | |
| | 5E | #09 | 9 | |
| | 5F | #08 | 8 | |
| | 60 | #07 | 7 | |
| | 61 | #00 | NOT USED | |
| | 62 | #0C | P | |
| | 63 | #00 | | |
| | 64 | #00 | | |
| | 65 | #00 | | |
| | 66 | #00 | | |
| | 67 | #00 | | |
| | 68 | #00 | | |

TABLE IV-continued

NUMBER LOOK-UP TABLE

| | Program Memory Address | HEX | Character | |
|---|---|---|---|---|
| | 69 | #00 | A | END OF TIME NUMBERS |

Figures 40, 40A:
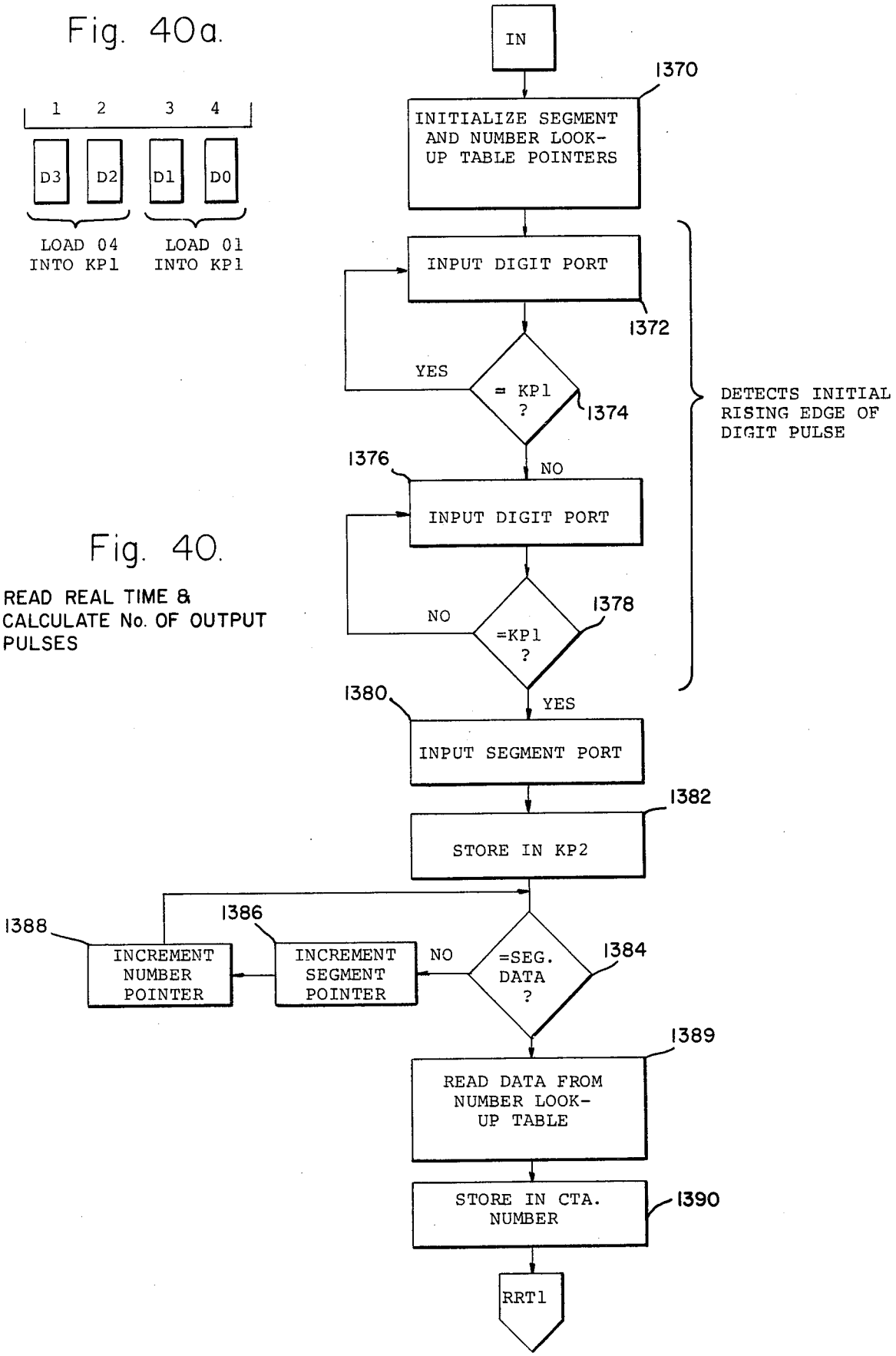
FIGS. 40 through 42 are flow diagrams of READ REAL TIME AND CALCULATE NUMBER OF OUTPUT PULSES.
FIG. 40*a* is a diagram showing the segment data for further explaining the flow diagrams of FIGS. 40 through 42.
Figure 41:
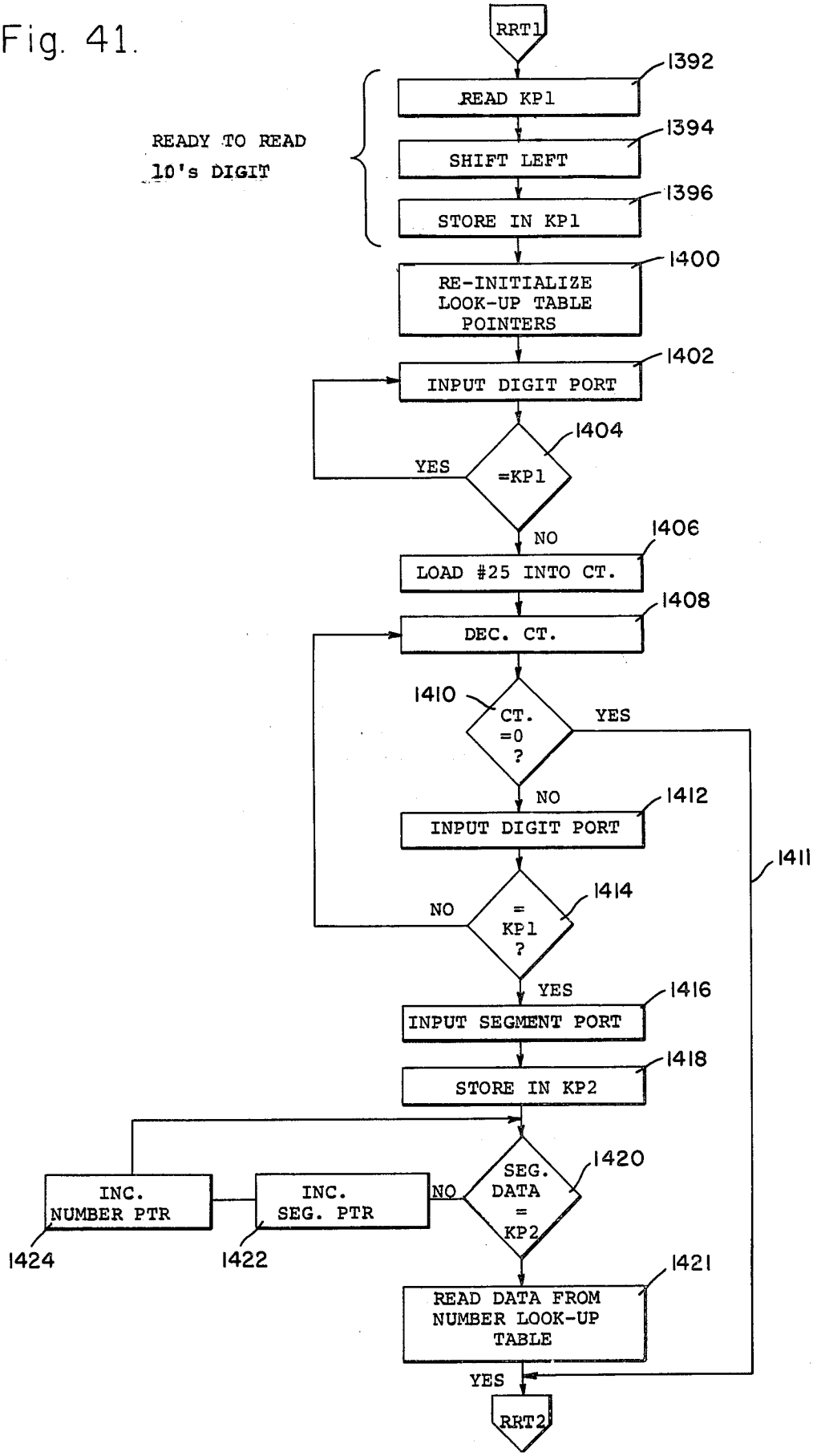

Referring now to FIGS. 40, 40*a* and 41, the subroutine READ REAL TIME (AND CALCULATE THE NUMBER OF OUTPUT PULSES) will be explained. As may be recalled, SET TIME ONLY has two input paths from the main program. The SET TIME ONLY routine was explained relative to FIGS. 35 and 36. As can be seen in FIG. 35 in box 1185, 04 is loaded into KPI followed by READ REAL TIME in box 1187 (for setting the Month). KPI is a register in the processor and 04 is loaded to define D3 and D2 shown in FIG. 40*a* which are the first two digits on the watch display. For reading the real time from the reference watch, a first box 1370 initializes the segment and number Look-Up Table pointers to each point to the initial location of respective Tables III and IV. The second box 1372 reads the input digit port of the reference watch and in a box 1374, a decision is made whether the input digit port is equal to KPI.

It is necessary to detect the rising edge of the pulse such as D2 to determine that it is time to obtain the segment information. In boxes 1372 and 1374, the processor checks and waits for the 04 digit location to have its contents become equal to 0. The procedure then goes from box 1374 to boxes 1376 and 1378 and waits for D2 to appear and become 1 (determines rising edge). If the input data is equal to KP1 in a box 1378 (yes), the routine proceeds to an input segment port 1380 and the processor reads the segment bits (8 bits) from IP2 and they are stored in KP2 in a box 1382. In the next operation, a box 1384 determines if the stored D2 segment data is equal to the segment data in Look-Up Table III and if it is not equal, the segment pointers as well as the Number Pointers (counters) are both incremented by one in boxes 1386 and a box 1388 and the decision in box 1384 is repeated until a location or sequence number is found in Table III. If the segment bits are equal to the Table segment data, the operation continues to a box 1389 which reads the data from the number Look-Up Table and stores it in a box 1390 in a location CTA of the processor memory. In boxes 1392, 1394 and 1396 reading, shifting and storing are performed so that the processor is ready to read the TEN's digit from the memory.

The contents of 04 are read in the box 1392 from KP1 and shifted left to 08 in box 1394 so as to define 10's digit D3 for reading that digit. In the box 1396, 08 is stored in KP1. Reinitialization in a box 1400 places the look-up pointers (counters) back to the beginning of Tables III and IV and detects the leading edge of the digit pulse D3 in boxes 1402 and 1404.

The process in boxes 1406, 1408 and 1410 for determining the leading edge is similar to that previously described except that an escape exit along path 1411 is provided if no digit strobe occurs at D3. In the box 1406, the value $25_{16}$ is loaded into CT (a counting register) and decremented in the box 1408 to provide 25 chances for a digit strobe to occur, and if none occurs the routine passes along the escape path 1411.

Assuming a No output from the box 1410 (a digit is detected), and if it is not equal to 08 as read in box 1412 a try is again performed as determined in a box 1414. If in the box 1414, a digit is found in D3, IP2 is read in box 1416 and the data is stored in a box 1418 in the KP2 location.

The value of KP2 is compared in a box 1420 with the data in the Segment Look-Up Table III and if not equal, the segment and number pointers are incremented in boxes 1422 and 1424. When KP2 equals the value indicated by the pointer, the data is read from the Number Look-Up Table IV in a box 1421. In a box 1426, this data is multiplied by 10 as it is the D3 (10's) digit position. In a box 1428, the result is added to 2 which is the unit digit that was previously stored (the total number is 12). In a box 1430, the number 12 is multiplied by 8 to provide the correct number of bursts (½ second of real time=8 pulses). The number of burst pulses is then stored in the QTY register in a box 1432 and the subroutine returns to the program that called it. The watch sets at a ½ hz rate. Therefore, 8 times the periods or pulses applied to the watch 16 hz drive point equals one count or clock advance.

Figure 43:
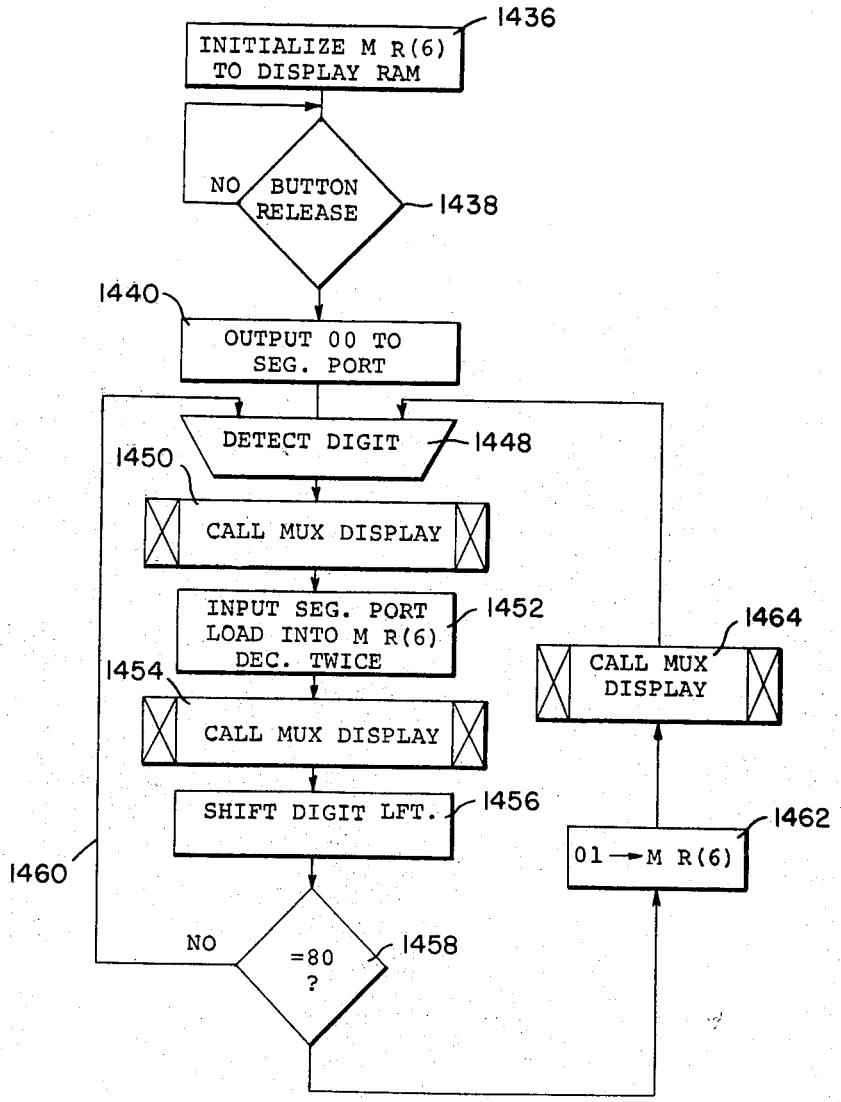
FIG. 43 is a flow diagram for READ AND DISPLAY REAL TIME CLOCK.

Referring now to FIG. 43 which is the subroutine READ AND STORE REAL TIME CLOCK, this subroutine will be explained which is part of the initialization or set-up mode normally utilized only once when the power is being supplied to the setting unit. In a box 1436, the display RAM is initialized and the ESC button is released in a box 1438 resulting in the zeros being loaded in the segment port (OPA) in a box 1440. This loading blanks the test box display when a digit is detected in a box 1448. The operation then proceeds to CALL MUX DISPLAY in a box 1450, followed by a box 1452 during which the segment input port (IP2) data is stored in display memory. The routine then proceeds to CALL MUX DISPLAY in a box 1454, shifts the digit to the left in a box 1456 and makes a decision in a box 1458 whether the number is 80, 80=D3, 01=D0, O2=D1 and O4=D2 of FIG. 40A. If it is not 80, then a path 1460 is followed and if it is 80, the routine loads 01 into memory location M R6 in a box 1462, goes through the CALL MUX DISPLAY routine of a box 1464 and then returns to a detect digit function of a box 1448. Thus, the M R6 location continually is updated with real time display data. This operation will continue until the reset button is pushed.

Figure 44:
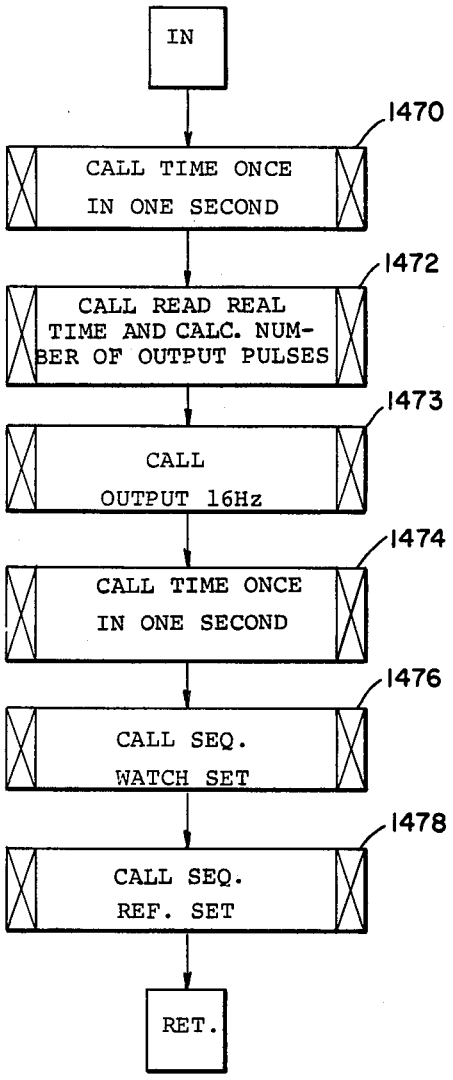
FIG. 44 is a flow diagram for READ REAL TIME AND SET WATCH.

Referring now to FIG. 44, which is the READ REAL TIME AND SET WATCH subroutine, the operation starts in a box 1470, which is CALL TIME ONCE IN ONE SECOND and the system is ready to slew for setting the month. In a box 1472, CALL READ REAL TIME AND CALCULATE NUMBER OF OUTPUT PULSES is called and the correct number of data bursts is determined. In a box 1473, a CALL OUTPUT 16 HZ, for the slewing is performed and in a box 1474, the CALL TIME ONCE IN ONE SECOND subroutine stops the slewing. In a box 1476, the CALL SEQUENCE WATCH SET effectively pushes the set button and releases it to set the watch to receive the day of the Month. In a box 1478, the CALL REFERENCE SET pushes the set button and releases it to prepare the reference watch to provide the day of the month. Thus, the READ REAL TIME and SET WATCH subroutine is completed and the operation returns to box 1191 of FIG. 35 for setting the date. In the boxes 1195, 1179 and boxes 1207 and 1209 of FIG. 36, the hours, minutes and seconds are respectively set utilizing the CALL READ REAL TIME AND SET WATCH subroutine. It is to be noted that in FIG. 36, the seconds are reset in both boxes 1207 and 1209 to allow the illustrated watch to go out of the set mode to the seconds display.

Figure 45:
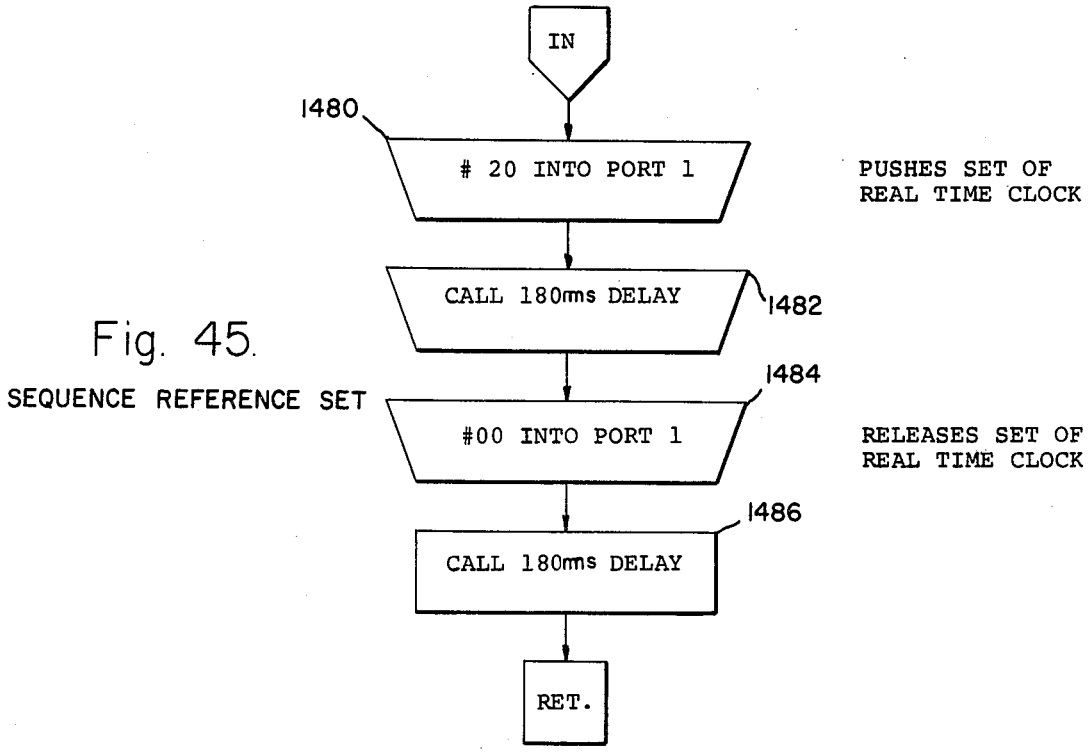
FIG. 45 is a flow diagram for SEQUENCE REFERENCE SET.
Figure 42:
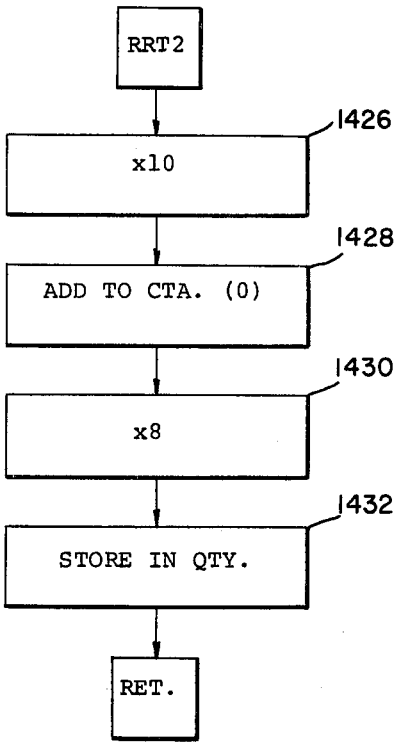

Referring now to the subroutine of FIG. 45 which is SEQUENCE REFERENCE SET, the subroutine starts in a box 1480 where the number 20 is transferred into port 1 (OP1) which is electronically pushing the set button of the real time clock by means of a code 00100000 which is decoded as 20 of respective digit numbers D7 to D0. In a box 1482, a subroutine CALL 180 MILLISECONDS DELAY is performed to let the real time clock recognize that the button is pushed and in a box 1484 in order to release the set button of the real time clock, the numbers 00 are applied to port one representing not time and not set. In a box 1486, a similar delay of CALL 180 MILLISECONDS DELAY is provided and the subroutine returns to the normal program.

Figure 46:
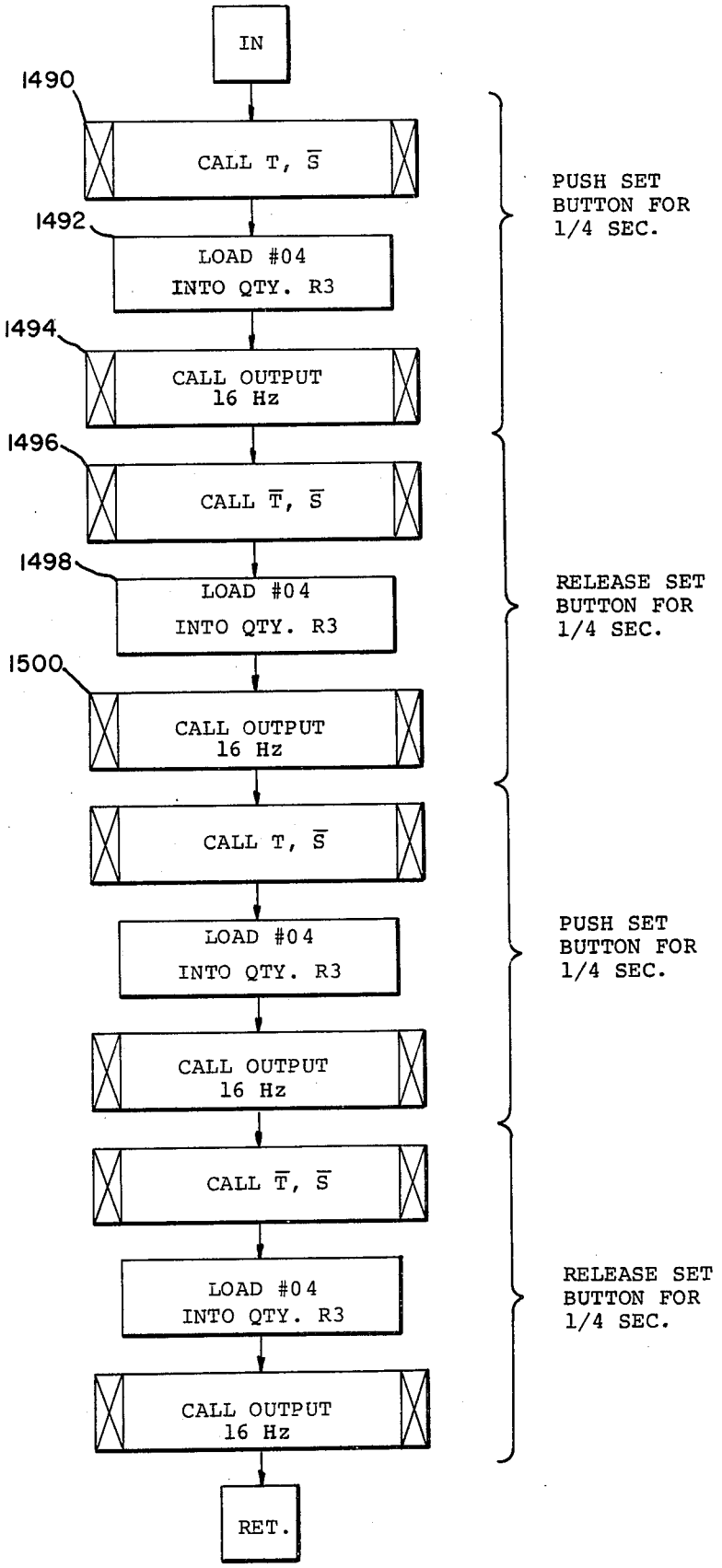
FIG. 46 is a flow diagram for CALL TIME TWICE IN ONE SECOND.

Referring now to FIG. 46 the CALL TIME TWICE IN ONE SECOND subroutine is used in the illustrated watch rather than the message button, for transferring between characters in the display memory. In a box 1490, the CALL T, S (time and not set) set routine is performed followed by loading number 04 in the memory location QTY R3 in a box 1492 and with the CALL OUTPUT 16 hz of pulses of a box 1494 so that the watch completes the push-set button for a quarter second. For releasing the set button for a quarter second, boxes 1496, 1498 and 1500 are utilized which are respectively CALL T, S, load the number 04 into the register R3 and CALL OUTPUT 16 hz. For calling the time the second time within one second, a similar number of boxes and subroutines are performed and the subroutine is then returned to the program which it is performing.

Figure 47:
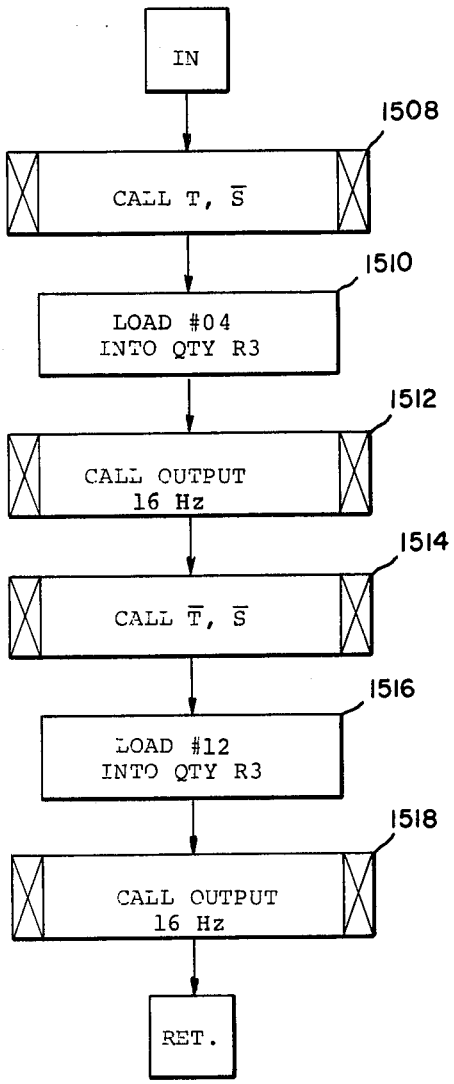
FIG. 47 is a flow diagram for CALL TIME ONCE IN ONE SECOND.

Referring now to FIG. 47 which shows a subroutine CALL TIME ONCE IN ONE SECOND which is utilized to initialize the first character of each word, a subroutine CALL T, $\overline{S}$ of a box 1508 is first performed. In a box 1510, the number 04 is loaded into the quantity R3, followed by a CALL OUTPUT 16 hz of four pulses shown by a box 1512. Thus, the data bursts occur during the time period of the box 1512 and a box 1514 which is CALL $\overline{T}$, $\overline{S}$ releases the time button. In a box 1516, the number 12 is loaded into the register QTY R3 followed by a CALL OUTPUT 16 hz subroutine of a box 1518 which is a data burst of twelve pulses to the watch under test so that it recognizes that the button has been released, in circuits such as in the debouncing circuits.

Figure 48:
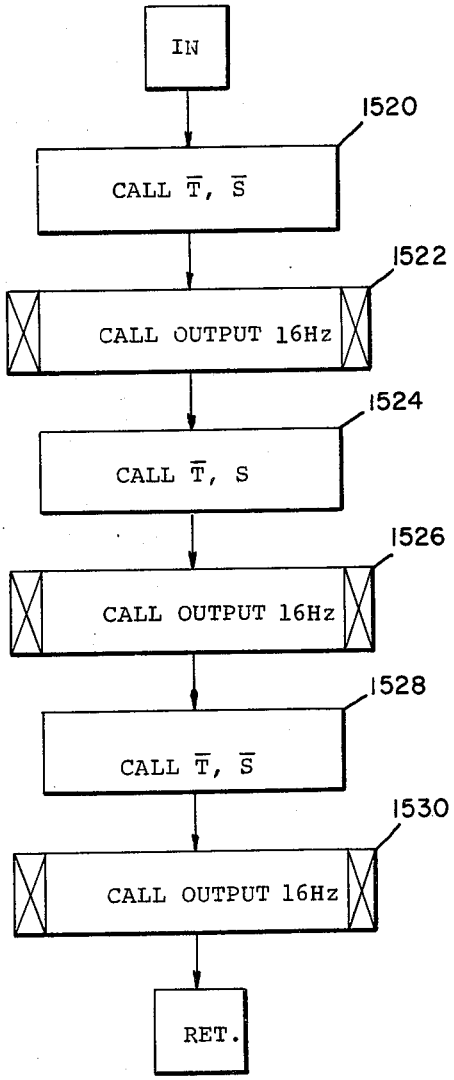
FIG. 48 is a flow diagram for SEQUENCE WATCH SET.

Referring now to FIG. 48 which is the SEQUENCE WATCH SET, for sequencing the watch to the next word, the watch under test has its set button pushed and then released ina box 1520 which is a subroutine CALL $\overline{T}$, $\overline{S}$ to make sure that no buttons are called before pushing time, with this subroutine followed by CALL OUTPUT 16 hz of a box 1522 which provides slewing of eight pulses. It is to be noted that when a 16 hz output is called and a calculation has not previously been made, eight output pulses are always provided to the watch under test. In a box 1524 CALL $\overline{T}$, S is performed, in a box 1526 a slewing of a CALL OUTPUT 16 hz is performed with eight pulses and in a box 1528 the subroutine CALL $\overline{T}$, $\overline{S}$ is performed to remove the set condition or to release the set signal. In a box 1530 the subroutine CALL OUTPUT 16 hz is performed and eight pulses are stored in a predetermined memory location for use in any subsequent sequences.

Figure 49:
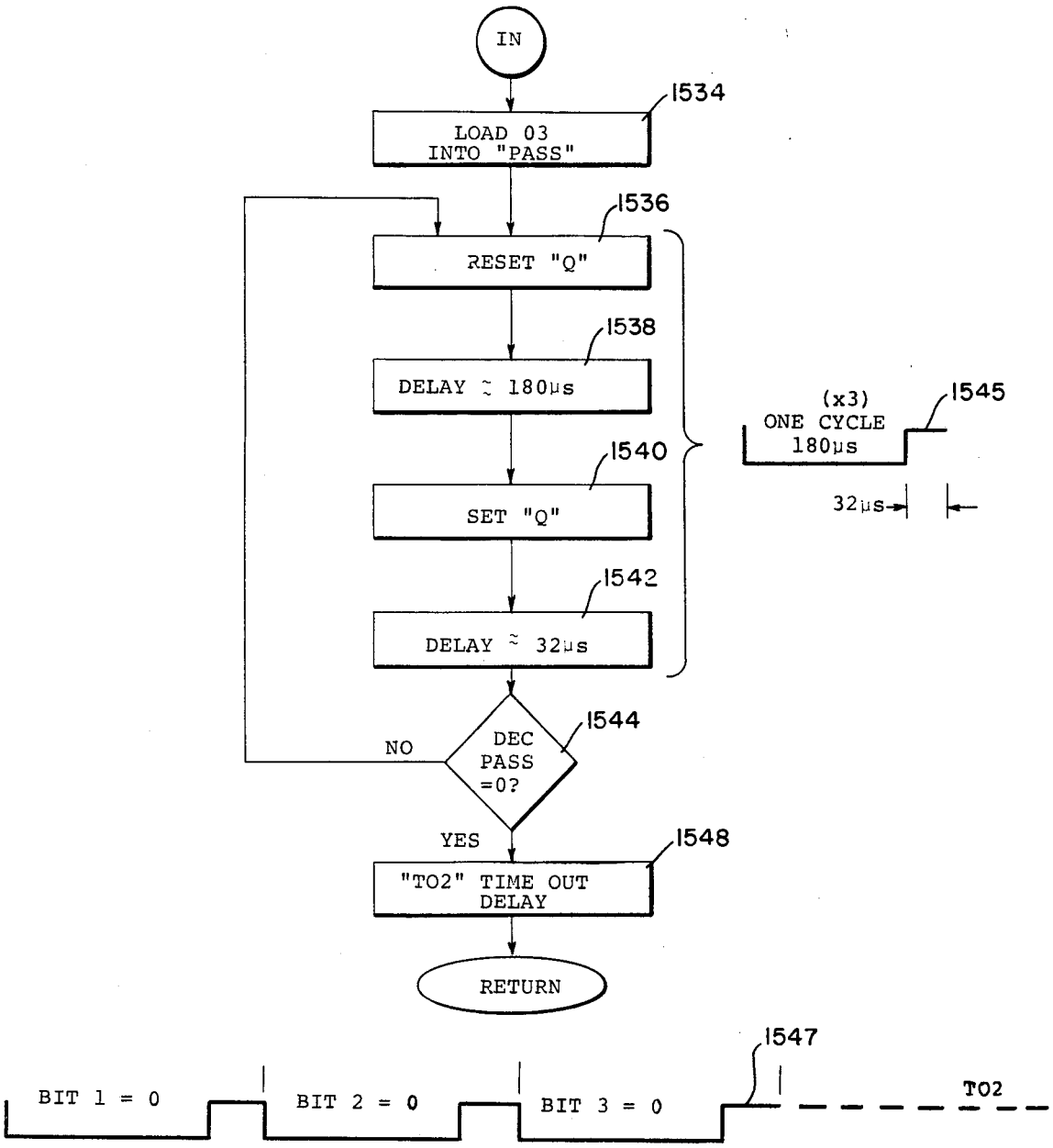
FIG. 49 is a flow diagram with illustrative waveforms for CALL T,S (TIME AND SET) SUBROUTINE.

Referring now to the reset subroutine of FIG. 49 which is CALL T, S (time and set) subroutine, the number 03 is loaded into a memory location "pass" in a box 1534 followed by Q being reset in a box 1536. In a box 1538, the DELAY 180 MICROSECONDS is performed, in a box 1540 Q is set, in a box 1542 a delay of 32 microseconds is performed and in a decision box 1544, the decision is made whether the pass contents is equal to 0. The boxes 1536, 1538, 1540 and 1542 generate the 180 microsecond and the 32 microsecond pulses of a waveform 1545. When the three bits have been generated equal to 000 as shown by a waveform 1547, the routine passes to a box 1548 which is T02 time out periodfor the processor and then proceeds to return to its normal routine. The three bit time modulated pulses of the waveform 1547 are the data bits that are transferred through the LED structure to the watch.

Figure 50:
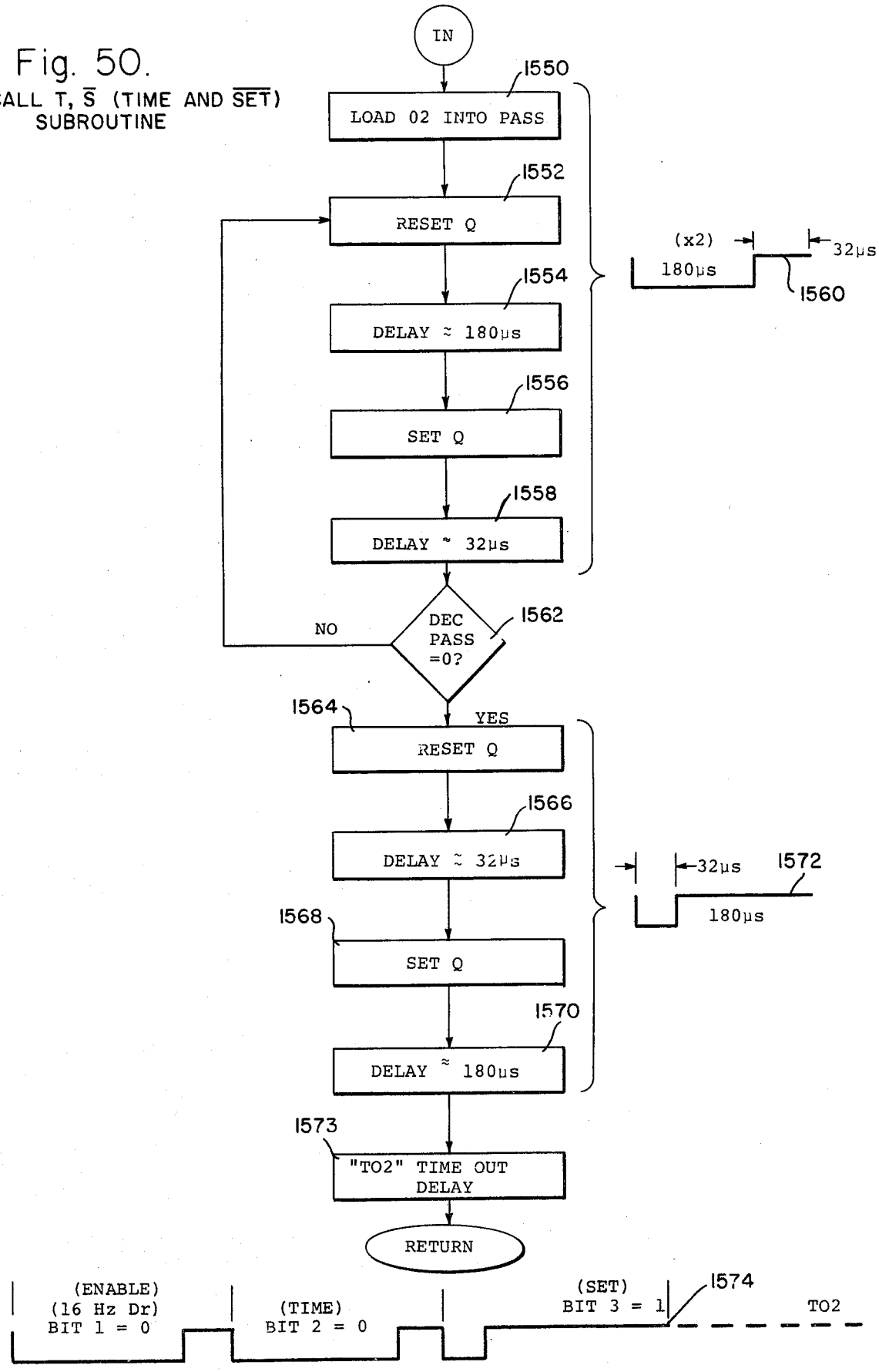
FIG. 50 is a flow diagram with illustrative waveforms for CALL T,$\overline{S}$ (TIME AND $\overline{SET}$) SUBROUTINE.

Referring to FIG. 50 which is the CALL T, $\overline{S}$ subroutine for starting and stopping slewing, the operation starts with loading the number 02 into the pass register in a box 1550 followed by the boxes 1552, 1554, 1556 and 1558 which generates a 180 microsecond delay followed by a 32 microsecond delay of the waveform 1560 representative of a 0 bit. The decision whether the pass register is equal to 0 in a box 1562 is then made and when the two 0 bits are formed, the routine transfers to boxes 1564, 1566, 1568 and 1570 which provide a 32 microsecond delay followed by a 180 microsecond delay of a waveform 1572 representing a binary 1. The last operation is a T02 time out delay subroutine of a box 1573 and the time and not set code of a waveform 1574 has been developed.

Figure 51:
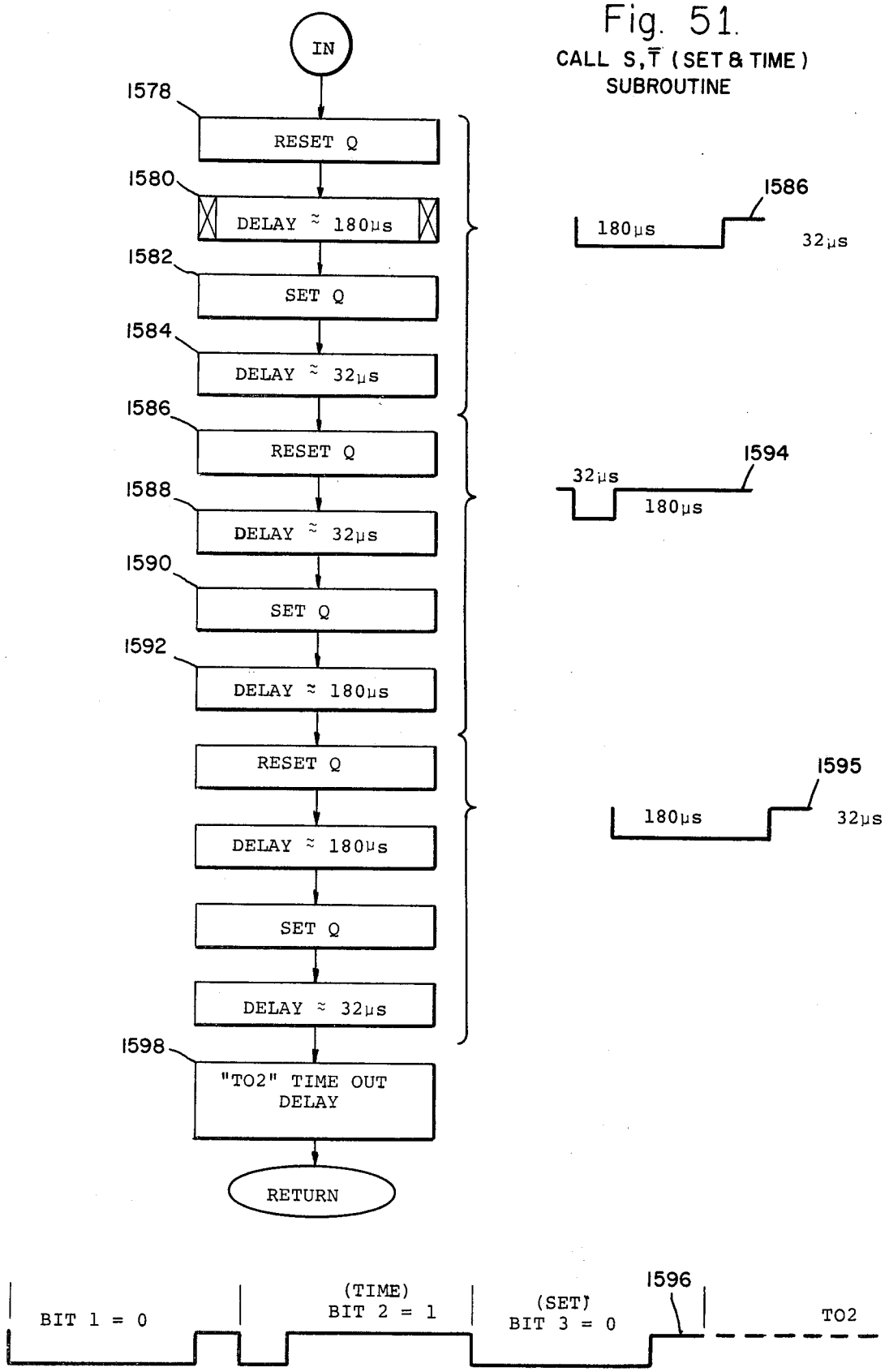
FIG. 51 is a flow diagram with illustrative waveforms for CALL S,$\overline{T}$ (SET AND $\overline{TIME}$) SUBROUTINE.

Referring now to FIG. 51 which is the CALL S, $\overline{T}$ (set and not time) subroutine, boxes 1578, 1580, 1582 and 1584 generate a 0 of a waveform 1586 followed by boxes 1586, 1588, 1590 and 1592 which generates a one condition of a waveform 1594 which in turn is followed by four boxes which generate a 0 bit condition of a waveform 1595. Thus, the result is a 010, as shown by a waveform 1596 followed by T02 subroutine of a box 1598.

Figure 52:
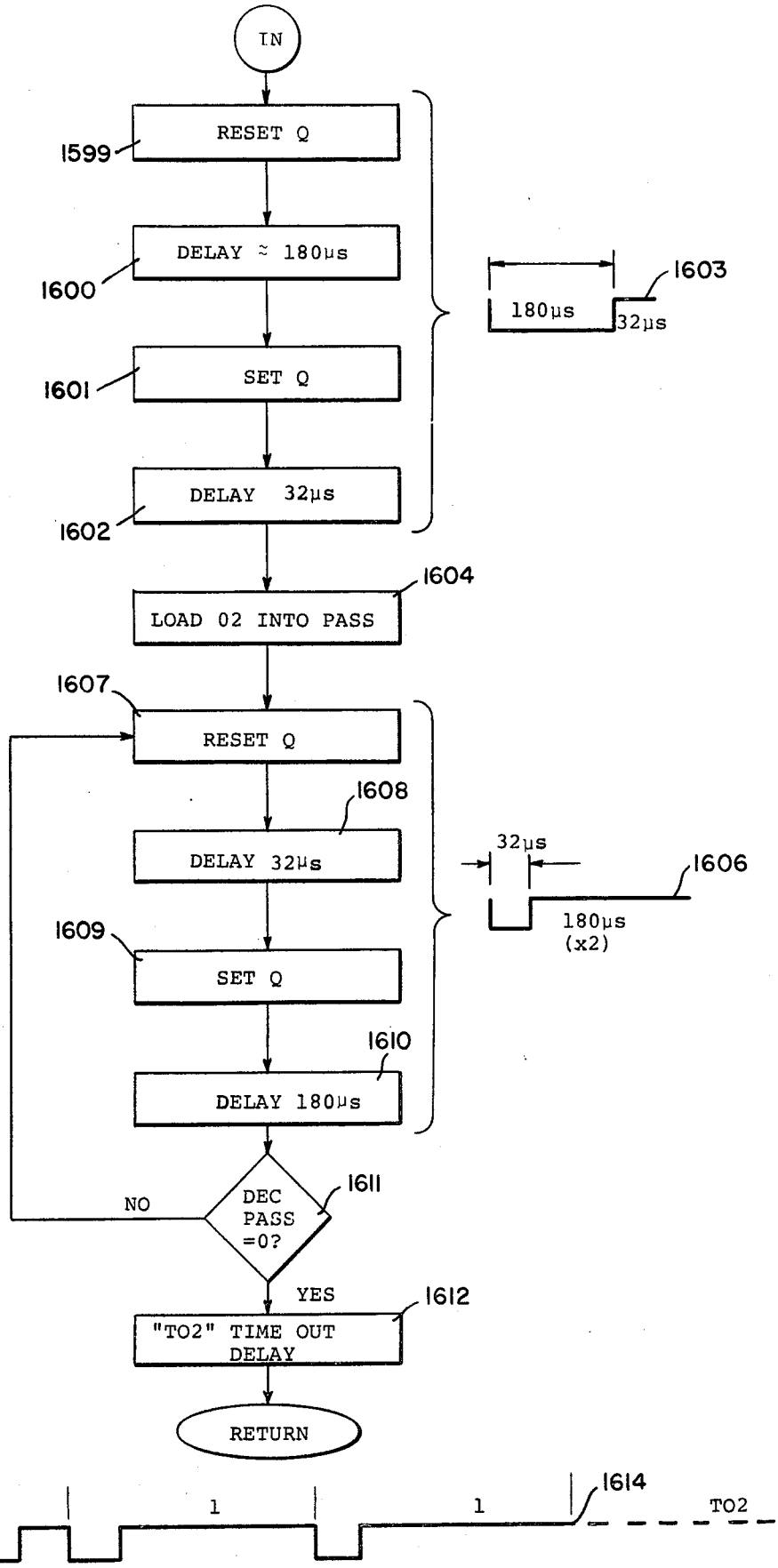
FIG. 52 is a flow diagram with illustrative waveforms for CALL $\overline{T}$,$\overline{S}$ ($\overline{TIME}$ AND $\overline{SET}$) SUBROUTINE.

Referring now to FIG. 52 the CALL $\overline{T}$, $\overline{S}$ (Not Time and Not Set) subroutine is shown which is utilized to make certain that no commands have been called. The routine of boxes 1599 to 1602 generates the 0 pulse condition of a waveform 1603 followed by loading 02 into the pass register or counter in a box 1604. The one pulse condition of a waveform 1606 is then generated by boxes 1607 to 1611 with the decision block 1611 allowing two bits to be generated followed by a T02 time out delay of box 1612 which is the DELAY 950 MICROSECONDS SUBROUTINE of FIG. 55. Thus, the 011 code of waveform 1614 is transferred to the watch by this subroutine.

Figure 53:
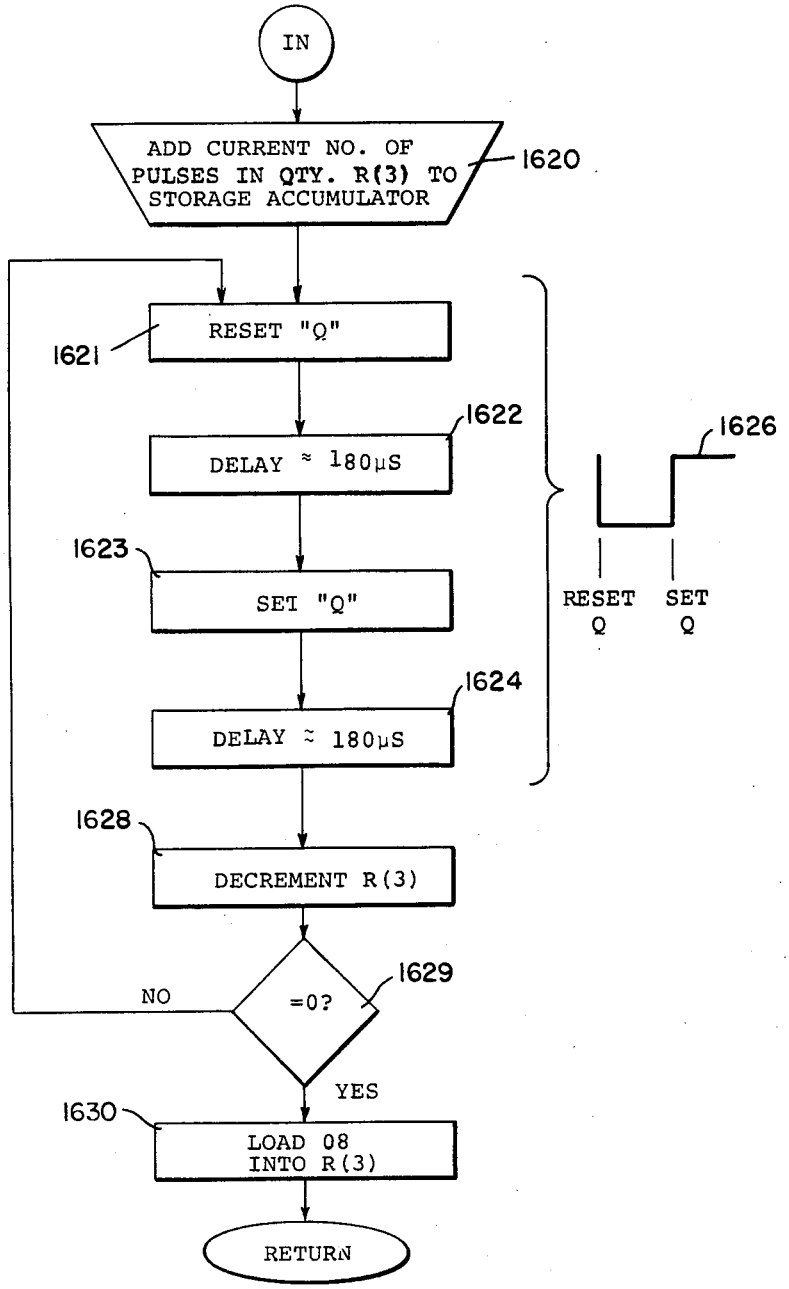
FIG. 53 is a schematic flow diagram with illustrative waveforms for OUTPUT 16 HZ SUBROUTINE.
Figure 53:
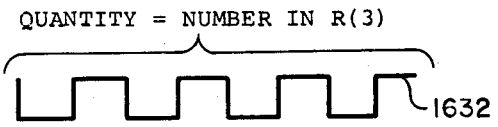

Referring now to FIG. 53 which is the OUTPUT 16 hz drive pulses subroutine, the operation starts in a box 1620 which is adding the current number of pulses in the QTY R(3) register to the accumulator which stores the total number of pulses. The routine then proceeds to reset Q of a box 1621, followed by a delay of 180 microseconds of a box 1622, followed by set Q of a box 1623 and a delay of a 180 microseconds of a box 1624 to generate the pulse condition of a waveform 1626. In a box 1628, the value of R(3) is decremented and in a decision box 1629, a determination is made whether QTY is 0 and if it is not, the routine is repeated to generate another pulse. If the value QTY is equal to 0, then the quantity 08 is loaded into R(3) in a box 1630 and the subroutine returns to the program. It is to be noted that the total quantity of pulses is equal to the number of pulses in R(3), as shown by waveform 1632.

Referring now to FIG. 54, a DELAY FOR 180 MILLISECONDS subroutine will be explained. In a box 1640, the number 1500 is loaded into a selected memory CT, is decremented in box 1642 and in a decision box 1644 if the result is not 0, it is again decremented in box 1642. When the box 1644 receives a 0 from the memory location, a 180 milliseconds delay period has occurred.

Referring now to FIG. 55, the DELAY FOR 950 MICROSECONDS subroutine is shown. In a box 1646, the number 0015 is loaded into a selected memory location CT and is decremented in a box 1648. In a decision box 1650, a determination is made when the value in location CT is equal to 0 and the subroutine then returns to the program.

Figure 56:
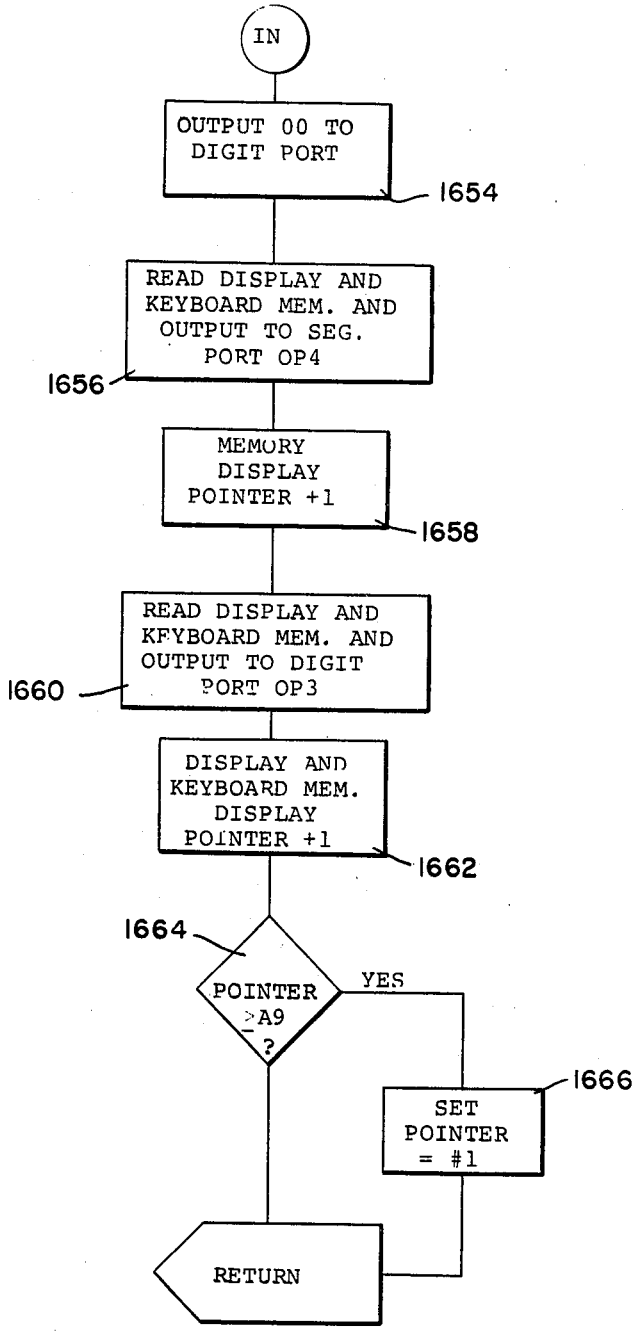
FIG. 56 is a flow diagram of the MUX (multiplexer) DISPLAY SUBROUTINE.

Referring now to the MUX DISPLAY subroutine of FIG. 56, the program has previously filled the "keyboard and display memory" with one word. In a box 1654, a number 00 is written into the digit port to turn the display off momentarily. In a box 1656, the display and keyboard memory is read from the position at which the pointer is pointing and the output is applied to segment port OP4. The memory display pointer is then incremented by 1 in a box 1658. In a box 1660, the addressed value such as A1 is read from the keyboard and display memory and the value is outputted to port OP3 followed by the display and output memory pointer being incremented by 1 in a box 1662. In a box 1664, a decision is made whether the memory pointer has reached 9 and if the pointer is greater than 9, the pointer is set to the first digit where there is data, that is to AO, the pointer setting function being performed in a box 1666 before returning to the overall routine. If the pointer is less than 9 as determined in box 1664, the operation returns directly to the main program.

Table V illustrates the message setting operation in accordance with the invention. It is to be noted at this time that message setting always preceeds time setting, if message setting is to be performed. This sequence is necessary because the high speed message setting operation of the illustrated system changes the time setting of the watch being set.

TABLE V

| | | | (0 = Pushed) (1 = Release) Toggle once per 8. | 16 = 1 sec. Real time | |
|---|---|---|---|---|---|
| LINE | DIS | TIME* | SET* | # PULSES | FUNCTION |
| 1 | 0 | 1 | 0 | 0 | Unlock bits |
| 2 | 0 | 0 | 0 | 36 | Resets watch |
| 3 | 0 | 1 | 1 | 10 | |
| 4 | 0 | 1 | 0 | 8 | Push and Release |
| 5 | 0 | 1 | 1 | 8 | set button |

TABLE V-continued

| | LINE | DIS | TIME* | SET* (0 = Pushed) (1 = Release) | # PULSES 16 = 1 sec. Real time Toggle once per 8. | | FUNCTION |
|---|---|---|---|---|---|---|---|
| | 6 | 0 | 1 | 0 | 8 | | 2nd Time |
| | 7 | 0 | 1 | 1 | 8 | | |
| | 8 | 0 | 1 | 0 | 8 | | " |
| | 9 | 0 | 1 | 1 | 8 | | |
| | 10 | 0 | 1 | 0 | 8 | | " |
| | 11 | 0 | 1 | 1 | 8 | | |
| | 12 | 0 | 1 | 0 | 8 | | 5 times total now |
| | 13 | 0 | 1 | 1 | 8 | | into message set mode, 1st character, 1st word. |
| | 14 | 0 | 0 | 1 | 16 | | Initializes an "A" in |
| | 15 | 0 | 1 | 1 | 8 | | 1st character |
| | 16 | 0 | 0 | 1 | 4 | | Slew to char. to set an |
| | 17 | 0 | 1 | 1 | 4 | | "H" (7 × 8) + 32 |
| H | 18 | 0 | 1 | 1 | | 88 | |
| | 19 | 0 | 0 | 1 | 4 | | |
| | 20 | 0 | 1 | 1 | 4 | | Push Time STOPS Release Time SLEW |
| | 21 | 0 | 0 | 1 | 4 | | Push time twice within |
| | 22 | 0 | 1 | 1 | 4 | | within one second |
| | 23 | 0 | 1 | 1 | 4 | | advances to next |
| | 24 | 0 | 0 | 1 | 4 | | character |
| A | 25 | 0 | 0 | 1 | 4 | | Slew to char. to set an |
| | 26 | 0 | 1 | 1 | | | "A" (42 × 8) + 32 |
| | 27 | 0 | 1 | 1 | | 368 | |
| | 28 | 0 | 1 | 1 | 4 | | Push time STOPS |
| | 29 | 0 | 1 | 1 | 4 | | release SLEW |
| | 30 | 0 | 0 | 1 | 4 | T | Push time twice |
| | 31 | 0 | 1 | 1 | 4 | T | within one second. |
| | 32 | 0 | 0 | 1 | 4 | T | ADVANCES TO NEXT |
| | 33 | 0 | 1 | 1 | 4 | T | CHARACTER |
| P | 34 | 0 | 0 | 1 | 4 | | SLEW TO CHAR. TO SET |
| | 35 | 0 | 1 | 1 | 4 | | "P" (17 × 8) + 32 |
| | 36 | 0 | 0 | 1 | | 168 | Push time STOPS |
| | 37 | 0 | 0 | 1 | 4 | | release SLEW |
| | 38 | 0 | 1 | 1 | 4 | | |
| | 39 | 0 | 0 | 1 | 4 | | ADVANCE TO NEXT |
| | 40 | 0 | 1 | 1 | 4 | | CHARACTER |
| | 41 | 0 | 0 | 1 | 4 | | |
| | 42 | 0 | 1 | 1 | 4 | | |
| P | 43 | 0 | 0 | 1 | 4 | | 2nd "P" (0 × 8) + 32 |
| | 44 | 0 | 1 | 1 | 4 | | |
| | 45 | 0 | 1 | 1 | | 32 | |
| | 46 | 0 | 0 | 1 | 4 | | STOPS SLEW |
| | 47 | 0 | 1 | 1 | 4 | | |
| | 48 | 0 | 0 | 1 | 4 | | ADVANCE TO NEXT |
| | 49 | 0 | 1 | 1 | 4 | | CHARACTER |
| | 50 | 0 | 0 | 1 | 4 | | |
| | 51 | 0 | 1 | 1 | 4 | | |
| Y | 52 | 0 | 0 | 1 | 4 | | "Y" (11 × 8) + 32 |
| | 53 | 0 | 1 | 1 | 4 | | |
| | 54 | 0 | 1 | 1 | | 120 | |
| | 55 | 0 | 0 | 1 | 4 | | STOPS SLEW |
| | 56 | 0 | 1 | 1 | 4 | | |
| | 57 | 0 | 0 | 1 | 4 | | GOES BACK TO |
| | 58 | 0 | 1 | 1 | 4 | | 1st CHARACTER |
| | 59 | 0 | 0 | 1 | 4 | | |
| | 60 | 0 | 1 | 1 | 4 | | |
| | 61 | 0 | 1 | 0 | 8 | | PUSH SET and RELEASE to |
| | 62 | 0 | 1 | 1 | 8 | | 1st CHAR. 2nd WORD |

The command bits DIS, TIME* and SET* are transferred to the serial interface for controlling the watch to receive its pulses. As previously explained DIS remains false until the setting operation is terminated by resetting Q at the end of the operation. The command bits shown in Table V are also the signals generated by the interface and transferred into the watch module. It is to be noted that in the debouncing circuit, TIME* and SET* are inverted. In line 1, the command code 010 provides the function of unlocking the bits and as previously explained unlocking is not followed by a train of pulses. A reset command of line 2 which is the code 000 resets the watch followed by 011 which releases the time and set buttons. Thirty-six pulses follow the command code in line 2 and 10 pulses follow the command code in line 3 to allow time for the interface and the watch circuit to pass the pulses and to respond. Because the message code is now being set into the display memory, the set button must be pushed and released five times to place the watch into the message set mode which is performed in lines 4 to 13. It is noted that a train of eight pulses after each set command is to allow the watch circuits such as debouncing circuits to respond to the command. Also, it is to be noted that each set by the code 010 is followed by the command code 011 because the watch requires the set button to be released. Lines 14 and 15 perform the function of initializing an A in the first character (CALL TIME IN ONE SECOND) formed by the command code 001 followed by 011 so that the time button is effectively pushed and released. Lines 14 and 15 are followed by bursts of 16 and 8 pulses respectively for allowing the watch circuits to responds. It is to be noted that initialization of an A is necessary as a reference in the first character of each word. In the lines 16–18, a pulse burst of 88 pulses slews the segement counter to an H, the pulses being $(7\times8)+32$. In lines 19 and 20, the time button is effectively pushed and released to conform to the watch logic, this being necessary even though slewing stops at the end of the burst of 88 pulses.

In lines 21 to 24, the watch is advanced to the next character by pushing time twice in one second. In lines 25 to 27, the slew is performed with 338 pulses to program an A and in lines 28 and 29, the stop slew condition is transferred to the watch. In lines 30 to 33, the watch advances to the next character and in lines 34 to 36, the slewing responds to a burst of 168 pulses to program or set a P. In order to stop the slew, lines 37 and 38 apply the code 001 and 011 to the LED array each followed by a pulse burst of four pulses.

Now to advance to the next character in lines 39to 42, the illustrative codes are performed each followed by a burst of four pulses. In lines 43 to 45 a second P is stored in memory which is $(0\times8)+32$ or a total of 32 pulse bursts. The slew is stopped in lines 46 and 47 and the watch is advanced to the next character in lines 48 to 51. In lines 52 to 54, in order to store a Y which is $(11\times8)+32$ pulses, the codes 001, 011 and 011 are respectively followed by pulse bursts of 4, 4 and 120 pulses. The slew is stopped in lines 55 and 56 and in lines 57 to 60, command codes 001, 011, 001 and 011 command the watch back to the first character. In lines 61 and 62, the command codes 010 and 011 set and release the set button which in the illustrative watch causes the watch to go to the first character of the second word which is now set at A. The operation proceeds in a similar manner to store the message for the other words and will not be explained in further detail.

The following table VI is for setting time and as explained, relative to the overall program only time may be set or time may be set after setting the message.

TABLE VI

| LINE | O = Pushed 1 = Release DIS | TIME* | SET* | # PULSES | 16 = 1 sec. Real time | FUNCTION |
|---|---|---|---|---|---|---|
| 1 | 0 | 1 | 0 | 0 | | UNLOCK BITS |
| 2 | 0 | 0 | 0 | 36 | 2-¼ SEC. | RESET WATCH |
| 3 | 0 | 1 | 1 | 10 | | |
| 4 | 0 | 1 | 0 | 8 | | SEQUENCES INTO |
| 5 | 0 | 1 | 1 | 8 | | SET-MONTH MODE |
| 6 | 0 | 0 | 1 | 4 | | READY TO SLEW |
| 7 | 0 | 1 | 1 | 4 | | (count) |
| 8 | 0 | 1 | 1 | = | [(Real/MO) × 8] | −8 SLEWING |
| 9 | 0 | 0 | 1 | 4 | | STOPS SLEWING |
| 10 | 0 | 1 | 1 | 4 | | |
| 11 | 0 | 1 | 0 | 8 | | SEQUENCES INTO SET |
| 12 | 0 | 1 | 1 | 8 | | - Day of Mo. Mode |
| 13 | 0 | 0 | 1 | 4 | | READY TO SLEW |
| 14 | 0 | 1 | 1 | 4 | | |
| 15 | 0 | 1 | 1 | = | [(Real/Day) × 8] | −8 SLEWING |
| 16 | 0 | 0 | 1 | 4 | | STOPS SLEWING |
| 17 | 0 | 1 | 1 | 4 | | |

If only the time is to be set and not the message, then command bits 010 are transferred to unlock the bits. However, if message set is followed by the time set, the line 1 unlocking is not repeated. Lines 2 and 3 which perform the reset watch function, that is pushing the reset button and releasing it applies the codes 000 and 011 respectfully followed by bursts of 36 and 10 pulses. Lines 4 and 5 sequences the watch module into the set month mode, that is one push of the set button by command codes 010 and 011, each followed by a burst of 8 pulses for the watch circuits to respond. In lines 6 and 7, the function ready to slew or count is performed by the command codes 001 and 011 and in line 8 in response to command code 011, slewing is formed by a pulse train equal to $[(\text{Real MO})\times8]-8$ pulses. In lines 9 and 10, in response to the command code 001 and 011 the watch goes to the stop slewing condition and the month that is calculated by the processor is stored in the month counter. In lines 11 and 12 in response to command codes 010 and 011, the watch sequences into the set day of month mode and in lines 13 and 14 in response to the command codes 001 and 011 the watch goes into the ready to slew condition. In line 15 in response to command code 011, the burst of pulses of slewing is provided to the watch equal to $[(\text{Real/day})\times8]-8$. In lines 16 and 17, the watch stops slewing in response to the command codes 001 and 011. This operation continues in a similar manner for time setting until the seconds are set and the setting operation is then terminated by resetting Q.

Thus, there has been provided a time setting and message setting system for digital watches that transfers the setting data to the watch by emitting energy pulses such as pulses of light or IR energy. The commands may be coded and decoded by pulse width modulation. The digital watch includes interface circuitry that provides automatic reset and automatic power turn off from the interface circuitry when the watch setting operation is terminated for any reason. The system operates without any feedback from the watch to the setting unit to simplify the operator's task. The setting operation is performed at a high rate of speed as determined by the selected rate of command bits and pulses so that both message and time setting are performed in a minimum of time. For example, the time required to push the time button twice in one second as required in manual setting is actually performed in 6 milliseconds by the system of the invention. The concept is illustrated for setting one watch at a time but is equally applicable to setting a plurality of watches at the same time. The principles of the invention have been illustrated for an LED watch, but it is to be understood that they are equally applicable to other types of watches such as liquid crystal watches. The system of the invention not only can be utilized with a watch module but can set a cased digital watch on or off of a person's wrist. The serial interface operates during a setting operation to duplicate the signals that may be normally provided by the manual buttons.

It is to be emphasized that the system of the invention is not to be limited to transmission and reception of IR or visible energy but includes any frequency region that can be transmitted and received such as RF or ultrasonic, for example, if a suitable transmitter and receiver is provided. Further, it is to be understood that although the illustrated system provides time setting or message setting followed by time setting, other arrangements which provide only message setting or provides time setting followed by message setting are within the scope of the invention. For example, for message setting only, the operation could be performed in real time or by speeding up the message setting circuits and bypassing the time keeping divider chain.

What is claimed is:

1. A system for setting a digital watch having a divider chain including a plurality of counter registers and having an energy responsive means for receiving setting pulses comprising:

a data entry unit including processing means for generating pulse bursts of a calculated number of pulses for selectively causing said counter registers to count a predetermined number of times from a reset count, a reference watch for time setting, a keyboard for entering messages to be set in said digital watch and means for providing commands as a pulse width modulated code, and an energy source responsive to said processing means for emitting said commands and said pulse bursts for reception by said energy responsive means.

2. The combination of claim 1 in which said means for providing commands further includes means to provide a first command for unlocking setting controls in said digital watch and to provide subsequent commands for message setting and for time setting, each command being a 3 bit code, each subsequent command being serially followed by a pulse burst.

3. The combination of claim 1 in which said digital watch includes an initial frequency divider having a selected point and developing first signals at said point at a first frequency to control said divider chain during time counting operation and means for resetting said plurality of counter registers, and said processing means includes means for providing said pulse bursts to be applied to said selected point at a frequency that is at least a plurality of integral multiples of said first frequency.

4. The combination of claim 1 in which said digital watch includes slewing means for slewing between different characters for setting said messages and an initial frequency divider providing a slewing clock signal at a first frequency for controlling said slewing means, and said processing means includes means for providing said pulse bursts for controlling said initial divider so that said slewing clock signal is at a frequency that is at least a plurality of integral multiples of said first frequency for substantially increasing the frequency of said slewing means.

5. The combination of claim 1 in which said watch includes message slewing means and said processing means includes means to calculate the number of pulses for message slewing for programming the watch to characters derived from said keyboard.

6. A watch setting system comprising:

a data entry unit for providing energy pulses of serial command pulses representing command codes and of pulse trains, said data entry unit including a watch holder for emitting said serial command pulses and said pulse trains, said data entry unit including a reference time source and a processor for calculating said command codes and the number of pulses to be emitted in said pulse trains for setting said watch, a digital watch including a time divider chain having a plurality of counter registers and including energy receiving means positioned on said watch for receiving said serial command pulses and said pulse trains for being selectively applied to said counter registers to count a predetermined number of times, said watch including interface means responsive to said energy receiving means for controlling said watch in response to said serial command pulses and said pulse trains for causing said registers to count a predetermined number of times, said watch having at least three buttons and including means for generating a master reset signal in response to said command codes from said interface means and means responsive to said master reset signal to convert said watch to a two button watch.

7. An interface unit for a digital watch that includes a chain of counters for maintaining a sequence of time levels and for responding to a data entry unit that applies as energy pulses, control data as command codes and bursts of data pulses to said interface unit, said digital watch including an initial divider having a connecting point for controlling the frequency of said chain of counters, said watch responding to set and time signals for controlling, setting and displaying of said time levels comprising:

energy sensitive means for receiving said energy pulses from said data entry unit;

shift register means responsive to said control data from said energy sensitive means for providing said set and time signals;

data timer means responsive to said control data for providing data control signals;

latching means for receiving commands from said shift register means and coupled to said watch for passing said set and time signals thereto for selecting the counters of said chain of counters;

gating means responsive to said control data and coupled to said watch for applying said bursts of pulses to said connecting point of said initial divider, and toggle means responsive to said data control signals for sequentially controlling said latching means to receive the command codes from said shift register means and controlling said gating means to pass said bursts of pulses to said initial divider.

8. The combination of claim 7 in which said interface unit includes unlock means responsive to an initial command code for unlocking said toggle means so said latching means and said gating means receive said respective command codes and pulse bursts.

9. The combination of claim 8 in which said unlock means includes means for locking said toggle means when said toggle means is unlocked, upon termination of reception of control data from said data entry unit.

10. The combination of claim 8 in which said watch includes a manual set button and said interface means includes a power-on circuit responsive to said manual set button to apply a power-on signal to said interface unit, said power-on circuit including means to turn off said power-on signal at the termination of a setting operation.

11. The combination of claim 7 in which said connecting point of said initial divider has a first normal operating frequency and said control data is applied to said interface unit at a frequency that is at least a substantial integral multiple of said normal operating frequency, said initial divider responding to said bursts of pulses from said gating means to increase the frequency of the selected counters.

12. A digital watch module for being set in response to data pulses received from a data entry unit at a first frequency comprising:

an interface unit for receiving said data pulses, a counter chain in said watch module including a frequency divider having a connection point for transferring counter pulses through said frequency divider at a normal operating frequency being a relatively small fraction of said first frequency, and means coupling said interface unit to said connection point in said frequency divider.

13. The combination of claim 12 in which said data pulses include alternately three command pulses and a burst of pulses representative of the divider count and said interface unit includes latching means, for receiving said command pulses, gating means for receiving said bursts of pulses and coupled to said connection point, and toggle means for controlling said command pulses to be stored in said latching means and for controlling said gating means to pass said bursts of pulses to said connection point.

14. A digital watch module being message set in response to data pulses received from a data entry unit at a selected frequency comprising:

slewing means for slewing through a sequence of characters, memory means for storing selected characters received from said slewing means, an initial divider for developing slewing pulses at a normal operating frequency being at a pulse frequency such that said selected frequency is at least a plurality of integral multiples of said normal operating frequency, and an interface unit for receiving said data pulses and transferring selected groups of said data pulses to said slewing means at said selected frequency.

15. The combination of claim 14 in which said data pulses are energy pulses emitted from the data entry unit and said watch module includes an energy responsive transistor on the surface thereof and coupled to said interface unit, said energy responsive transistor receiving said energy pulses.

16. The combination of claim 15 in which said data pulses include command pulses coded with pulse width modulation to represent a first or a second binary state and said interface unit includes decoding means responsive to the coded pulses received from said energy responsive transistor to develop command pulses at a first or at a second binary level to be transferred to said watch module.

17. An interface unit for a digital watch that includes a message display, a message memory and slewing means and an initial divider for providing clock signals to said slewing means, said digital watch responding to set and time signals from said interface unit for setting said message, said interface unit responding to a data entry unit that applies control data as command codes and bursts of data pulses to said interface unit, comprising:

means for receiving said control data, data timer means responsive to said control data for generating data control signals, shift register means for receiving said command codes and providing said set and time signals, latching means for receiving commands from said shift register means and coupled to said watch for passing said set and time signals thereto, gating means for receiving said control data and coupled to said watch for applying said bursts of pulses to said initial divider, and toggle means responsive to said data control signals for sequentially controlling said latching means to receive the commands from said shiftregister means and controlling said gating means to pass said bursts of pulses to said initial divider.

18. The combination of claim 17 in which the watch also includes a chain of counters coupled to said initial divider for maintaining a sequence of time levels.

19. The combination of claim 17 in which said interface unit includes unlock means responsive to unlock command signals of said command codes to unlock said interface unit and responsive to the absence of control data to lock said interface.

* * * * *